US007252364B2

(12) United States Patent
Chikuma et al.

(10) Patent No.: US 7,252,364 B2
(45) Date of Patent: Aug. 7, 2007

(54) INK JET PRINTING APPARATUS AND PRINTING POSITION SETTING METHOD OF THE APPARATUS

(75) Inventors: Toshiyuki Chikuma, Kanagawa (JP); Hisatsugu Naito, Kanagawa (JP); Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 620 days.

(21) Appl. No.: 10/788,137

(22) Filed: Feb. 25, 2004

(65) Prior Publication Data

US 2004/0165033 A1 Aug. 26, 2004

(30) Foreign Application Priority Data

Feb. 26, 2003 (JP) ..... 2003-049971

(51) Int. Cl.
*B41J 2/15* (2006.01)

(52) U.S. Cl. ..... 347/41; 347/19

(58) Field of Classification Search ..... 347/41, 347/19; 358/3.03

See application file for complete search history.

(56) References Cited

U.S. PATENT DOCUMENTS

| | | | | |
|---|---|---|---|---|
| 4,723,129 | A | 2/1988 | Endo et al. | 346/1.1 |
| 4,740,796 | A | 4/1988 | Endo et al. | 346/1.1 |
| 6,164,745 | A * | 12/2000 | Nagoshi et al. | 347/15 |
| 6,310,637 | B1 * | 10/2001 | Shimada et al. | 347/19 |
| 6,532,026 | B2 * | 3/2003 | Takahashi et al. | 347/41 |

FOREIGN PATENT DOCUMENTS

JP 8-181379 7/1996

* cited by examiner

*Primary Examiner*—Lamson Nguyen
(74) *Attorney, Agent, or Firm*—Morgan & Finnegan L.L.P.

(57) ABSTRACT

An inkjet printing apparatus prints by scanning an inkjet printhead for discharging ink and a printing medium relative to each other. The printhead includes a first nozzle group used to print a dot having a first density, and a second nozzle group used to print a dot having a second density. The inkjet printing apparatus has a first printing mode in which only one of the first and second nozzle groups is used during one printing scan, and a second printing mode in which the first and second nozzle groups are driven at different timings during one printing scan. In this inkjet printing apparatus, a pattern for adjusting the relative printing positions of the nozzle rows in the first printing mode is printed. From this pattern, set values of relative printing positions in the first printing mode are specified. On the basis of the specified set values, set values of the relative printing positions of the nozzle rows in the second printing mode are determined.

14 Claims, 43 Drawing Sheets

+3

INK JET PRINTING APPARATUS AND PRINTING POSITION SETTING METHOD OF THE APPARATUS

FIELD OF THE INVENTION

The present invention relates to an inkjet printing apparatus and a printing position setting method of the apparatus and, more particularly, to the adjustment of relative printing positions of nozzle rows in an inkjet printing apparatus which prints by using a printhead having a plurality of nozzles for printing dots (dot means the smallest unit which constitutes a pixel) different in density, and also having a plurality of nozzle rows.

The present invention is applicable to all apparatuses using printing media such as paper, cloth, leather, nonwoven fabric, OHP sheets, and metals. Practical examples are business machines such as printing apparatus, copying machines, and facsimile apparatuses, and industrial production apparatuses.

BACKGROUND OF THE INVENTION

As information output apparatuses for, e.g., wordprocessors, personal computers, and facsimile apparatuses, printing apparatus which print desired information such as characters and images on printing media such as paper sheets and film sheets are widely used.

Various systems are known as printing systems of such printing apparatus. An inkjet system which prints by discharging ink from a printing means (printhead) onto a printing medium has the advantages that, e.g., a printing apparatus can be readily made compact, high-precision images can be printed at high speed, the running cost is low, noise is low because the system is a non-impact system, and color images can be easily printed by using ink liquids of a plurality of colors. Therefore, this inkjet system is widely used as a general printing system.

In a printhead of a printing apparatus (to be referred to as an inkjet printing apparatus hereinafter) using the inkjet system, discharge orifices (nozzles) have variations in discharge rate and discharge direction. When a plurality of discharge orifice rows are formed, slight variations are produced in accuracy of attachment to the printhead. As a consequence, the printing position of one nozzle row slightly differs from that of another nozzle row. If printing is performed while the relative printing positions of discharge orifice rows are thus different, ruled lines are formed in different positions, or the density of dots printed by ink discharged from the printhead varies, resulting in grainy images.

Accordingly, to improve the quality of printed images, the relative printing positions of nozzle rows must be aligned. This is generally called printing position adjustment.

This printing position adjustment is done by printing, on a printing medium, a plurality of patterns in which the relative printing positions of objects (e.g., nozzle rows) of the printing position adjustment are shifted little by little, and selecting a pattern in which optimum relative printing positions are printed. Methods of selecting the optimum pattern are roughly classified into two methods: a method of allowing a user to select relative printing positions; and a method of aligning relative printing positions by installing a certain relative printing position adjusting means in the printing apparatus itself.

As described above, the printing quality of an inkjet printing apparatus having a plurality of nozzle rows can be improved by adjusting the relative printing positions of these nozzle rows before the printing apparatus is used.

FIG. 8 is a view showing examples of printing patterns for performing the printing position adjustment between a plurality of nozzle rows. This printing position adjustment is performed to adjust the relative printing positions of a plurality of nozzle rows. Accordingly, the type of printing pattern changes in accordance with the type of nozzle row of a printhead. The printing patterns shown in FIG. 8 are printing position adjusting patterns for an inkjet printing apparatus which uses a printhead having an even-numbered nozzle row and odd-numbered nozzle row for each of ink liquids of black, cyan, yellow, and magenta as shown in FIG. 11.

Assume that this printhead shown in FIG. 11 can drive the nozzle rows of the individual colors at respective arbitrary timings without limiting the discharge timings of each color and each nozzle row. Assume also that the interval of the driving timings is so set that dots from the same nozzle can be printed at an interval of 1,200 dpi in the main scan direction during the same main scan.

The printing position adjustment is performed by printing a specific test pattern (printing position adjusting pattern) which allows easy detection of relative printing position differences on a printing medium (generally a paper sheet). On the basis of one nozzle row as an object of the printing position adjustment, a specific pattern is printed a plurality of number of times (in FIG. 8, 11 times from +7 to −3 or from +5 to −5) while the relative printing position of the other nozzle row as an object of relative printing position matching is changed by changing the driving timing. Of these printed patterns, the set value of a pattern having the best matched printing positions is stored in a nonvolatile memory (EEPROM) of the printing apparatus. This process is performed for all nozzle rows (some of them may also be processed together) as objects of the printing position adjustment.

Combinations of nozzle rows to be subjected to the printing position adjustment by using patterns A to F shown in FIG. 8 are as follows.

A: Black even-numbered nozzle row/odd-numbered nozzle row

B: Cyan even-numbered nozzle row/odd-numbered nozzle row

C: Magenta even-numbered nozzle row/odd-numbered nozzle row

D: Black two-way printing

E: Color (cyan) two-way printing

F: Black/color (cyan)

For yellow, no printing position adjustment is performed between even- and odd-numbered nozzle rows. This is so because the density of yellow is low, and this makes it difficult to determine a set value with which the relative positions match best when the above patterns are printed. For this reason, the result of adjustment of cyan is used for yellow. This cyan adjustment result is also used in two-way printing position adjustment of ink liquids of other colors (magenta and yellow), so no specific patterns for the purpose are prepared.

After the printing position adjusting patterns are thus printed, a set value is selected from the printing results by one of the following two methods. In one method, a user selects a set value from the test pattern printing results, and manually inputs the set value from a host apparatus connected to the printing apparatus. In the other method, the printed test patterns are sensed by an internal sensor of the printing apparatus, and an optimum set value is selected on the basis of a density change or the like.

The printing position adjustment will be described in more detail below with reference to FIGS. 9 and 12 to 15 by taking the pattern A (black even-numbered nozzle row/odd-numbered nozzle row printing position adjusting pattern) as an example.

FIG. 9 is a view showing, in an enlarged scale, the state of dots printed by set value +3 in the pattern A shown in FIG. 8. The abscissa indicates printing positions in the scan direction. Assuming that the scale shown in FIG. 9 is divided for every 1,200 dpi, dots are printed from the left to the right in FIG. 9, i.e., dots are printed in ascending order of value on the abscissa. Blank circles indicate dots printed by an even-numbered nozzle row, and hatched circles indicate dots printed by an odd-numbered nozzle row.

That is, FIG. 9 shows the state printed by repeating a process in which each of an even-numbered nozzle row A and odd-numbered nozzle row B of black nozzle rows 1A of the printhead shown in FIG. 11 is first continuously driven 7 times (7 columns are printed) and then kept undriven 7 times in the main scan direction while the printing position is moved. In this embodiment, printing is performed by moving the printing position by 1,200 dpi at one time. More specifically, dots of the even-numbered nozzle row are printed in main scan direction printing positions 0 to 6 and 14 to 20, and dots of the odd-numbered nozzle row are printed in 10 to 16 and 24 to 30. In main scan direction printing positions 14 to 16, the dots printed by the even- and odd-numbered nozzle rows overlap each other.

FIG. 12 shows the state of those dots of the pattern A shown in FIG. 8, which are printed by set value +2. Similar to FIG. 9, the abscissa indicates printing positions in the main scan direction in which printing is performed, the scale is divided for every 1,200 dpi, dots are printed from the left to the right in FIG. 12, blank circles indicate dots printed by the even-numbered nozzle row, and hatched circles indicate dots printed by the odd-numbered nozzle row. In addition, driving and non-driving of the even- and odd-numbered nozzle rows are switched every 7 times in the same manner as in FIG. 9.

The difference of FIG. 12 from FIG. 9 is that the printing positions of the odd-numbered nozzles are shifted by 1,200 dpi to the left (the driving timings of the odd-numbered nozzles are advanced by 1,200 dpi) without changing printing by the even-numbered nozzles. Consequently, as shown in FIG. 12, although dots printed by the even-numbered nozzle row are formed in main scan printing positions 0 to 6 and 14 to 20 in the same manner as in FIG. 9, the main scan printing positions of the odd-numbered nozzle row are shifted to the left, i.e., to 9 to 15 and 23 to 29. Accordingly, different from FIG. 9, the dots printed by the even- and odd-numbered nozzle rows overlap each other in two main scan printing positions 14 and 15.

FIG. 13 shows the state of those dots of the pattern A shown in FIG. 8, which are printed by set value +1. That is, FIG. 13 shows the state of printed dots when the printing positions of the odd-numbered nozzle row are further shifted by 1,200 dpi to the left from the state shown in FIG. 12 (the driving timings are advanced by the time corresponding to 1,200 dpi). FIG. 14 shows the state of those dots of the pattern A shown in FIG. 8, which are printed by set value 0. FIG. 15 shows the state of those dots of the pattern A shown in FIG. 8, which are printed by set value −1.

As described above, only the printing timings of the odd-numbered nozzle row are changed one after another without changing the driving timings of the even-numbered nozzle row. As a consequence, the main scan direction printing positions of the dots printed by the odd-numbered nozzles change, and this changes the relative printing positions of the dots printed by the even- and odd-numbered nozzle rows. After a plurality of patterns are printed by thus changing the set values, a pattern (i.e., the pattern shown in FIG. 14 of the patterns shown in FIGS. 9 and 12 to 15) in which the dots printed by the even- and odd-numbered nozzle rows most smoothly connect. In this way, a relative printing position set value is determined and stored.

When the pattern shown in FIG. 14 is selected by thus performing the printing position adjustment, if the even-numbered nozzle row is driven at the driving timing when main scan direction printing position 0 in FIG. 14 is printed by the even-numbered nozzle row, and the odd-numbered nozzle row is driven at the driving timing when main scan direction printing position 7 in FIG. 14 is printed by the odd-numbered nozzle row, the interval between the printed dots in the main scan direction printing positions is 7. Therefore, the driving timing of the odd-numbered nozzle row is further advanced by 7 from the state shown in FIG. 14. In this manner, the printing positions of the even- and odd-numbered nozzle rows can be matched in the main scan direction.

As described above, the relative printing position set value of the even- and odd-numbered nozzle rows is determined. This similarly applies to the other patterns (patterns B to F) shown in FIG. 8. That is, on the basis of one of the two nozzle rows as objects of the printing position adjustment, printing is performed by changing the driving timing of the other nozzle row by 1,200 dpi at one time. Consequently, the relative printing positions of the two nozzle rows as objects of the printing position adjustment can be made different from each other. By selecting the smoothest pattern from a plurality of different printed patterns, the printing position set value of these nozzles can be obtained.

When a printhead having a plurality of discharge orifice groups (nozzle groups) is so controlled that different discharge orifice groups are not driven in the same column position during the same scan (i.e., so controlled that nozzles of different discharge orifice groups cannot be simultaneously driven), printing data supplied to the head for each column can be divided into discharge orifice groups, and a printing data transfer signal line can be shared by different discharge orifice groups. This makes it possible to reduce the costs of the printhead and printing apparatus.

Accordingly, in a conventionally proposed printing apparatus which scans a printhead having different nozzle groups, different discharge orifice groups are driven at different driving timings, thereby sequentially switching different discharge orifices.

FIGS. 10A to 10F are views showing various arrangements of discharge orifice groups of printheads used in such a printing apparatus. In FIGS. 10A to 10F, discharge orifices indicated by A and B form different discharge orifice groups, and the discharge orifice groups A and B cannot be simultaneously driven in this embodiment.

FIG. 10A shows an arrangement in which the discharge orifice groups A and B are formed by different discharge orifice rows (nozzle rows), and these two rows are shifted from each other by the half nozzle pitch. FIG. 10B shows an arrangement in which the discharge orifice groups A and B are alternately arranged in the same row. FIG. 10C shows an arrangement in which two rows of each of the discharge orifice groups A and B are formed, and these two rows of each discharge orifice group are shifted from each other by the half nozzle pitch.

FIGS. 10D to 10F illustrate arrangements in each of which discharge orifice groups different in discharge amount are formed for one printing ink. That is, in these arrangements shown in FIGS. 10D to 10F, the discharge amounts of the discharge orifice groups A and B are different, i.e., the discharge amount of the discharge orifice group A is larger. In each of the arrangements shown in FIGS. 10D to 10F, two rows of each of the discharge orifice groups A and B are formed, and these two rows of each discharge orifice group are shifted from each other by the half nozzle pitch. However, these arrangements are different in row arrangement order. In the arrangement shown in FIG. 10F, two rows in each of which the discharge orifice groups A and B are alternately arranged are formed, and the positions (the order in the row) of discharge orifices indicated by A and B in one row are different from those of the other row.

When printing is to be performed by using a printhead having discharge orifice groups different in discharge amount, nozzles having a small discharge amount are used for highlighted portions to reduce the graininess, and nozzles having a large discharge amount are used for high-density portions to reduce the number of times of discharge and express high densities. In this way, the printing quality can be improved without lowering the printing speed.

In addition, when a printing apparatus which prints by using the printhead as described above has printing modes such as a printing mode (high-speed mode) in which images are formed by using only nozzles having a large discharge amount in order to give priority to the printing speed over the printing quality, and a printing mode (high-quality mode) in which images are formed by using only nozzles having a small discharge amount in order to give priority to the printing quality over the printing speed, printing meeting conditions desired by the user can be performed. This apparatus is disclosed in, e.g., Japanese Patent Laid-Open No. 8-183179.

The problem of a printing apparatus using a printhead having a plurality of discharge orifice groups as described above will be explained below by taking as an example a printhead having a plurality of discharge orifices different in discharge characteristic shown in FIG. 5. Referring to FIG. 5, nozzles having a large discharge amount are represented by "LARGE NOZZLE", and nozzles having a small discharge amount are represented by "SMALL NOZZLE". The same applies to the following explanation.

The printing position adjustment performed for this printhead having nozzles different in discharge amount as described above is based on the assumption that the driving timings of the large and small nozzles are different when printing is performed by the same scan.

FIGS. 6, 7, 30A, and 30B are views for explaining the discharge operation and the positions of printed dots when the printing resolution of the printhead shown in FIG. 5 is 600 dpi and the printing position adjustment pitch is 1,200 dpi.

Referring to FIGS. 30A and 30B, the abscissa indicates the main scan direction, and a printhead 701 can be driven to discharge ink in each column position indicated by the alternate long and short dashed line. The printhead 701 drives a discharge orifice group 701A (large nozzles) and a discharge orifice group 701B (small nozzles) at different driving timings during the same scan, thereby printing a target pixel 700.

FIG. 30A shows the state in which the discharge orifice group 701A (large nozzles) is driven in main scan direction printing position 0. FIG. 30B shows the state in which, after the state shown in FIG. 30A, the printhead 701 is moved by 1,200 dpi to the left in FIG. 30B and the discharge orifice group 701B is driven in main scan direction printing position 1. Even when the discharge orifice groups 701A and 701B are driven at these timings, dots are printed in a 1,200-dpi position on the left side of the target pixel 700 (a 600-dpi pixel including main scan direction printing positions 2 and 3) because the ink discharge speed and discharge direction of one discharge orifice group are different from those of the other.

In each of FIGS. 30A and 30B, the scan direction of the printhead 701 is indicated by the arrow, and. a discharge orifice group (nozzle group) currently being driven in the printhead 701 is hatched. FIG. 30A indicates that the large nozzle row 701A is driven, and FIG. 30B indicates that the small nozzle row 701B is driven. The dots printed in the target pixel 700 by the above driving are hatched in the target pixel 700. For convenience's sake, the sizes of these printed dots in the target pixel are the same as the sizes of the respective corresponding discharge orifices, and the relationship between the nozzle which has used to print the dot and the dot printed in the target pixel is indicated by the arrow. In FIG. 30B, the position of the printhead when the large nozzles are driven in FIG. 30A is also indicated by the dotted lines.

FIG. 6 shows FIGS. 30A and 30B in the same drawing. Referring to FIG. 6, the positions of the printhead at driving timings at which ink droplets discharged from the individual discharge orifice groups can be printed in the target pixel 700, when the discharge directions and discharge speeds of these ink droplets are taken into account, are illustrated above and below the target pixel 700. The relationships between the discharge orifice groups used and the printed dots are indicated by the arrows. In the following description, the two printing states of the printhead during printing scan in the main scan direction are illustrated in one drawing as shown in FIG. 6.

FIG. 6 shows the state in which when the driving timings of the large nozzles 701A and small nozzles 701B are staggered by 1,200 dpi, ink droplets discharged from the large and small nozzles can be printed in the same column position of the target pixel 700. FIG. 7 shows the state in which when the driving timings of the large nozzles 701A and small nozzles 701B are the same, ink droplets discharged from the large and small nozzles can be printed in the same column position of the target pixel 700.

When ink droplets are to be printed in the same column position as shown in FIG. 6, no problem arises under conditions by which the individual discharge orifice groups are driven at different timings (in different column positions). However, when ink droplets cannot be printed in the same main scan direction printing position (column position) unless the driving timings of the large and small nozzles are the same as shown in FIG. 7, the printhead based on the assumption that the large and small nozzles are driven at different timings as mentioned earlier cannot print dots in the same column position.

Note that the above-mentioned discharge orifice groups having different characteristics are not only nozzle groups having different discharge amounts, but also nozzle groups used to print dots different in density. Examples are discharge orifice groups which discharge ink droplets of the same color but different in density, and discharge orifice nozzles which discharge ink droplets of different colors to perform color printing by using ink liquids of a plurality of colors. Also, the aforementioned problem similarly arises in a printhead which includes different discharge orifice groups having the same characteristics, and which is so restricted as to be unable to drive these discharge orifice groups in the same column position (at the same timing).

SUMMARY OF THE INVENTION

It is an object of the present invention to facilitate, in an inkjet printing apparatus which prints by relatively scanning a printhead having first and second nozzle groups for printing dots different in density, and also having a plurality of nozzle rows, the adjustment of the relative printing positions of the nozzle rows when printing is performed by driving the first and second nozzle groups at different timings.

According to an aspect of the present invention, there is provided an inkjet printing apparatus for printing by scanning an inkjet printhead for discharging ink and a printing medium relative to each other, wherein the printhead comprises a first nozzle group used to print a dot having a first density, and a second nozzle group used to print a dot having a second density, and also has a plurality of nozzle groups, and the inkjet printing apparatus has a first printing mode in which only one of the first and second nozzle groups is used during one printing scan, and a second printing mode in which the first and second nozzle groups are driven at different timings during one printing scan, and wherein the inkjet printing apparatus comprises printing position setting means for determining set values of relative printing positions of the plurality of nozzle rows in the second printing mode, on the basis of set values of relative printing positions specified from a pattern for adjusting relative printing positions of the plurality of nozzle rows in the first printing mode.

With this arrangement, in the second printing mode in which the two nozzle groups are driven at different timings, the printing position set value of one nozzle group is changed as needed. This eliminates the need for special printing position adjustment for the second printing mode. Furthermore, when this nozzle group whose printing position set value is to be changed is, e.g., a nozzle group used to print dots having the lower density, deterioration of the image quality of printed images can be prevented.

Accordingly, it is no longer necessary to adjust the relative printing positions of the nozzle rows for each of a plurality of printing modes. This reduces the load on the user. In addition, the relative printing positions of the two nozzle rows can be so set as to prevent deterioration of the image quality of printed images.

A resolution of relative printing position adjustment in the first printing mode may be an integral multiple of a resolution of relative printing position adjustment in the second printing mode.

Preferably, if a set value of a relative printing position of one of the two nozzle groups must be changed, a set value of a nozzle group to be used to print a dot having a low density is not changed.

Preferably, the printing apparatus further comprises two-way printing position setting means for, when printing is to be performed by scanning the printhead forward and backward, determining set values of relative printing positions in forward and backward scans of the same nozzle row in the second printing mode, on the basis of set values of relative printing positions determined from a pattern for adjusting relative printing positions in forward and backward scans of the same nozzle row in the first printing mode.

The the first and second nozzle groups may be different in size of a dot as a unit of printing, in density of ink to be used, or in color of ink to be used.

The printhead may comprise a first nozzle row including the first nozzle group, and a second nozzle row including the second nozzle group, or a plurality of nozzle rows in each of which nozzles of the first nozzle group and nozzles of the second nozzle group are alternately arranged.

The set value in the first printing mode may be input by a user by referring to the pattern.

Preferably, the printing apparatus further comprises reading means for reading the pattern, and set value selecting means for selecting the set value in the first printing mode.

The present invention can also be implemented as an inkjet printing apparatus printing position setting method, a computer program for allowing a computer to execute the method, and a storage medium storing the computer program, as well as the inkjet printing apparatus described above.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. In the following embodiments, a printer will be described as an example of a printing apparatus for utilizing an inkjet printing system.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

First, the entire arrangement and control configuration of a printing apparatus common to embodiments of the present invention to be explained below will be described.

(Arrangement of Printing Apparatus)

Figure 1:
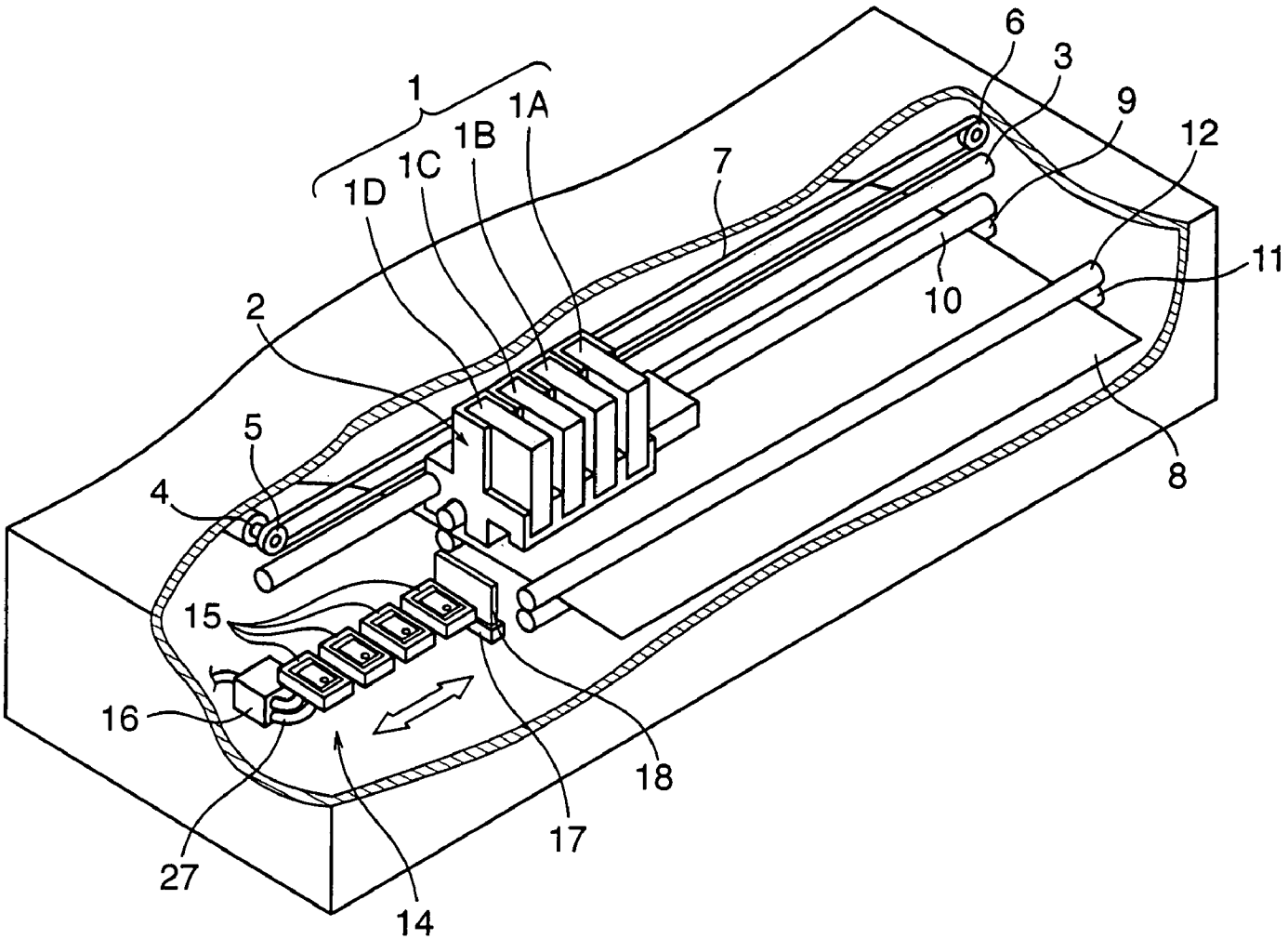
FIG. 1 a perspective view schematically showing the main parts of an inkjet printing apparatus.

FIG. 1 is a perspective view schematically showing the major components of an inkjet printing apparatus according to the present invention. Referring to FIG. 1, a head cartridge 1 as a printing means is detachably mounted on a carriage 2. The head cartridge 1 is made up of four head cartridges 1A, 1B, 1C, and 1D for printing ink liquids of different types (e.g., different colors).

Figure 10A:
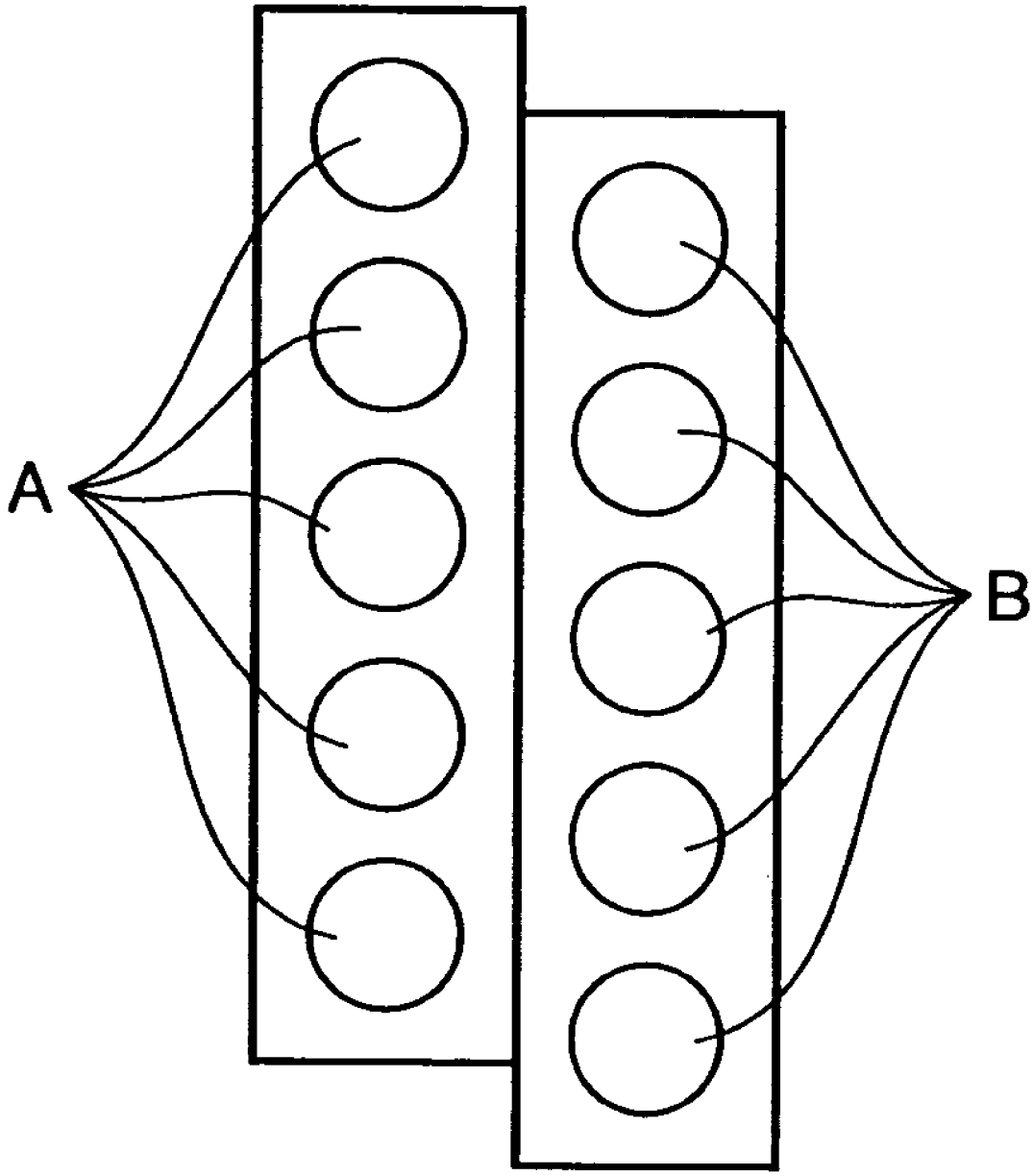
FIGS. 10A to 10F are views showing various arrangements of discharge orifice groups of the printhead.
Figure 10B:
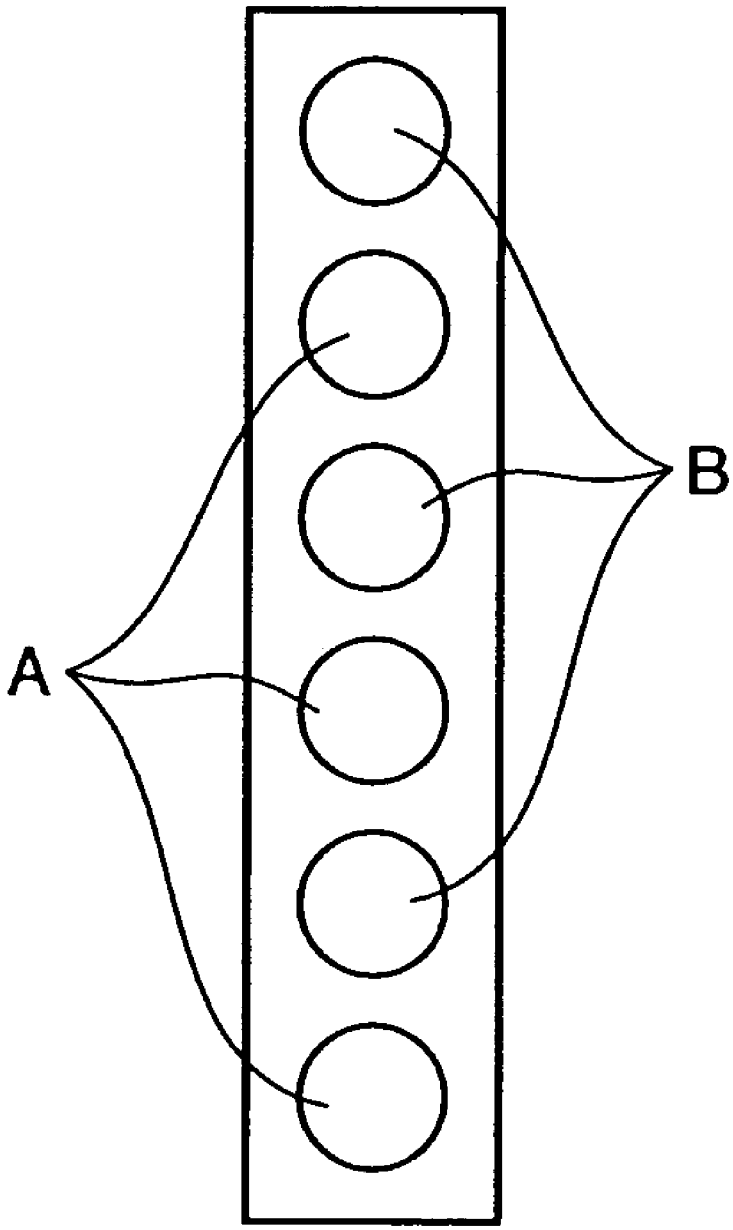
Figure 10C:
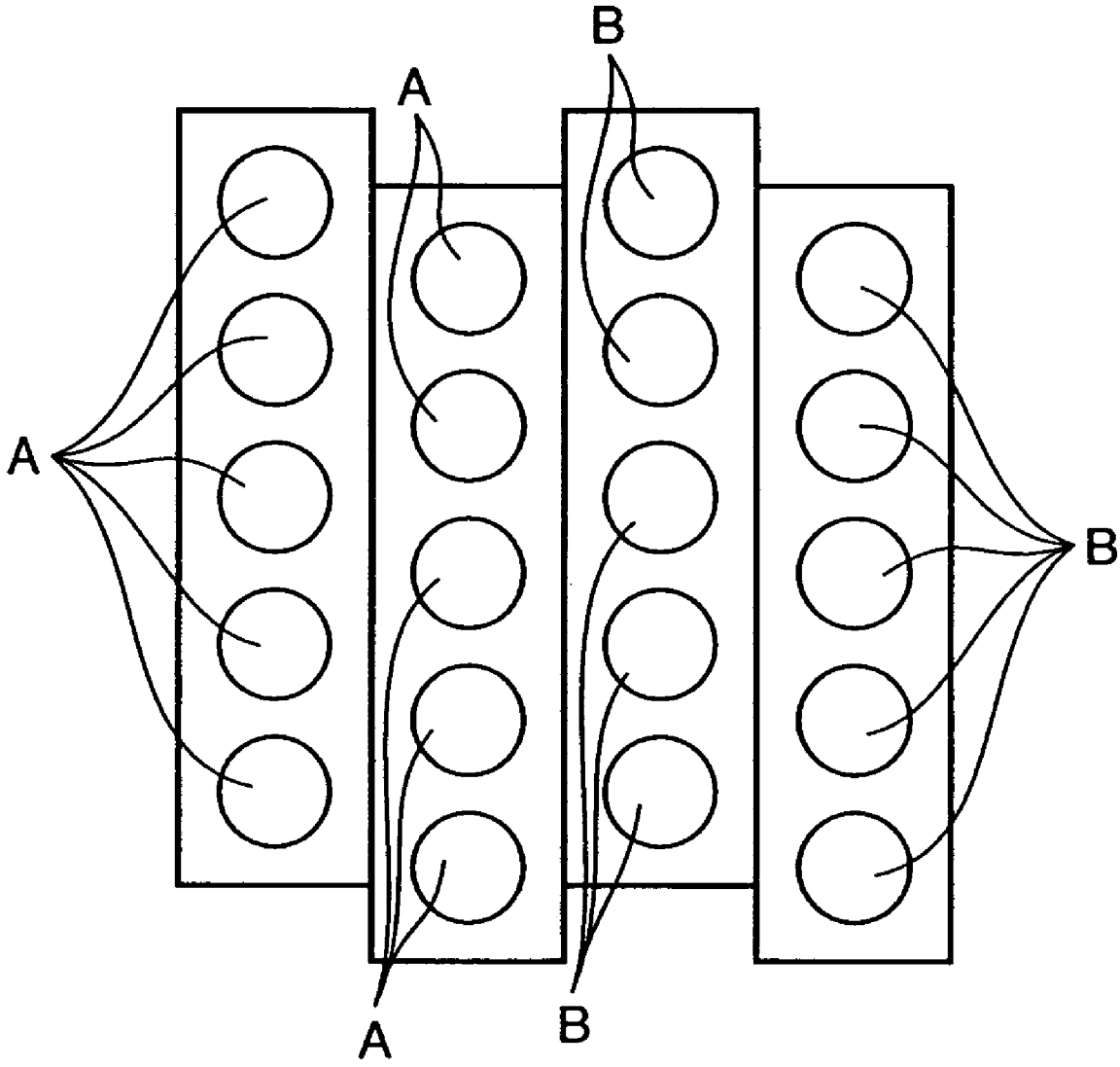
Figure 10D:
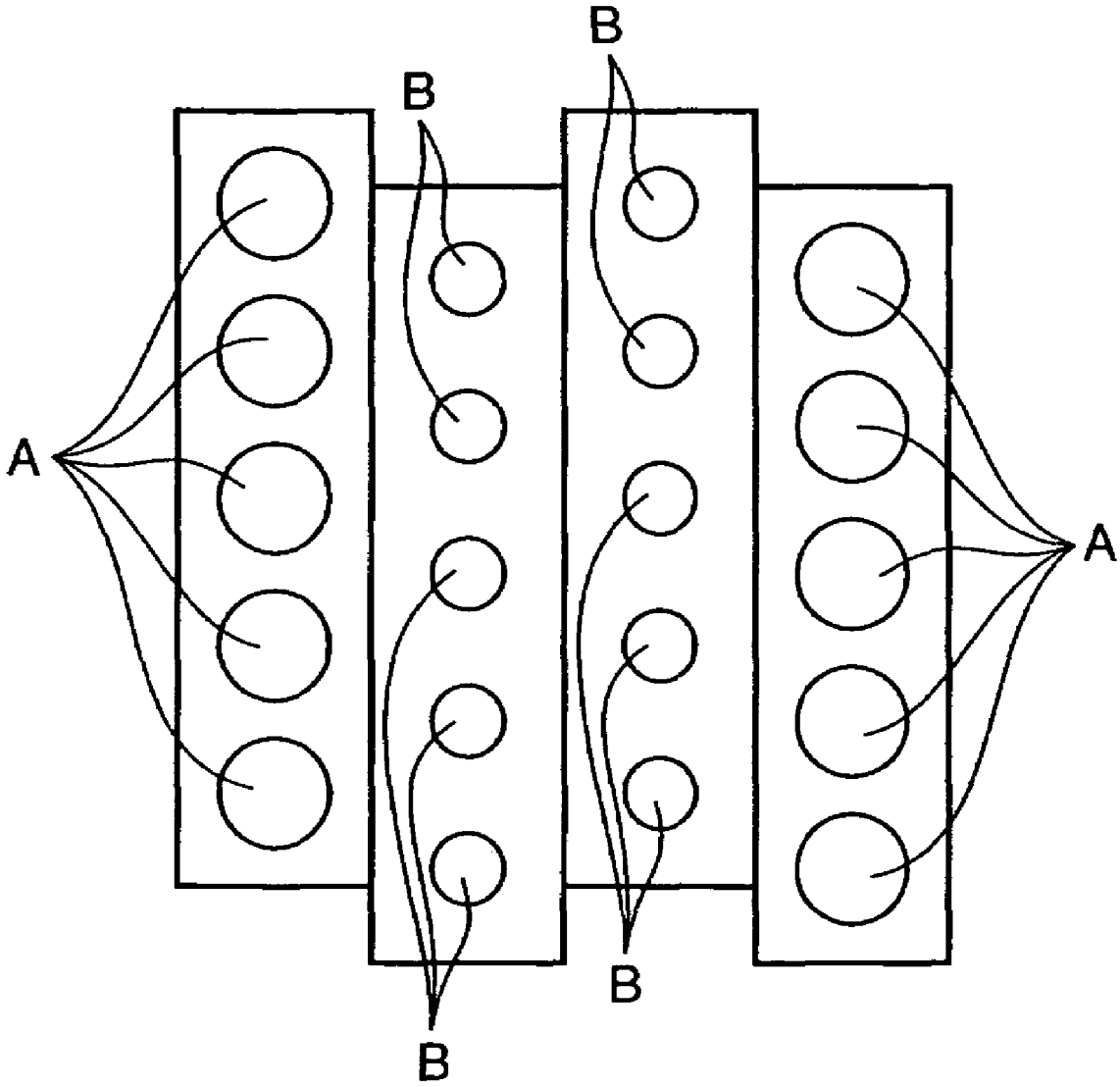
Figure 10E:
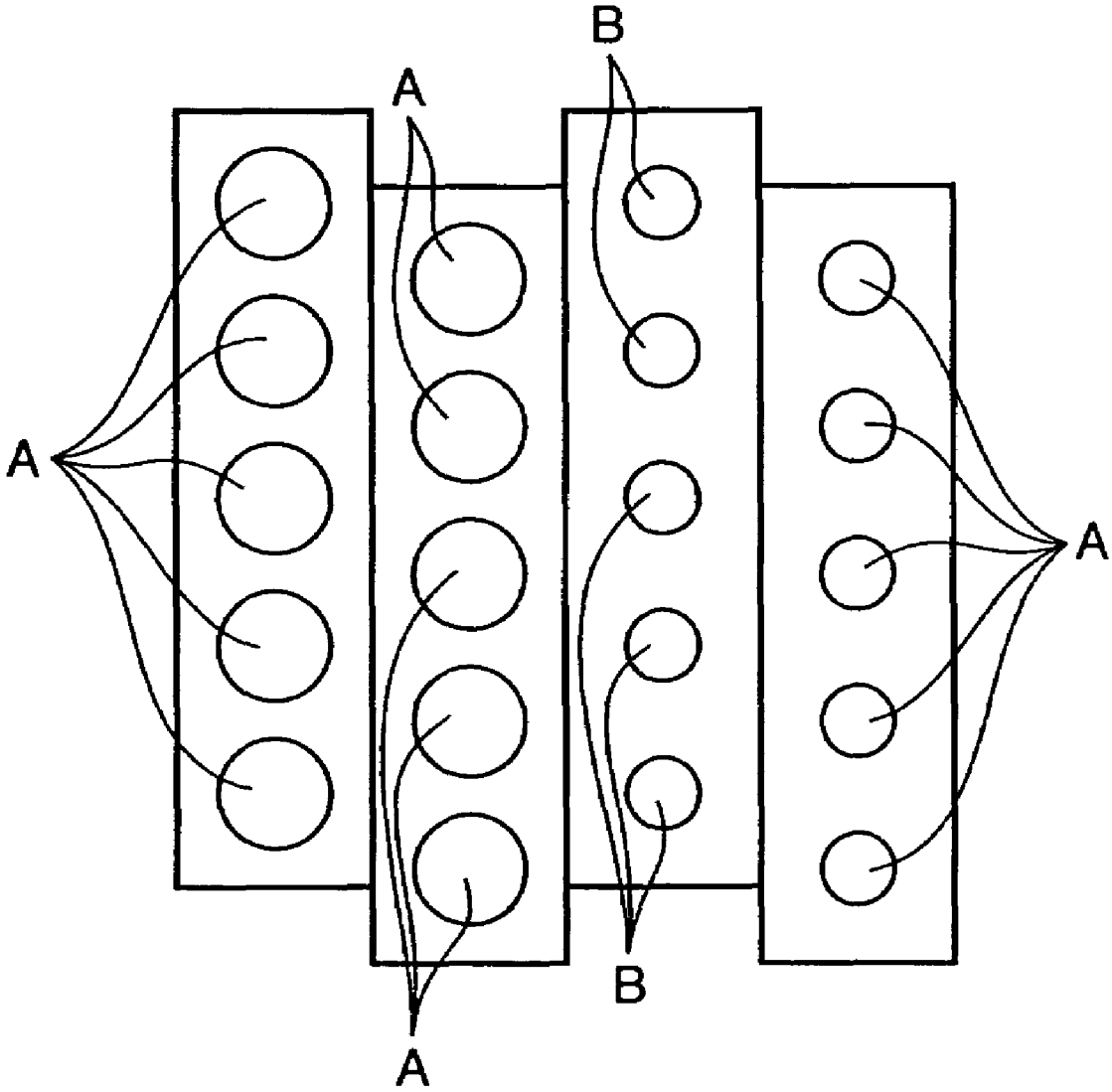
Figure 11:
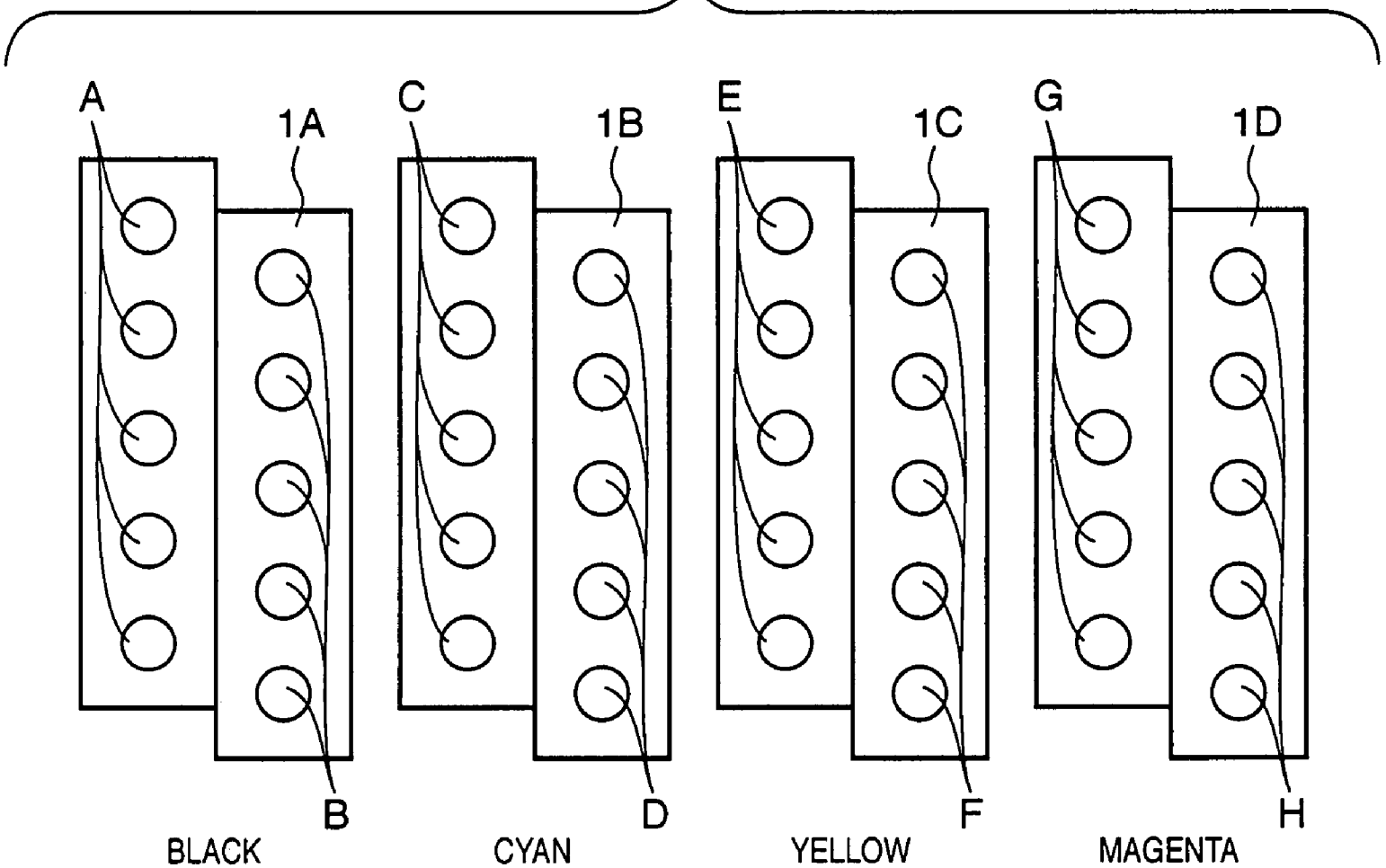
FIG. 11 is a view showing the arrangement of discharge orifice groups of a head cartridge.
Figure 12:
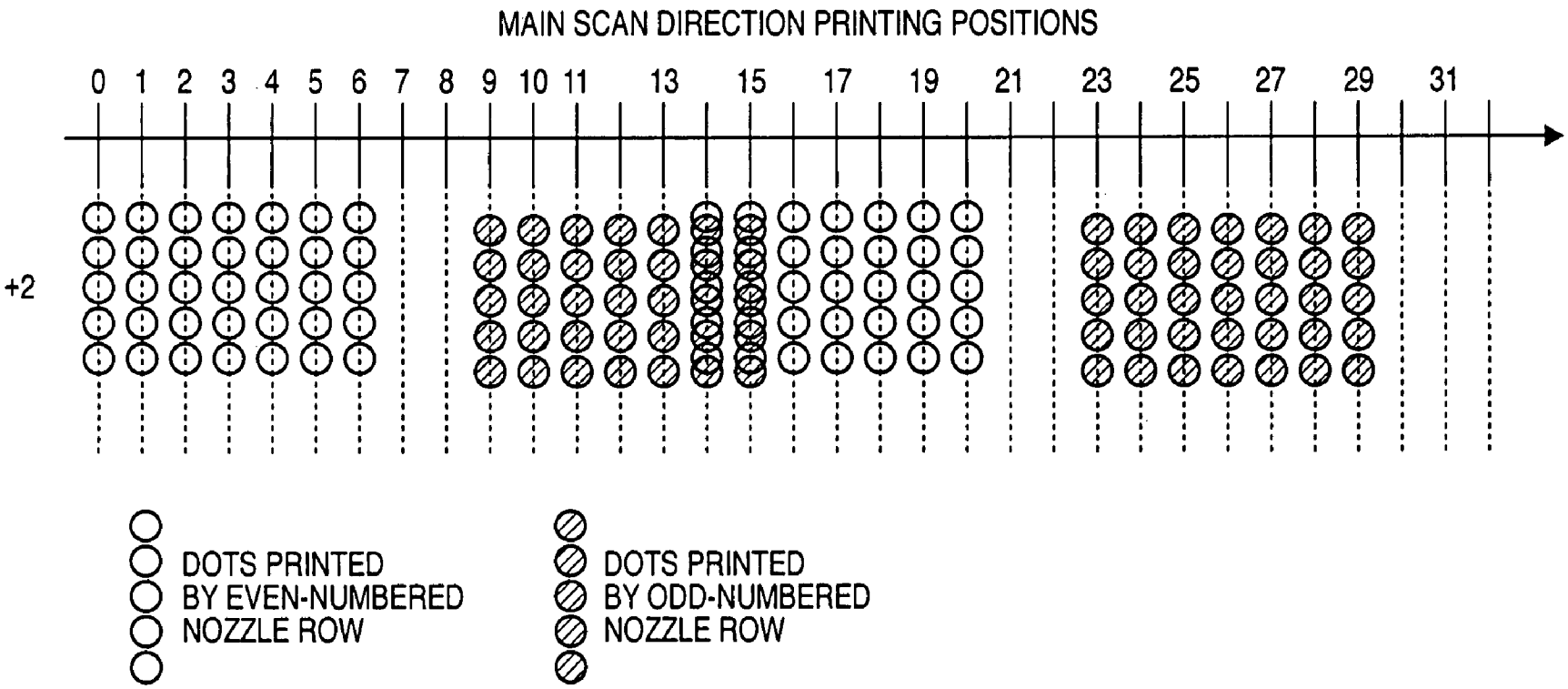
FIG. 12 is a view showing the state of those printed dots of the pattern A shown in FIG. 8, which are printed by set value +2.
Figure 13:
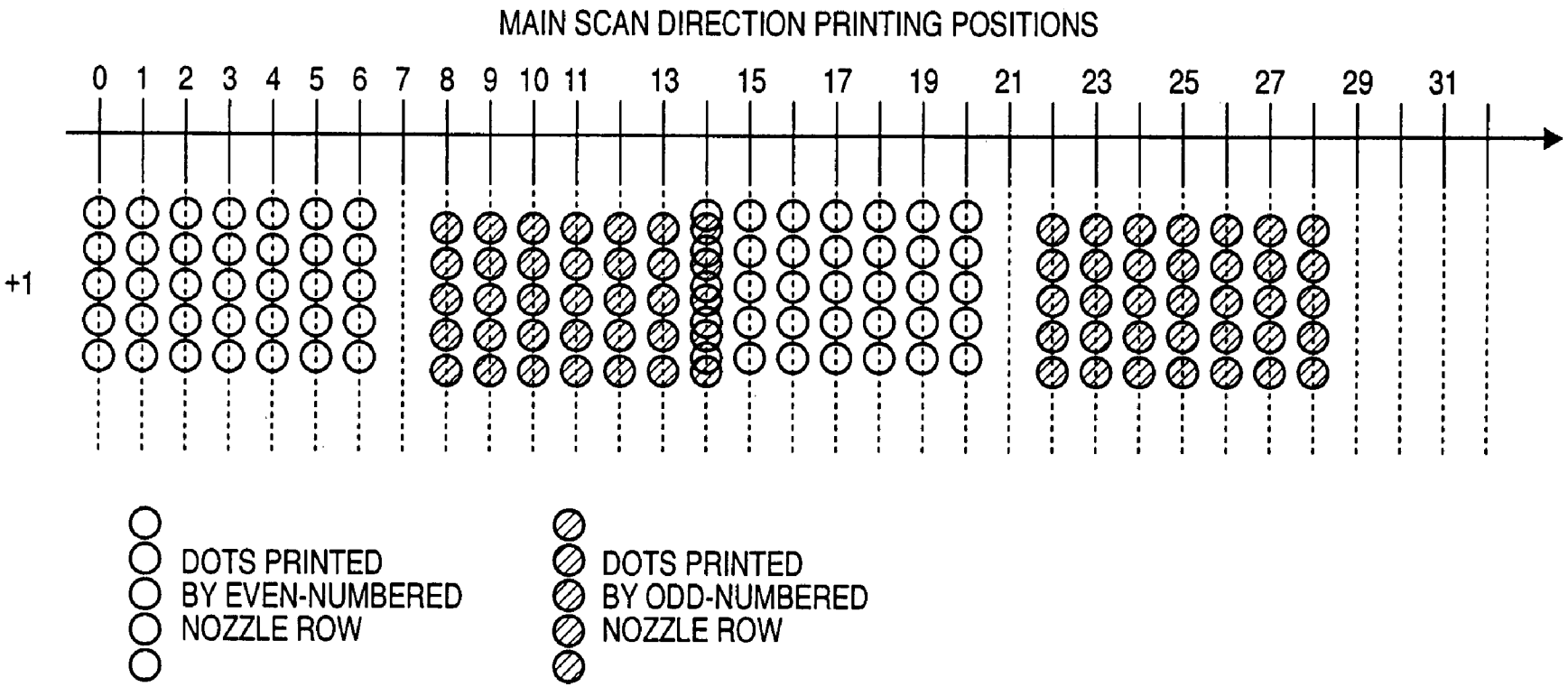
FIG. 13 is a view showing the state of those printed dots of the pattern A shown in FIG. 8, which are printed by set value +1.
Figure 14:
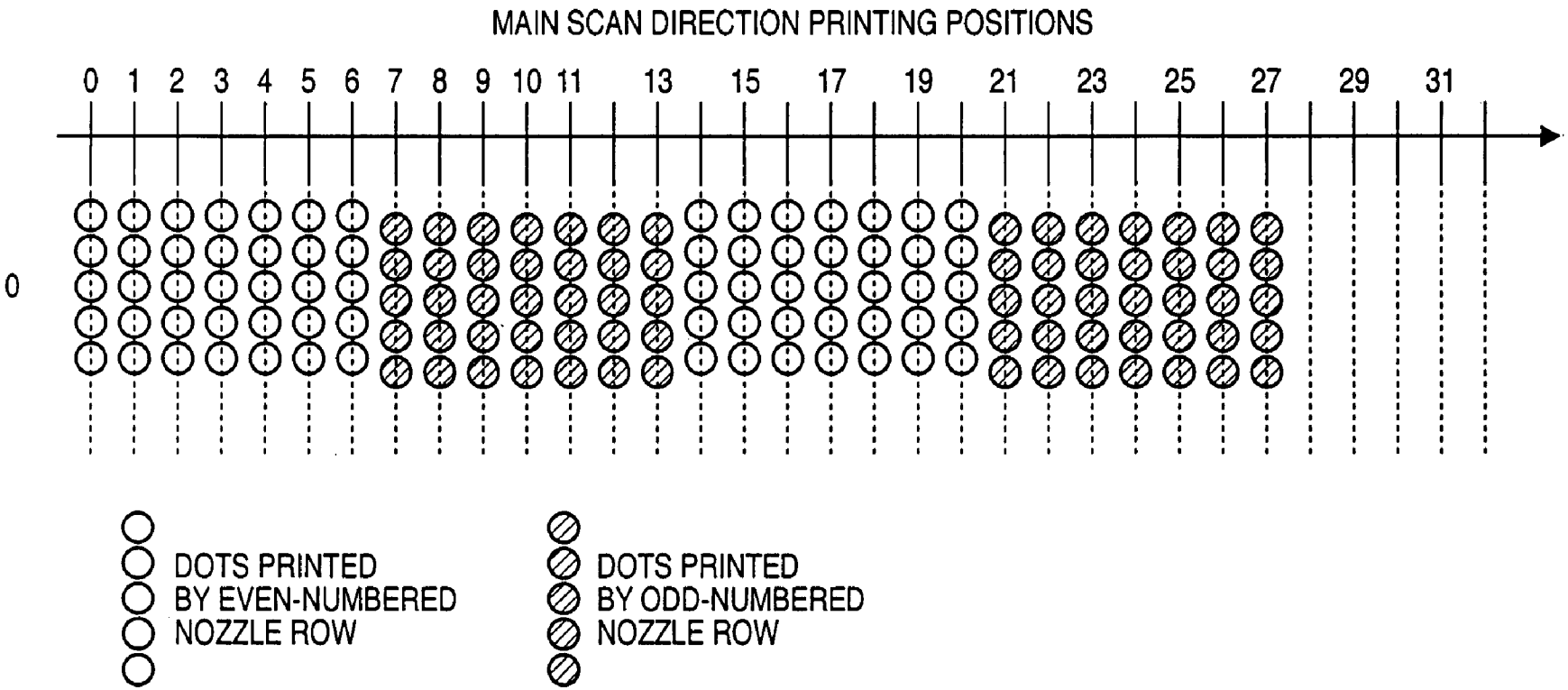
FIG. 14 is a view showing the state of those printed dots of the pattern A shown in FIG. 8, which are printed by set value 0.
Figure 15:
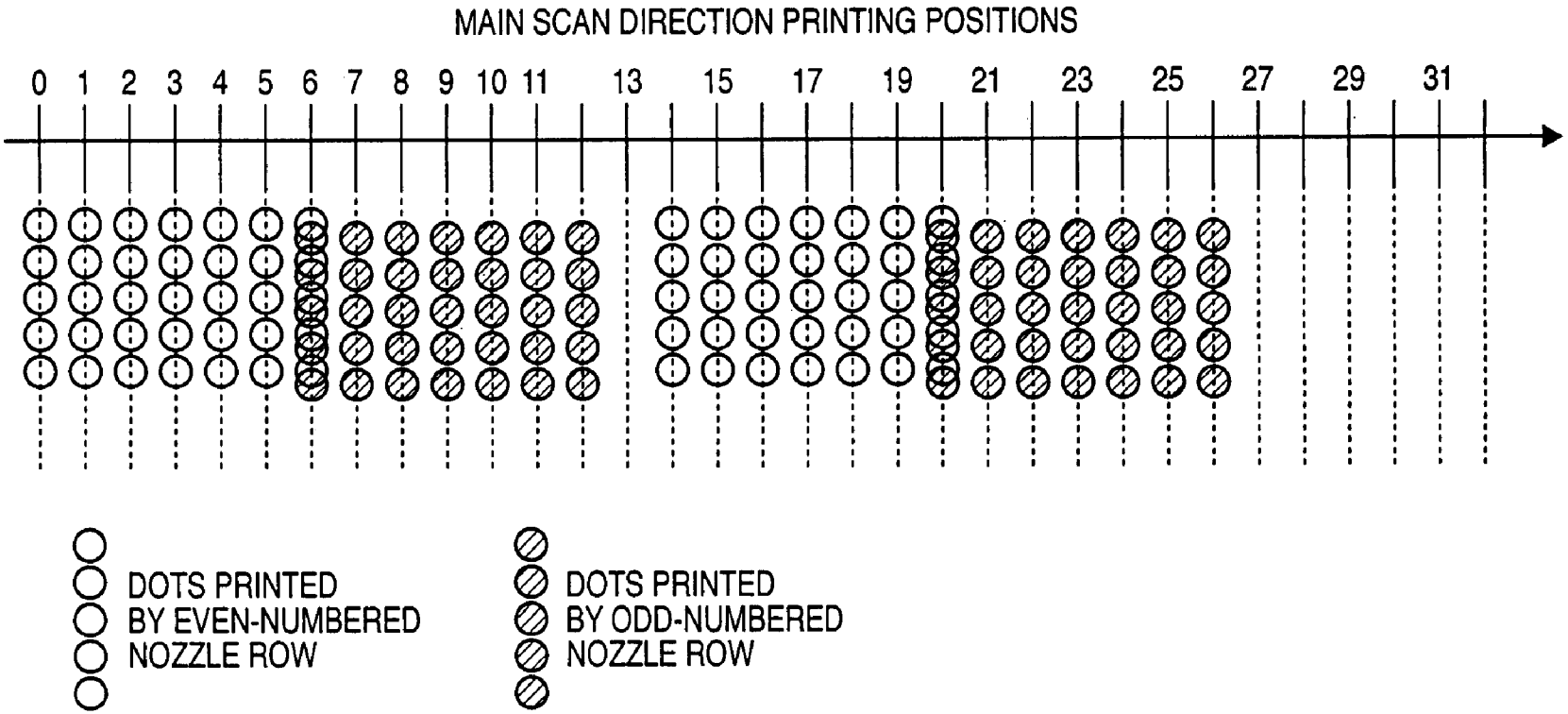
FIG. 15 is a view showing the state of those printed dots of the pattern A shown in FIG. 8, which are printed by set value −1.

Each of the head cartridges 1A, 1B, 1C, and 1D has a printhead having ink discharge orifice groups, and an ink tank for supplying ink to the printhead. FIG. 11 is a view showing the arrangement of the discharge orifice groups of the head cartridges 1A, 1B, 1C, and 1D when each head cartridge has two discharge orifice rows as shown in FIG. 10A.

Each of the cartridges 1A to 1D has a connector for receiving a signal for driving the printhead. In the following explanation, the whole or an arbitrary one of the printing means 1A to 1D is simply indicated by a printing means (printhead or head cartridge) 1.

To perform color printing by using ink liquids of different colors, the ink tanks of the head cartridge 1 contain different ink liquids, e.g., black, cyan, yellow, and magenta ink liquids. Each printing means 1 is positioned and detachably mounted on the carriage 2. The carriage 2 has a connector holder (electrical connection unit) for transmitting the driving signal and the like to each printing means 1 via the connector.

The carriage 2 is guided and supported so as to be movable in the main scan direction along a guide shaft 3 of the apparatus main body. A carrier motor 4 drives the carriage 2 via a motor pulley 5, driven pulley 6, and timing belt 7, and controls the position and movement of the carriage 2. A printing medium 8 such as a paper sheet or thin plastic plate is conveyed (fed) through a position (printing unit) opposite to the discharge orifice surface of the printhead 1 by the rotation of two pairs of conveyor rollers 9 and 10, and 11 and 12, driven by a conveyor motor (not shown). The lower surface of the printing medium 8 is supported by a platen (not shown) so as to form a flat printing surface in the printing unit. Each cartridge 1 mounted on the carriage 2 is so held that the discharge orifice surface of the cartridge 1 protrudes down from the carriage 2 so as to be parallel to the printing medium 8 between the two pairs of conveyor rollers.

The printhead 1 is an inkjet printing means for discharging ink by using heat energy, and includes an electrothermal transducer for generating heat energy. Also, the printhead 1 prints by discharging ink from a discharge orifice by using a pressure change produced by the growth and contraction of an air bubble formed by film boiling caused by the heat energy applied by the electrothermal transducer.

Reference numeral 14 denotes a recovery mechanism for performing a recovery operation for recovering the discharge performance of the printhead 1. The recovery mechanism 14 includes caps 15, a suction pump 16, a blade 18, and a blade holder 17. The caps 15 prevent evaporation of ink by covering the discharge orifice surfaces when the printhead returns to the home position. The suction pump 16 is connected to the caps 15 by tubes 27. The blade 18 removes dust, ink, and the like sticking to the discharge orifice surface. The blade holder 17 holds the blade 18.

The recovery operation is performed at a predetermined time interval. In this recovery operation, the discharge surface of each printhead 1 is cleaned by the blade 18, and, if necessary, the discharge surface of each printhead is moved to a position where the surface is covered with the corresponding cap 15, and thickened ink in discharge orifices is removed by suction by the suction pump 16.

Figure 2:
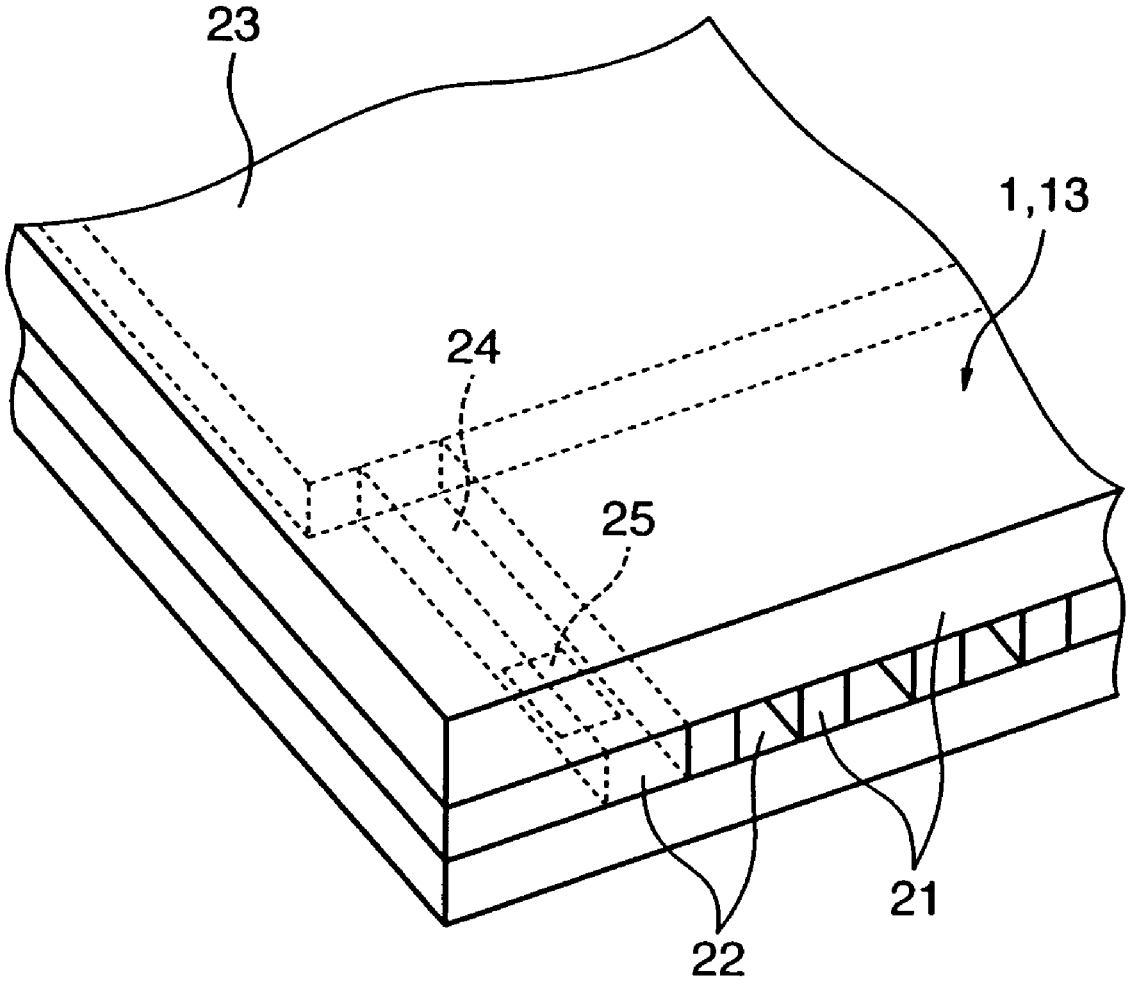
FIG. 2 is a schematic perspective view showing a portion of the main structure of an ink discharge unit of a printhead.

FIG. 2 is a schematic perspective view showing a portion of the main structure of an ink discharge unit 13 of the printhead 1. Note that FIG. 2 shows only one of the two discharge orifice rows A and B shown in FIG. 10A.

Referring to FIG. 2, a plurality of discharge orifices 22 are formed at a predetermined pitch in a discharge orifice surface 21 which faces the printing medium 8 with a predetermined gap (about 0.5 to 2 mm) between them. An electrothermal transducer (e.g., a heating resistor) 25 for generating ink discharging energy is formed along the wall surface of a flow path 24 which connects a common liquid chamber 23 to each discharge orifice 22. In this embodiment, the printhead 1 is mounted on the carriage 2 such that the discharge orifices 22 are arranged in a direction perpendicular to the scan direction of the carriage 2. In this manner, the printhead 1 is so designed that the electrothermal transducer 25 corresponding to a printing signal or discharge signal is driven (turned on) to cause film boiling of ink in the flow path 24, and the ink is discharged from the discharge orifice 22 by the pressure generated by the film boiling.

In this embodiment, an electrothermal transducer for generating heat energy is used as the ink discharging means. However, a piezoelectric element may also be used as this ink discharging means.

(Configuration of Control System)

Figure 3:
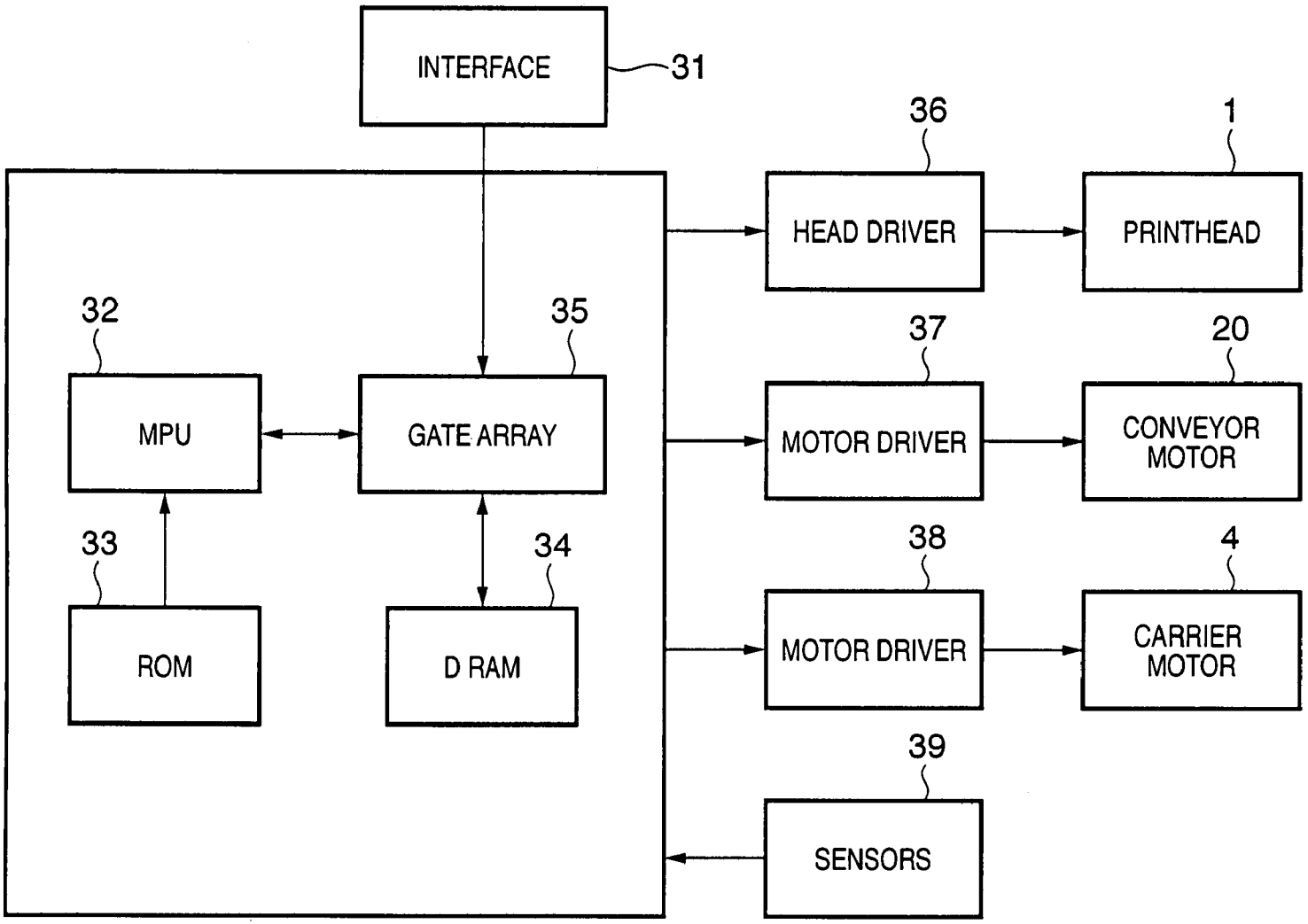
FIG. 3 is a block diagram showing the configuration of a control system of the inkjet printing apparatus shown in FIG. 1.

FIG. 3 is a block diagram showing the configuration of a control system of the inkjet printing apparatus according to the present invention. In FIG. 3, reference numeral 31 denotes an interface to which a printing signal from the connected host apparatus is input; 32, a microprocessor unit (MPU); 33, a program ROM for storing a control program executed by the MPU 32; and 34, a DRAM for storing printing signals and various data such as printing data to be supplied to the printhead 1. The DRAM 34 can also store (count) the number of printed dots and the printing time. Reference numeral 35 denotes a gate array for controlling the supply of printing data to the printhead 1. The gate array 35 also controls the transfer of data between the interface 31, MPU 32, and DRAM 34.

Referring to FIG. 3, reference numeral 4 denotes a carrier motor (main scan motor) for conveying the carriage 2 on which the printhead 1 is mounted; 20, a conveyor motor for conveying the printing medium 8 such as a printing paper sheet; 36, a head driver for driving the printhead 1; 37, a motor driver for driving the conveyor motor 20; 38, a motor driver for driving the carrier motor 4; and 39, sensors for performing various sensing operations. For example, the sensors 39 include a sensor for sensing the presence/absence of the printing medium 8, a sensor for sensing that the carriage 2 is in the home position, and a sensor for sensing the temperature of the printhead 1. With these sensors, it is possible to check the presence/absence of the printing medium 8, the position of the carriage 2, the environmental temperature, and the like.

Referring to FIGS. 1 and 3, printing data supplied from the host apparatus via the interface 31 is temporarily stored in the DRAM 34 via the gate array 35. The gate array 35 converts this data in the DRAM 34 from raster data into image data to be printed by the printhead 1, and stores the image data in the DRAM 34 again. The gate array 35 then transfers the image data to the printhead 1 via the head driver 36, and prints the image data by discharging ink from discharge orifices in the corresponding positions. During printing, the gate array 35 can count dots to be printed at high speed by using an internal counter for counting dots.

The carrier motor 4 is driven via the motor driver 38, and the carriage 2 is moved in the main scan direction in accordance with the printing speed of the printhead 1, thereby performing main scan printing once. When this main scan printing is complete, the conveyor motor 20 is driven via the motor driver 37 for this conveyor motor to convey (feed) the printing medium 8 by a predetermined pitch in the conveyance direction (sub scan direction) perpendicular to the main scan direction. To print in the next scan, the carrier motor 4 is driven via the motor driver 38 again, and the carriage 2 is moved in the main scan direction in accordance with the printing speed of the printhead 1, thereby printing in this main scan (the next main scan). By repeating these processes, printing is performed on the entire printing medium 8.

FIRST EMBODIMENT

The first embodiment in which the present invention is applied to the inkjet printing apparatus having the above arrangement will be described below.

The first embodiment includes a printhead having two types of discharge orifice groups (large and small nozzles) different in discharge amount, and has a printing mode in which printing is performed by using only one nozzle group during the same main scan, and a printing mode in which printing is performed by driving the two types of nozzle groups at different timings during the same main scan.

That is, this embodiment is an inkjet printing apparatus which includes at least a first nozzle group used to print dots having a first density, and a second nozzle group used to print dots having a second density, and has a first printing mode in which only one of the first and second nozzle groups is used during printing of one scan, and a second printing mode in which the first and second nozzle groups are driven at different timings during printing of one scan. In this printing apparatus, on the basis of set values for adjusting the relative printing positions of a plurality of nozzle rows in the first printing mode, set values of the relative printing positions of a plurality of nozzle rows in the second printing mode are determined. However, this embodiment also has the following characteristic features. Therefore, the present invention can properly combine these arrangements.

The resolution of relative printing position adjustment in the first printing mode is an integral multiple of the resolution of relative printing position adjustment in the second printing mode.

When a set value of the printing position in the second printing mode is to be determined, if the set value of the relative printing position of one of the two nozzle groups must be changed, the set value of the nozzle group used to print dots having a lower density is not changed.

The first and second nozzle groups are different in size of a dot to be printed.

The printhead has a plurality of nozzle rows in each of which nozzles of the first nozzle group and nozzles of the second nozzle group are alternately arranged.

The set value in the first printing mode is input by a user by referring to a printed pattern.

Figure 10F:
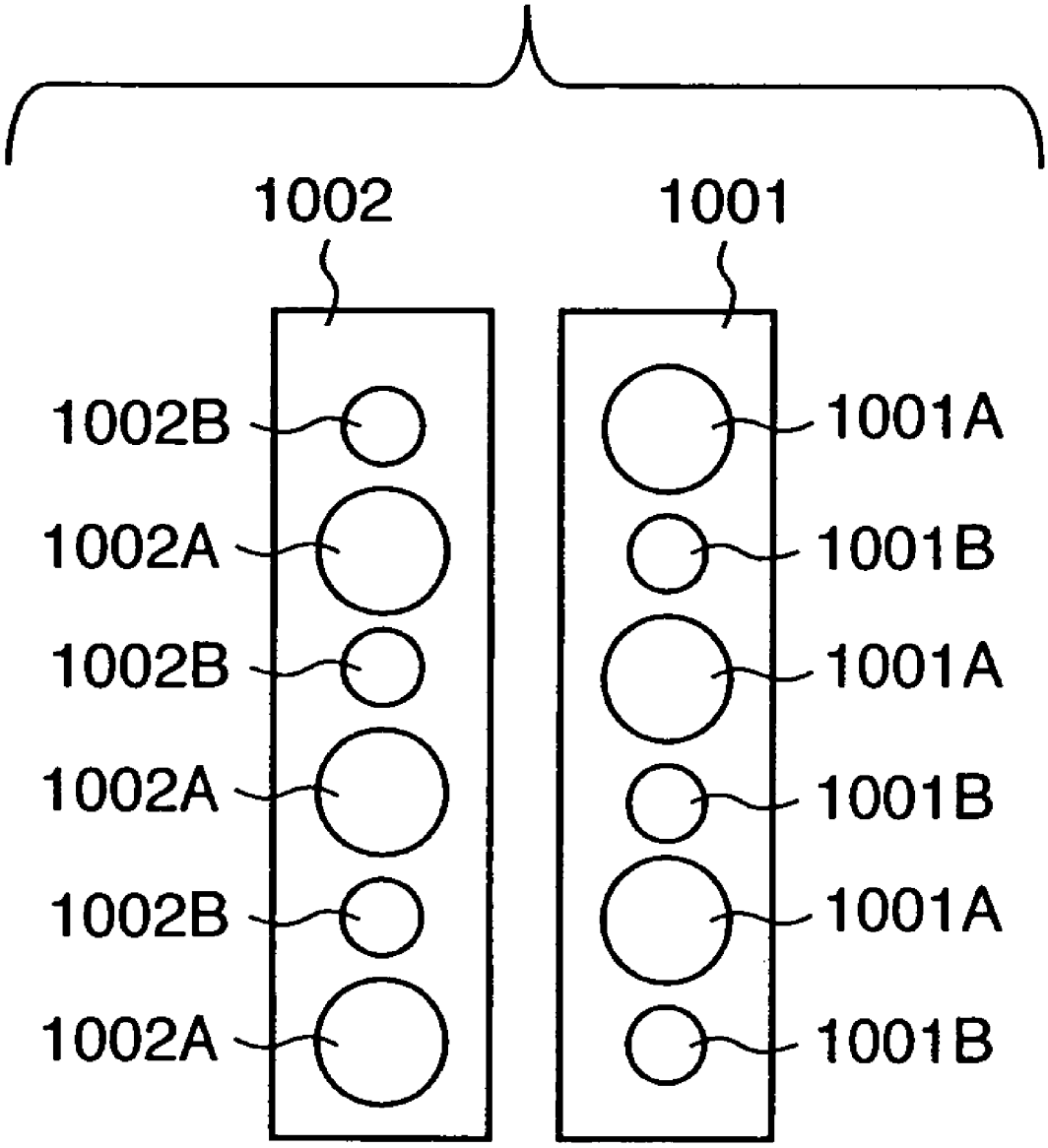

In the head cartridge 1 of this embodiment, nozzle groups of a head cartridge for one type of ink are arranged as shown in FIG. 10F. That is, the head cartridge has two nozzle rows in each of which large nozzles having a large discharge amount and used to print large dots and small nozzles having a small discharge amount and used to print small dots are alternately arranged. The positions (the order in the row) of these large and small nozzles in one row are different from those in the other row.

More specifically, an even-numbered discharge orifice (nozzle) row 1001 has a discharge orifice group 1001A (large nozzles) and a discharge orifice group 1001B (small nozzles). For the sake of convenience of a driving circuit, the discharge orifice groups 1001A and 1001B cannot be driven at the same timing during the same main scan, so printing is performed by switching the driving timings of these groups during the same main scan. Also, the amount and size of an ink droplet discharged from the discharge orifice group 1001A are larger than those of an ink droplet discharged from the discharge orifice group 1001B. Similar to the even-numbered discharge orifice row 1001, an odd-numbered discharge orifice (nozzle) row 1002 has a discharge orifice group 1002A (large nozzles) and a discharge orifice group 1002B (small nozzles). The discharge orifice groups 1002A and 1002B cannot be drive at the same timing during the same main scan, so printing is performed by switching the driving timings of these groups during the same main scan. The positional relationship between the large and small nozzles in the even-numbered discharge orifice row 1001 is opposite to that in the odd-numbered discharge orifice row 1002.

Note that when printing is to be performed by discharging ink only from the large or small nozzles during the same scan, this printing can be performed, without any switching, in positions which continue in the main scan direction.

Figure 8:
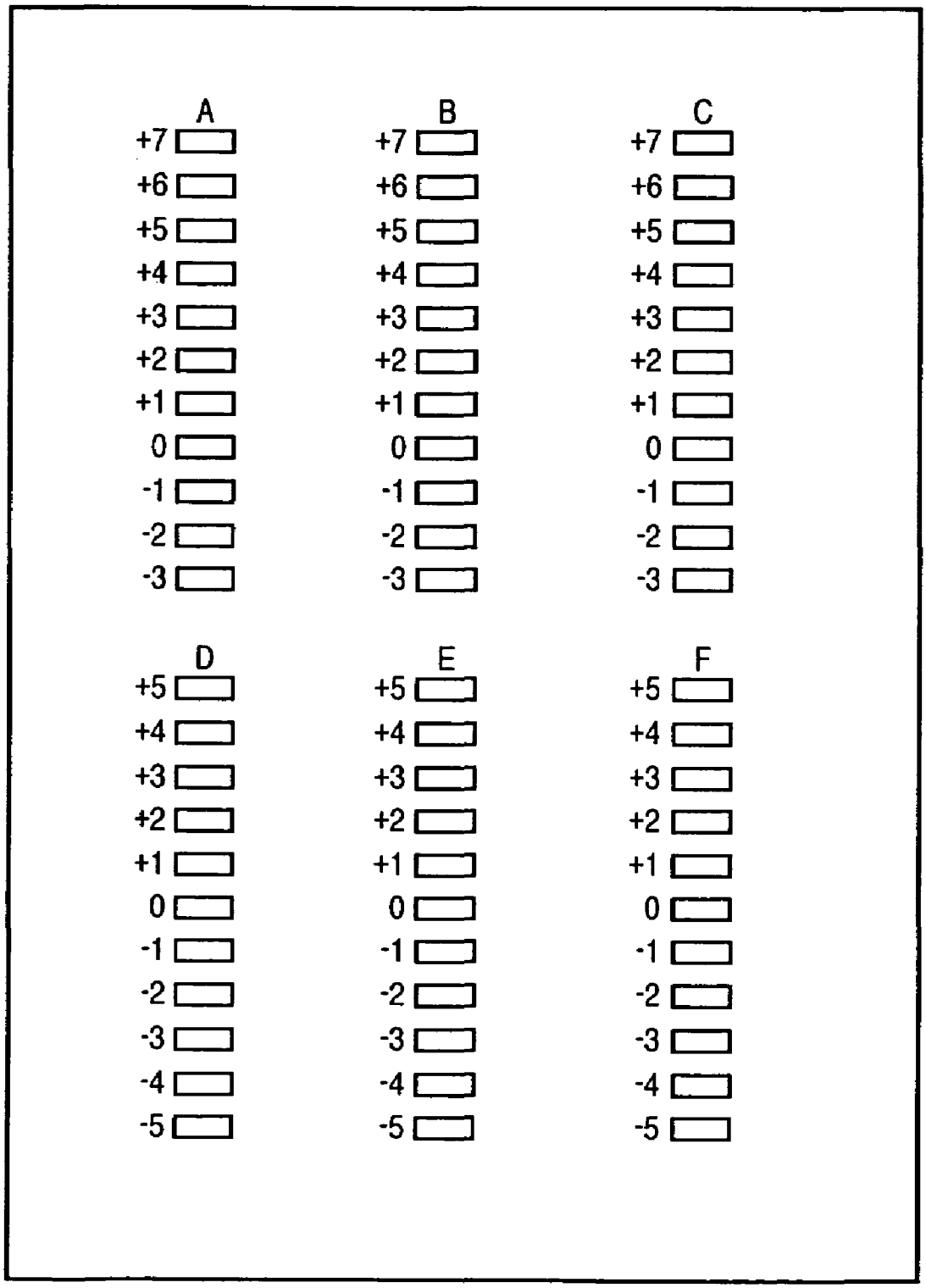
FIG. 8 is a view showing examples of patterns for performing printing position adjustment between a plurality of nozzle rows.
Figure 9:
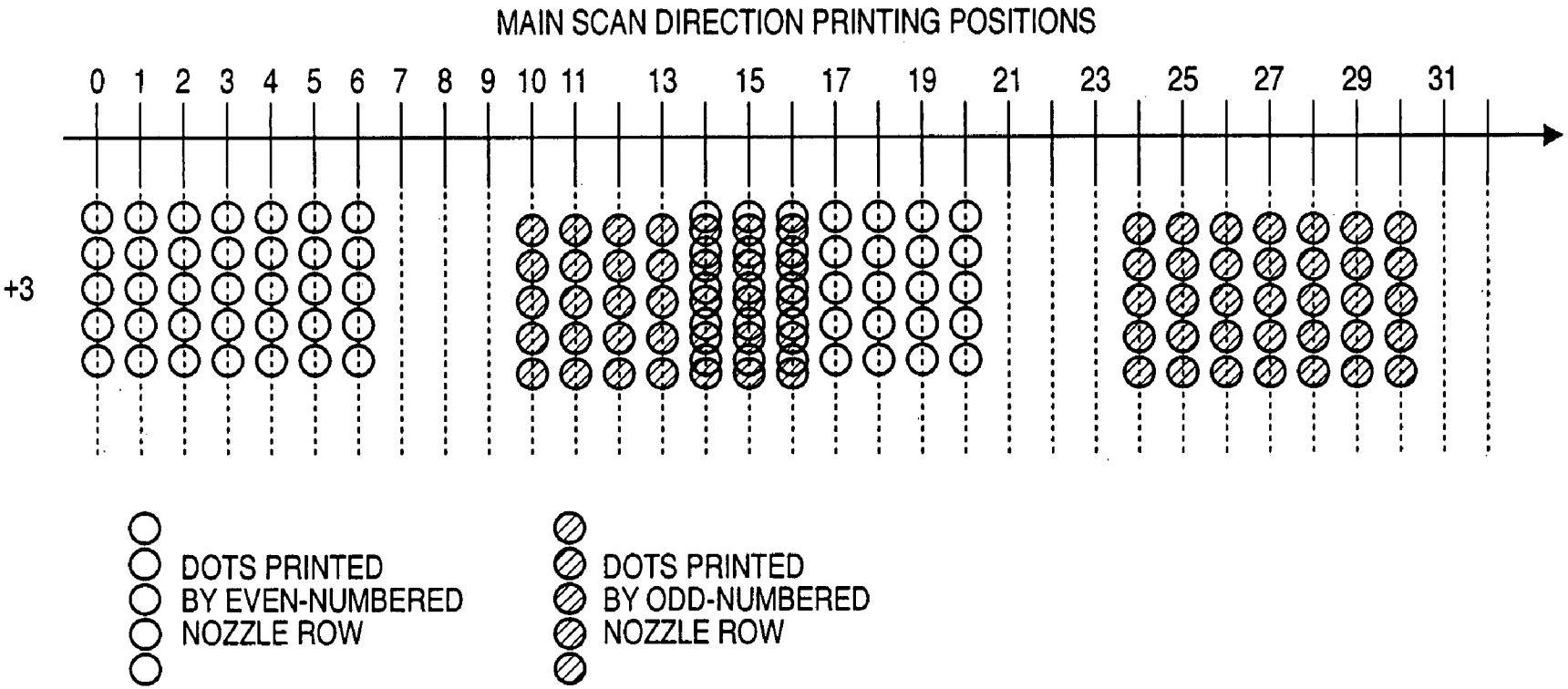
FIG. 9 is a view showing the state of those printed dots of a pattern A shown in FIG. 8, which are printed by set value +3.

Test patterns used in printing position adjustment of this embodiment include two patterns G and H in addition to FIG. 8 described earlier. Combinations of nozzle rows and nozzle groups to be subjected to the printing position adjustment by using these patterns are as follows.

A: Black even-numbered row large nozzles/odd-numbered row large nozzles

B: Cyan even-numbered row large nozzles/odd-numbered row large nozzles

C: Magenta even-numbered row large nozzles/odd-numbered row large nozzles

D: Black even-numbered row small nozzles/odd-numbered row small nozzles

E: Cyan even-numbered row small nozzles/odd-numbered row small nozzles

F: Magenta even-numbered row small nozzles/odd-numbered row small nozzles

G: Cyan even-numbered row large nozzles/even-numbered row small nozzles

H: Magenta even-numbered row large nozzles/even-numbered row small nozzles

Figure 6:
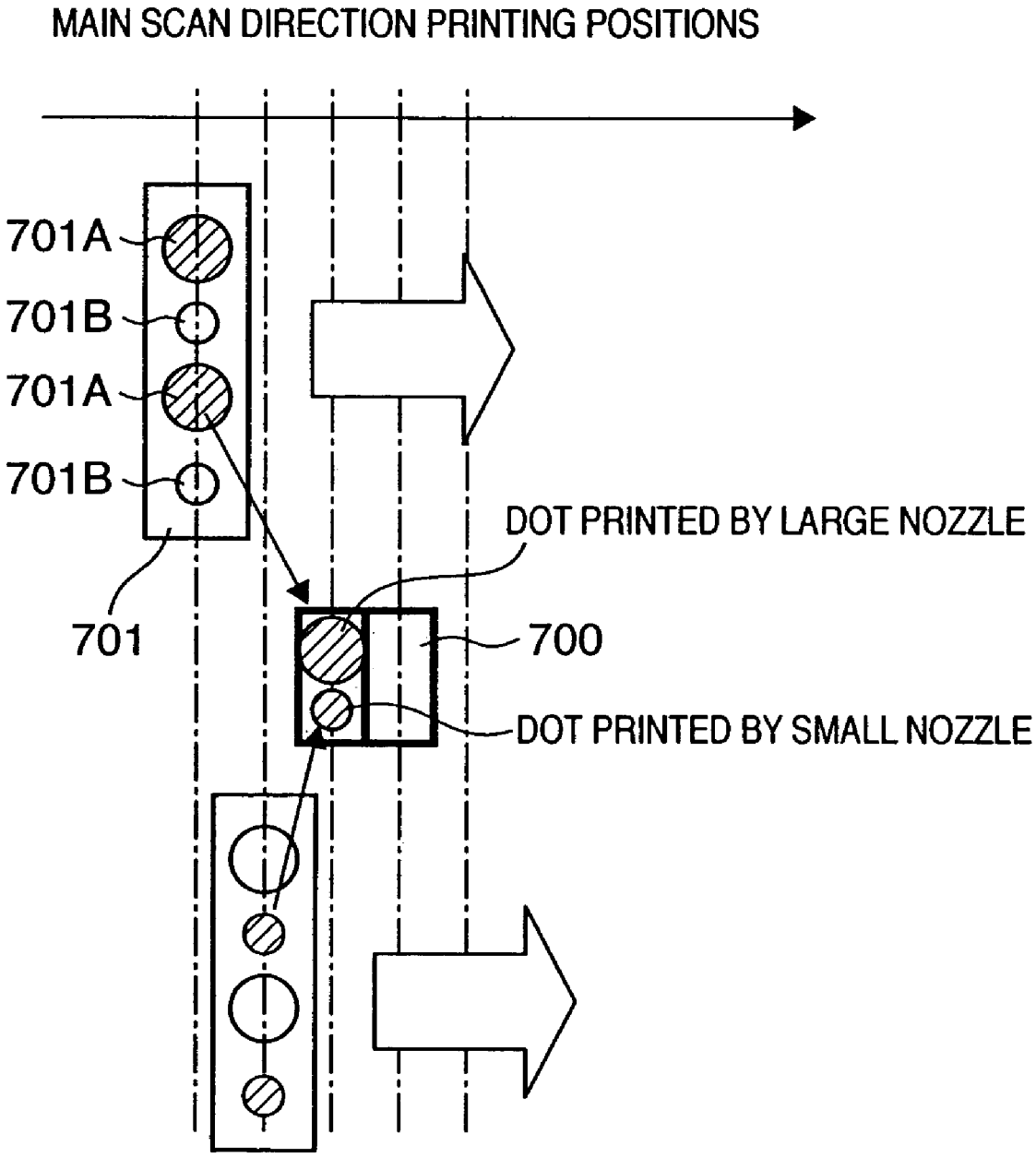
FIG. 6 is a view showing an example of the setting by which ink droplets discharged from large and small nozzles are printed in the same column position of a target pixel.
Figure 7:
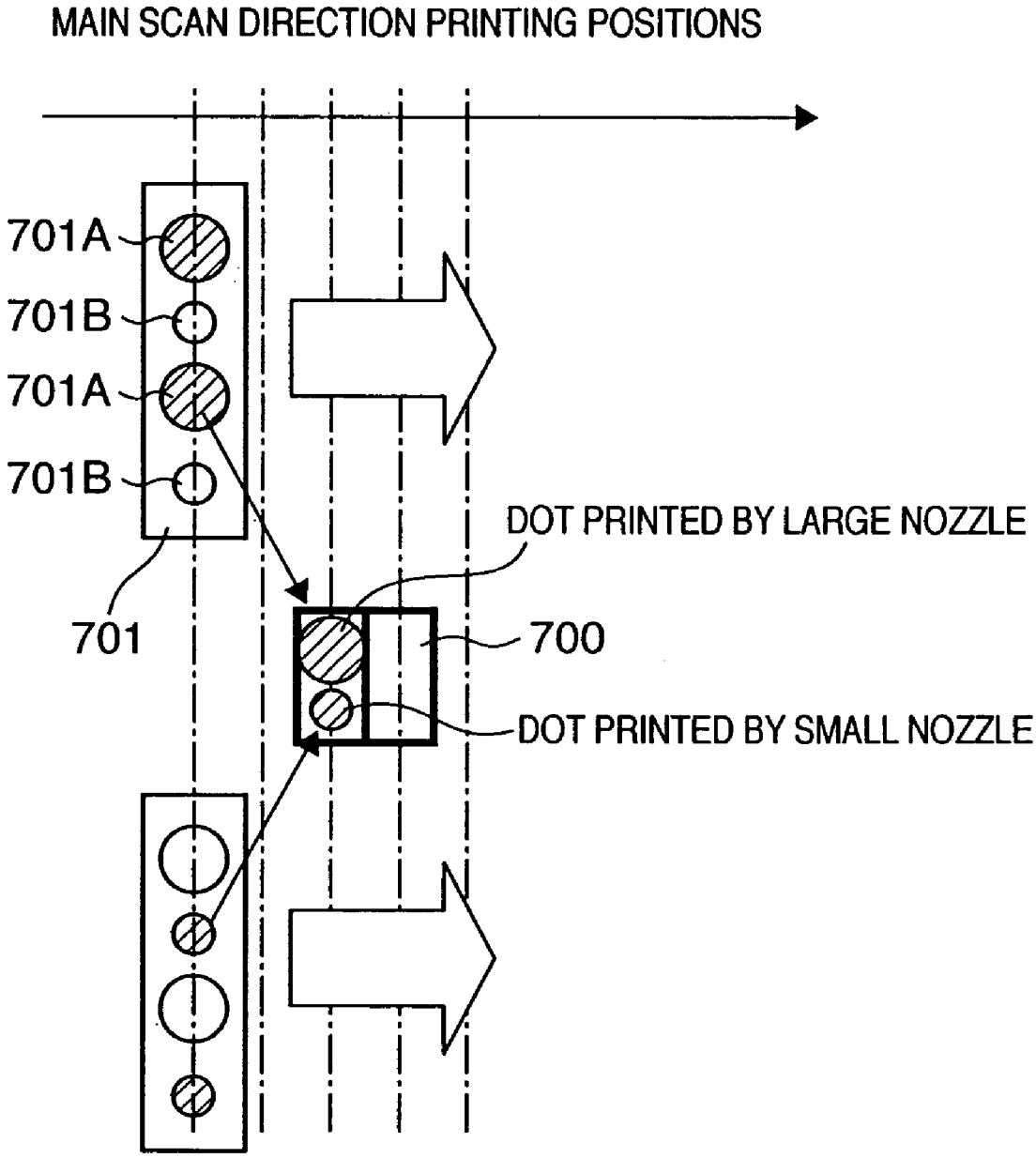
FIG. 7 is a view showing an example of the setting by which ink droplets discharged from large and small nozzles are printed in the same column position of a target pixel.

The printing position adjustment according to this embodiment will be described below with reference to FIGS. 4 and 16 to 21. Similar to FIG. 6, each of these drawings shows two driving states of one printhead.

Figure 21:
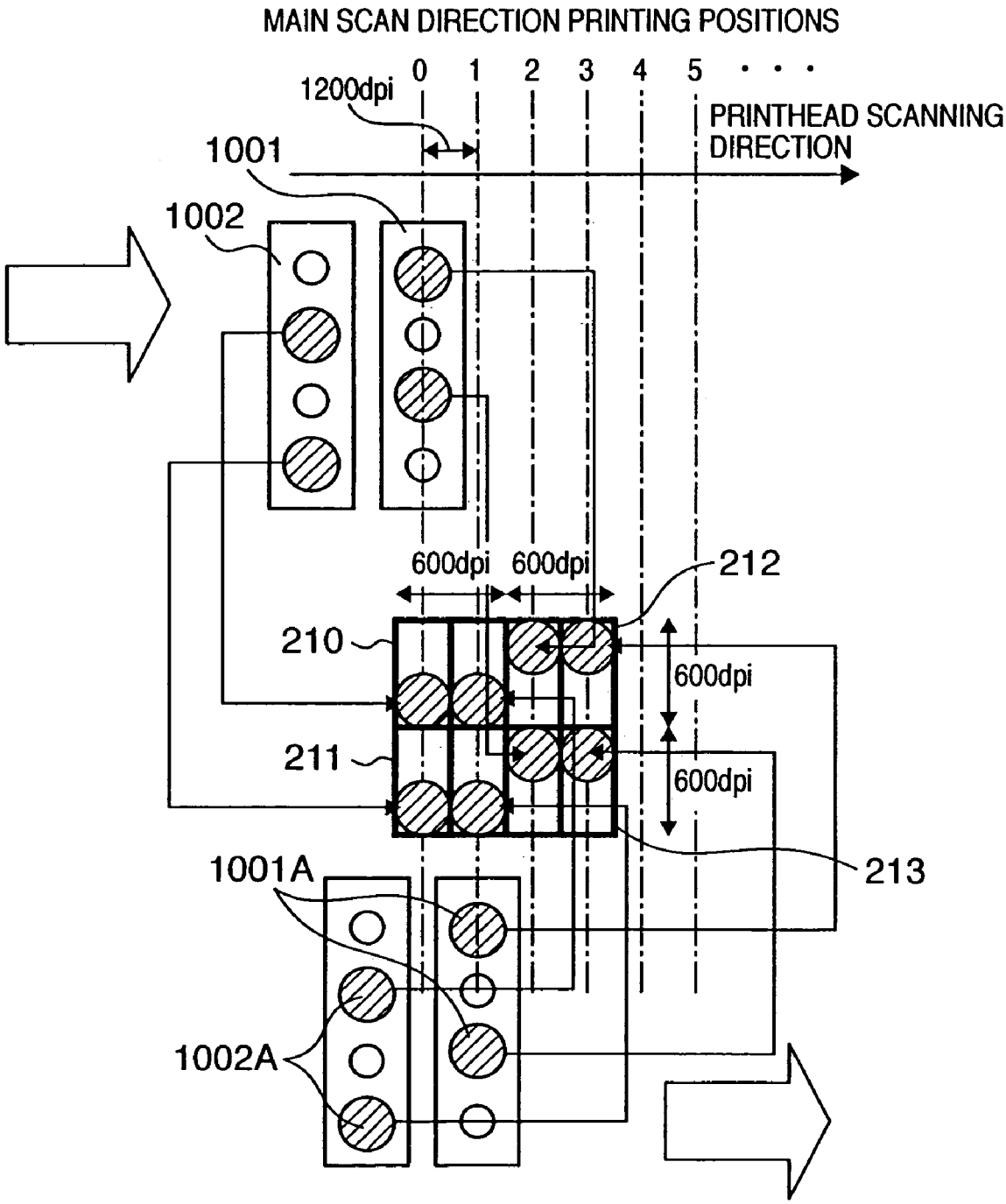
FIG. 21 is a schematic view for explaining the relationships between the driving timings of the nozzles and the positions of printed dots according to the first embodiment.

FIG. 21 is a schematic view for explaining the relationships between the driving timings and printed dots in this embodiment. The printhead has the arrangement as shown in FIG. 10F, and each nozzle row has two large nozzles and tow small nozzles, i.e., a total of fourth nozzles. This printhead is moved from the left to the right as indicated by the arrows in FIG. 21, and main scan direction printing positions are indicated by the alternate long and short dashed lines. The pitch of these printing positions is 1,200 dpi. Staggering the driving timing by 1 is equivalent to moving the printing position by 1,200 dpi, and is also equivalent to shifting the printing position set value by 1. A + (plus) sign of the set value means a shift to the right, and a − (minus) sign means a shift to the left. In this embodiment, the printing resolution is 600 dpi, so a target pixel has a size of 600 dpi constructed by a 1,200-dpi 2×2 matrix.

Referring to FIG. 21, states when the large nozzles (1001A and 1002A) are driven in main scan direction printing positions 0 and 1 are illustrated above and below, respectively, of printed pixels 210 to 213.

In FIG. 21, the pitch of the two nozzle rows is 600 dpi, and pixels printed when ink is discharged only from the large nozzles at two continuous timings (the nozzle row 1001 is driven at driving timings 2 and 3, and the nozzle row 1002 is driven at driving timings 0 and 1) are shown. As shown in FIG. 21, two dots are printed in each of the four pixels 210, 211, 212, and 213. In the following description, one of these printed pixels will be explained.

The relationships between the driving timings and printed dots when printing is performed by using only one ink discharge orifice group (large nozzles) during the same main scan will be described with reference to FIGS. 4 and 16. The relationships between the driving timings and printed dots when printing is performed by using only an ink discharge orifice group (small nozzles) different in driving from the large nozzles during the same main scan will be described with reference to FIGS. 17 to 19. The relationships between the driving timings and printed dots when printing is performed by switching the driving operations of the large and small nozzles during the same main scan will be described with reference to FIGS. 20 and 22 to 25.

First, the relationships between the driving timings and printed dots when printing is performed using only the large nozzles will be explained below. FIGS. 4 and 16 are schematic views showing the relationships between the driving timings and printed dots when printing is performed using the large nozzles by the nozzle row 1001 as an even-numbered nozzle row and the nozzle row 1002 as an odd-numbered nozzle row.

Figure 4:
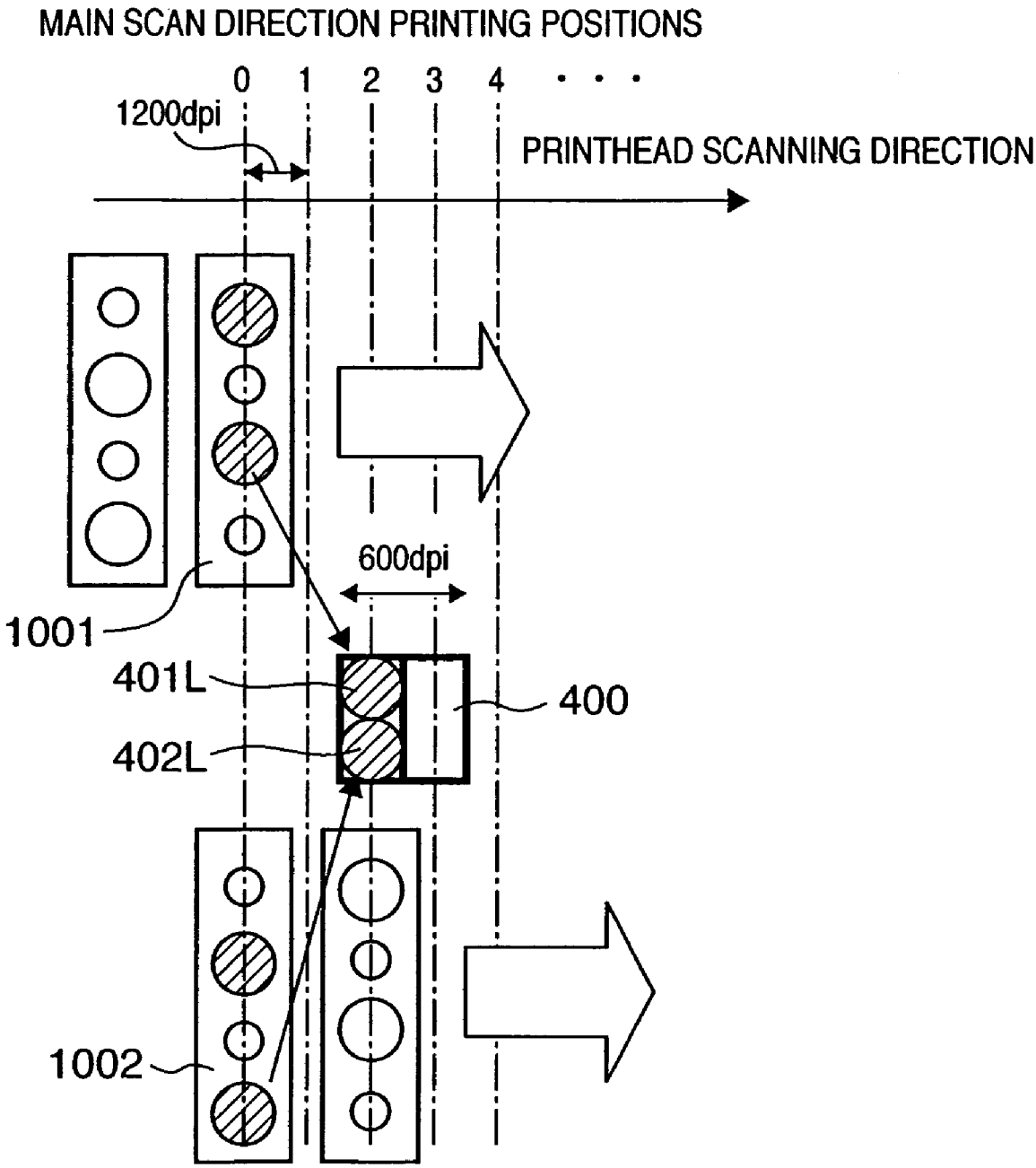
FIG. 4 is a schematic view for explaining the relationships between the driving timings of large nozzles of two nozzle rows and the positions of printed dots according to the first embodiment.
Figure 5:
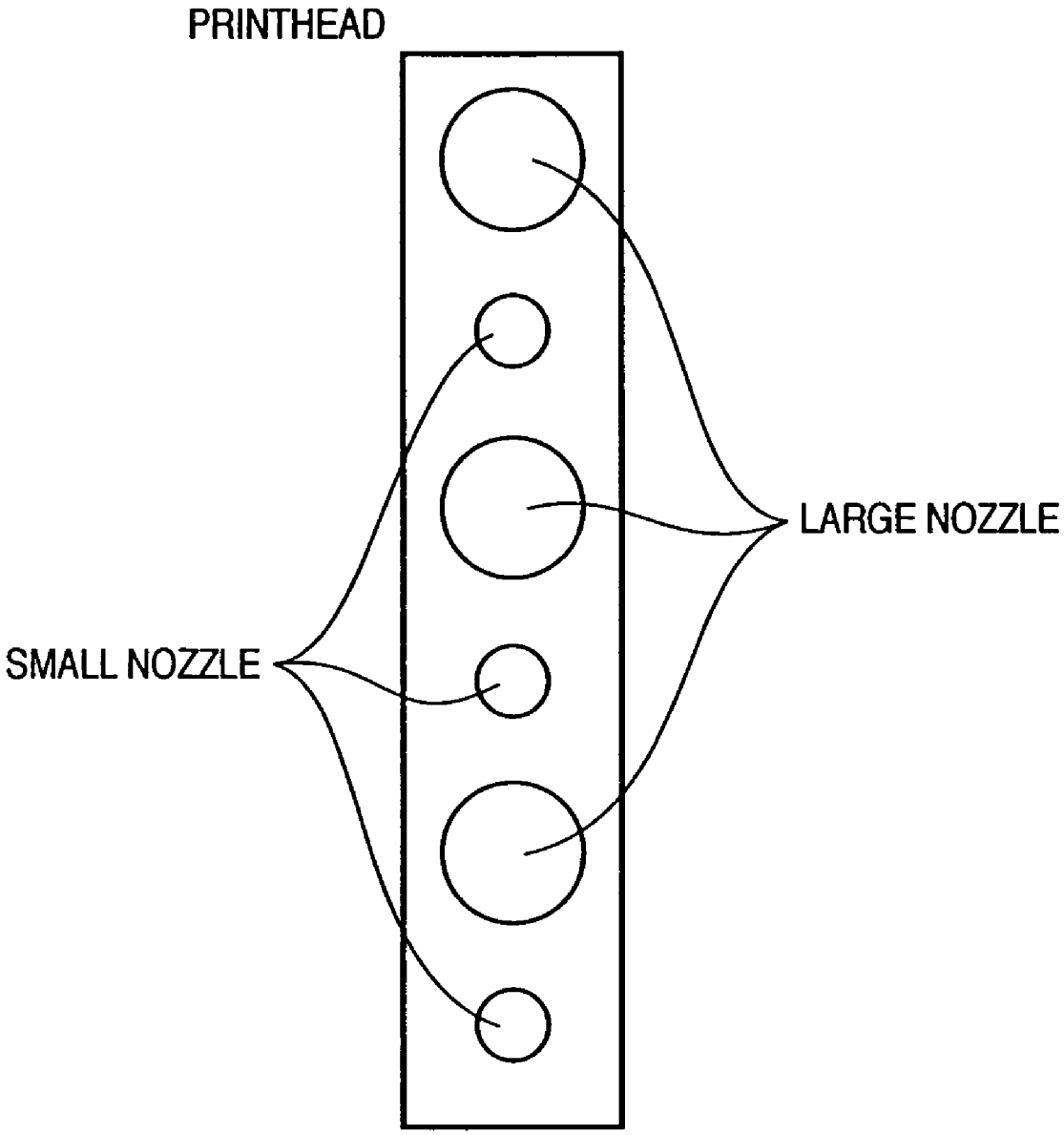
FIG. 5 is a schematic view for explaining an example of the nozzle arrangement of the printhead.

FIG. 4 shows a printed dot 401L formed on a target pixel 400 by an ink droplet discharged from the large nozzle of the nozzle row 1001, and a printed dot 402L formed on the target pixel 400 by an ink droplet discharged from the large nozzle of the nozzle row 1002, when the two nozzle rows 1001 and 1002 are driven to discharge the ink in main scan direction printing position 0. In FIG. 4, both the dots are printed in main scan direction printing position 2, so the printing positions of the two dots match.

Figure 16:
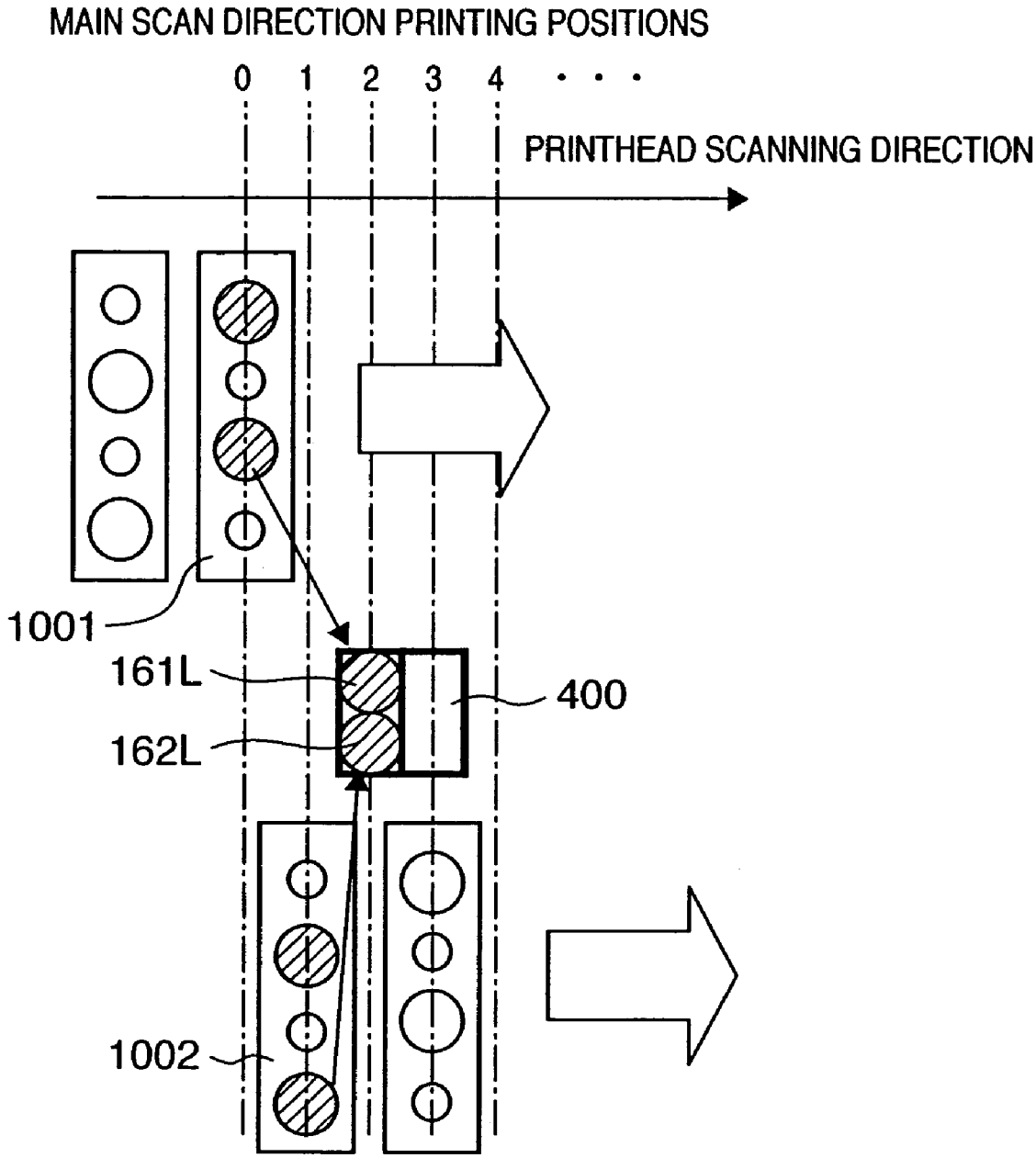
FIG. 16 is a schematic view for explaining the relationships between the driving timings of the large nozzles of the two nozzle rows and the positions of printed dots according to the first embodiment.

FIG. 16 shows an arrangement in which the nozzle rows 1001 and 1002 discharge the ink in main scan direction printing positions 0 and 1 (columns 0 and 1), respectively. That is, FIG. 16 shows the state in which the printing positions of printed dots 161L and 162L on the target pixel match in main scan direction printing position 2 by staggering the driving timings of these two nozzle rows by 1 (1,200 dpi).

The dots are formed in the same column as shown in FIG. 16 although the discharge timings (discharge positions) are different, because the discharge directions or discharge speeds (ink flying speeds) of the nozzle rows are different. In this example, the ink discharge speed of the nozzle row 1002 is relatively high, or the nozzle row 1002 discharges ink relatively forward in the moving direction.

As shown in FIG. 4 or 16, the printing position adjustment (dot formation position adjustment) is to check (sense) driving timings at which the printing positions of discharged dots match. When optimum driving timings are found by this printing position adjustment, these driving timings are used as set values of the printing position adjustment, and the large nozzles of the two, even- and odd-numbered nozzle rows are driven at the driving timings. Consequently, printing is performed such that the relative printing positions of the two nozzle rows match.

When printing is performed using only the large nozzles as described above, driving is possible in all the main scan direction printing positions (columns), so driving selection is not restricted at all. Therefore, the resolution (usable driving timings) when the printing position adjustment is performed is 1,200 dpi.

This similarly applies to the adjustment of the relative printing positions of the even- and odd-numbered nozzle rows in a printing mode in which only the small nozzles are used. The states are shown in FIGS. 17 to 19.

Figure 17:
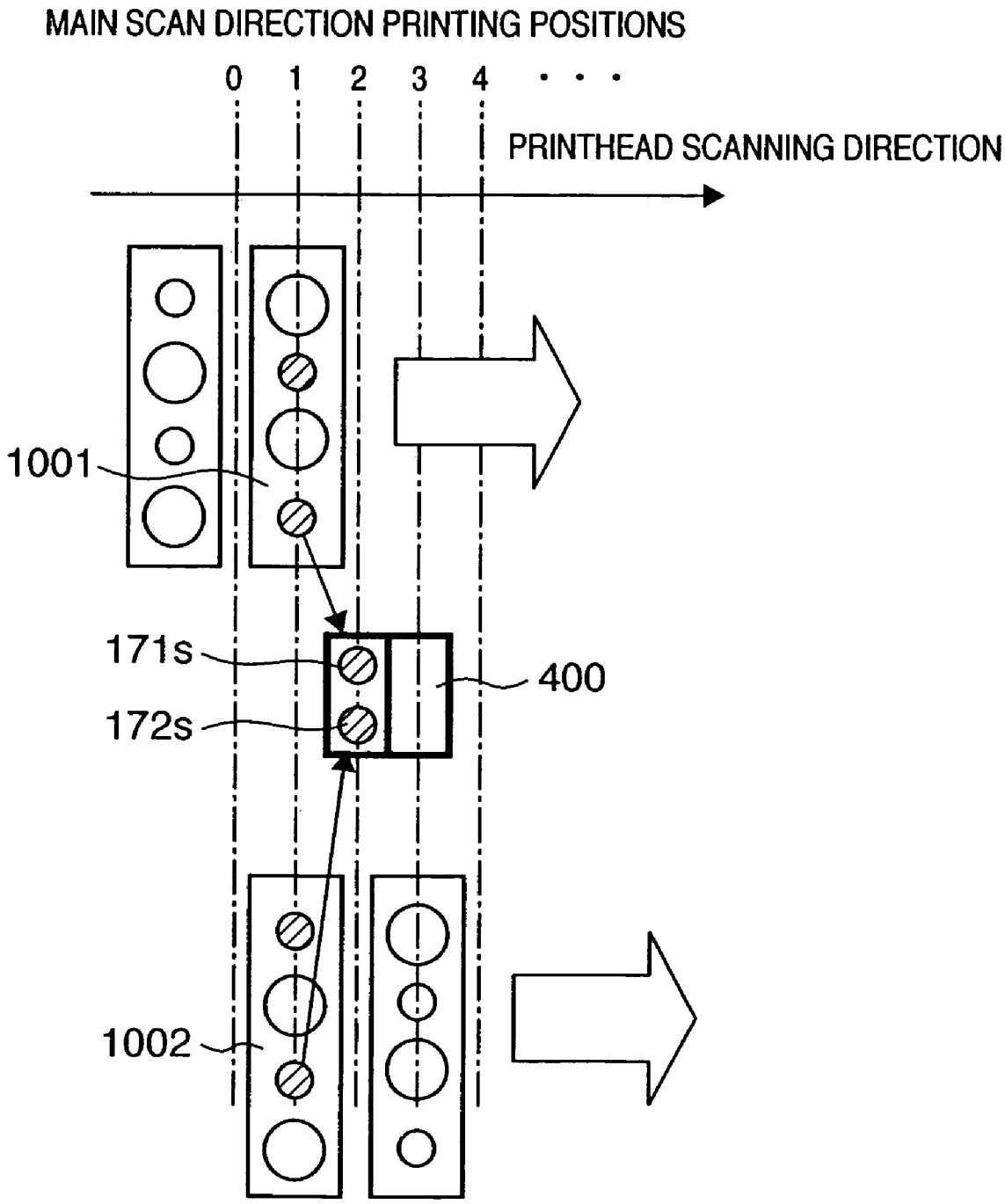
FIG. 17 is a first schematic view for explaining the relationships between the driving timings of small nozzles of the two nozzle rows and the positions of printed dots according to the first embodiment.
Figure 18:
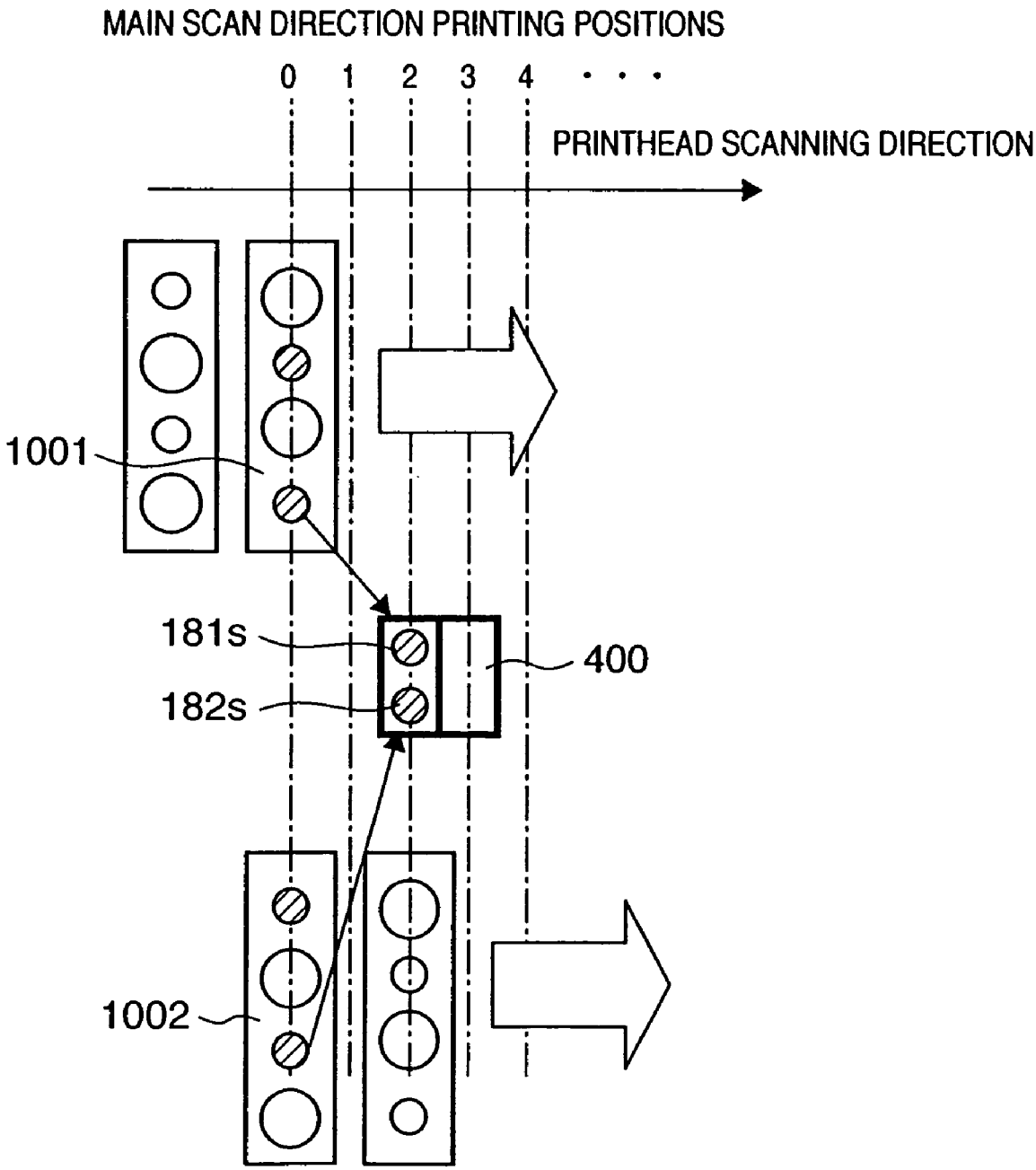
FIG. 18 is a second schematic view for explaining the relationships between the driving timings of the small nozzles of the two nozzle rows and the positions of printed dots according to the first embodiment.

FIG. 17 shows the state in which when the small nozzles of the even- and odd-numbered nozzle rows 1001 and 1002 are driven in main scan direction printing position 1, printing can be performed such that the relative printing positions of printed dots 171S and 172S match in the target pixel 400 ("driving in main scan direction printing position X" will be also referred to as "driving at driving timing X" hereinafter). FIG. 18 shows the state in which when the small nozzles of the even- and odd-numbered nozzle rows 1001 and 1002 are driven at driving timing 0, printing can be performed such that the relative printing positions of printed dots 181S and 182S match in the target pixel 400.

Figure 19:
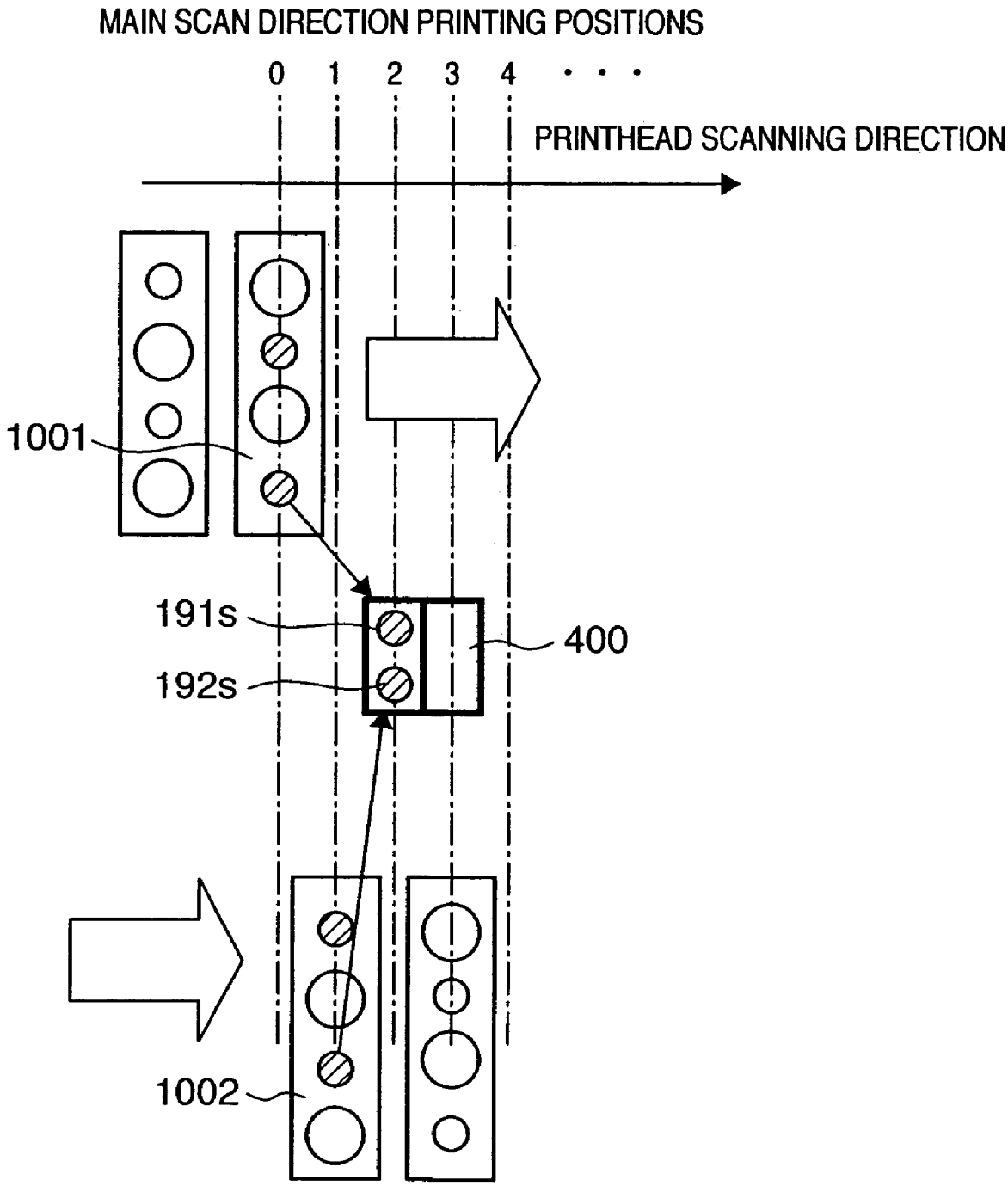
FIG. 19 is a third schematic view for explaining the relationships between the driving timings of the small nozzles of the two nozzle rows and the positions of printed dots according to the first embodiment.

FIG. 19 shows the state in which when the small nozzles of the even- and odd-numbered nozzle rows 1001 and 1002 are driven at driving timings 0 and 1, respectively, printing can be performed such that the relative printing positions of printed dots 191S and 192S match in the target pixel 400. As described above, even when printing is performed using only the small nozzles, all driving timings 0, 1, 2, . . . , can be used to drive these small nozzles. Accordingly, the printing positions can be adjusted at a resolution of 1,200 dpi.

On the other hand, a printing mode in which the large and small nozzles are driven at different timings during the same main scan is as follows.

For example, assume that when the printing positions are adjusted in the printing mode using only the large nozzles, dots printed by ink discharged from the large nozzles of the two nozzle rows are formed as shown in FIG. 4 (401L and 402L) (this state will be referred to as "the large nozzles are in the state shown in FIG. 4" hereinafter), and that when the printing positions are adjusted in the printing mode using only the small nozzles, dots printed by ink discharged from the small nozzles of the two nozzle rows are formed as shown in FIG. 17 (171S and 172L). In this case, if the large nozzles are driven in even-numbered main scan direction printing positions and the small nozzles are driven in odd-numbered main scan direction printing positions, dots are printed in the target pixel as shown in FIG. 22.

Figure 22:
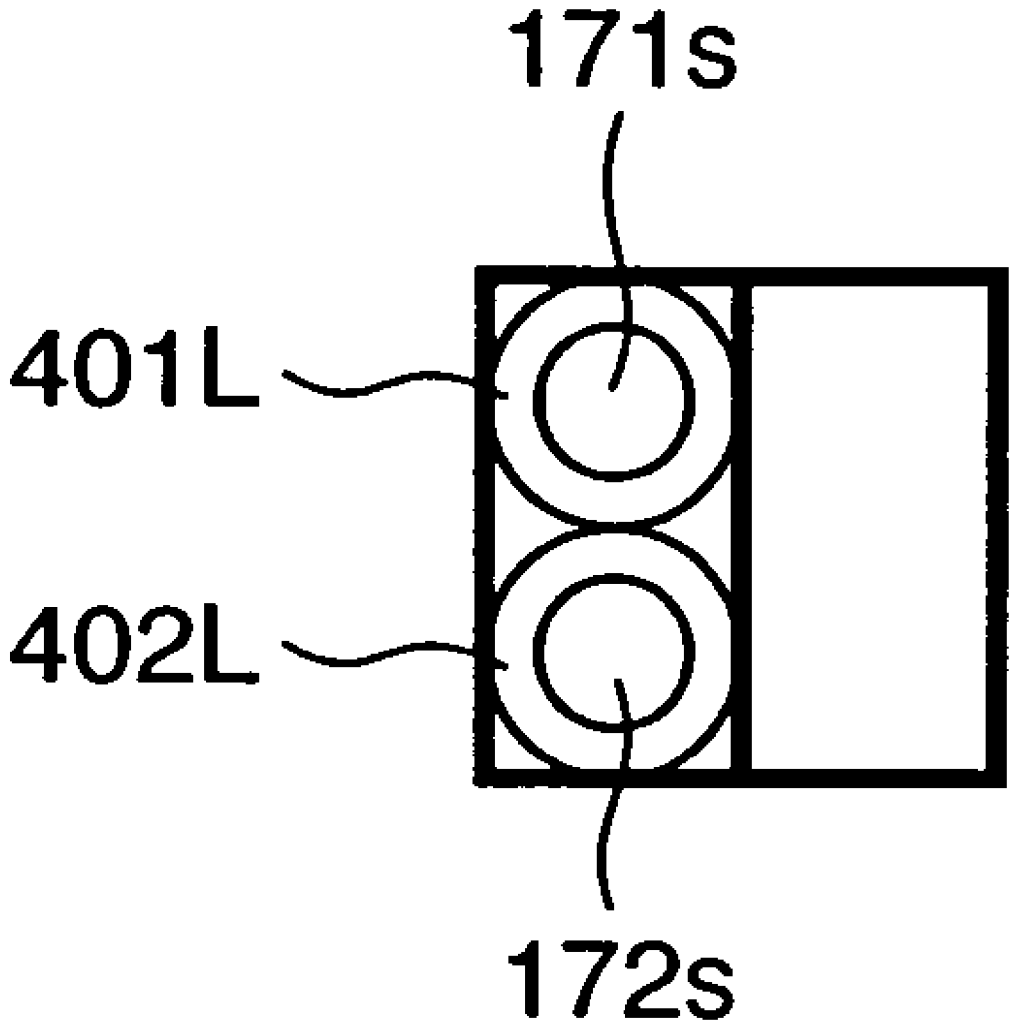
FIG. 22 is a schematic view for explaining the printing positions of printed dots according to the first embodiment.

FIG. 22 specifically shows the target pixel 400 alone. Reference numerals 401L and 402L denote printed dots formed if the large nozzles are driven in the state shown in FIG. 4; and 171S and 172S, printed dots formed if the small nozzles are driven in the state shown in FIG. 17.

In this case, one nozzle group can be driven only in the even-numbered main scan direction printing positions, and the other nozzle group can be driven only in the odd-numbered main scan direction printing positions (in the above example, the large nozzles are driven only in the even-numbered main scan direction printing positions, and the small nozzles are driven only in the odd-numbered main scan direction printing positions). As a consequence, the formed dots are positioned in the same column. Therefore, printing positions can be set in appropriate positions even when printing is performed by switching the timings of the large and small nozzles during one scan by using the printing position adjusting values when printing is performed using only the large nozzles and the printing position adjusting values when printing is performed using only the small nozzles.

The resolution (usable driving timings) in the mode in which printing is performed by switching the two nozzle groups during one scan is 600 dpi, i.e., half the resolution in the printing mode in which only one nozzle group (only the large nozzles or small nozzles) is used.

Figure 23:
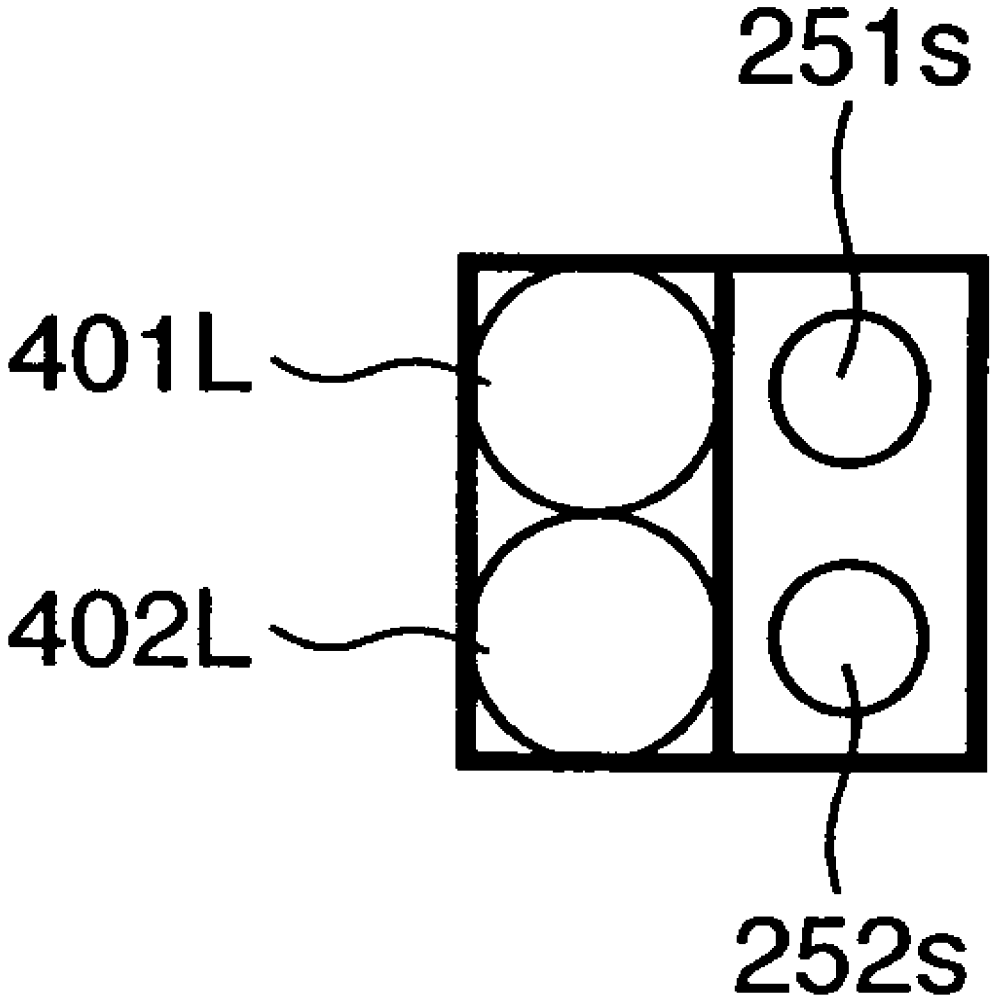
FIG. 23 is a schematic view for explaining the printing positions of printed dots according to the first embodiment.
Figure 25:
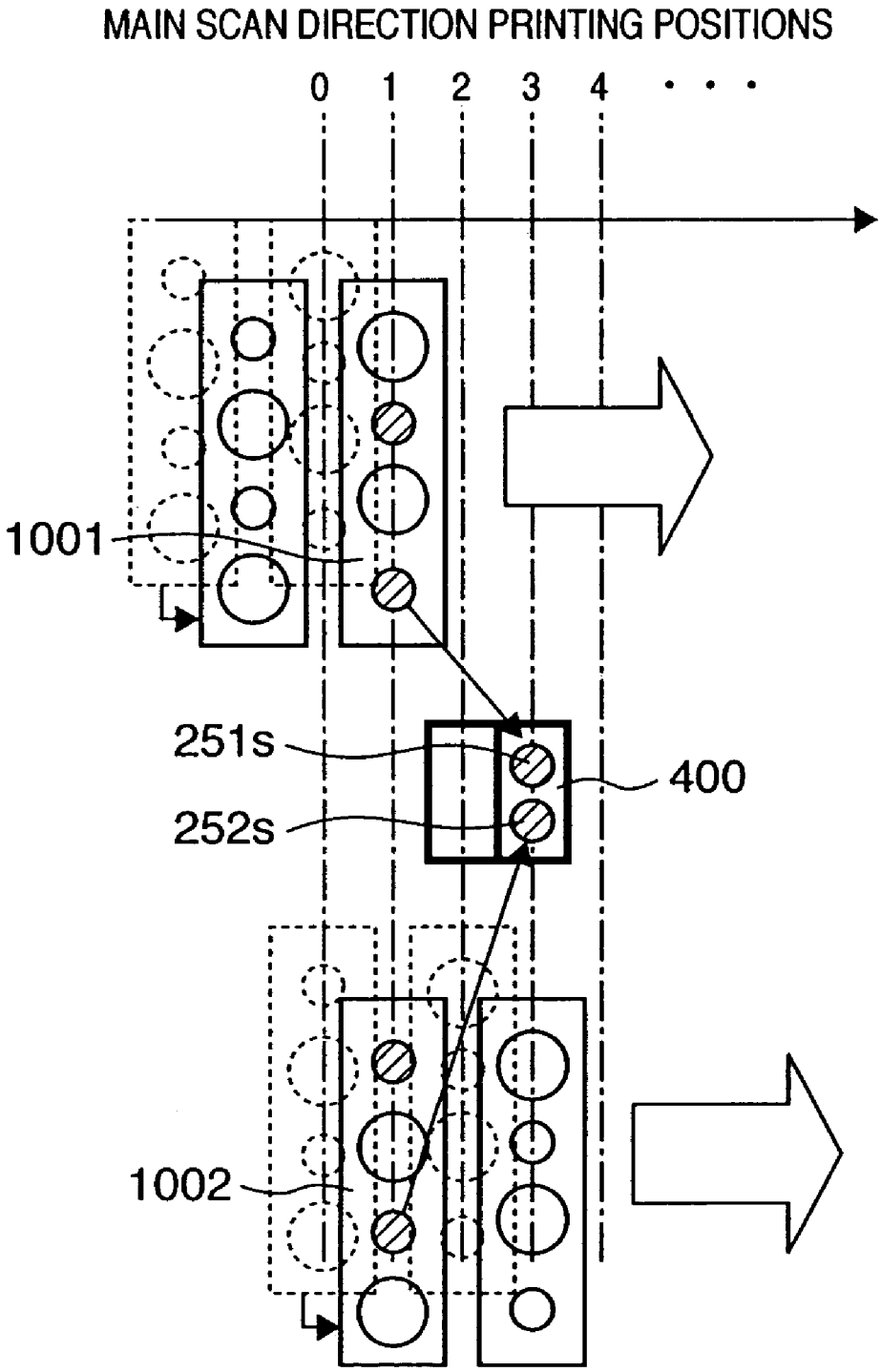
FIG. 25 is a schematic view for explaining the printing positions of printed dots when the driving timings of the small nozzles are staggered in the first embodiment.

On the other hand, if the result of the printing position adjustment performed in the printing mode using only the large nozzles is the state shown in FIG. 4 and the result of the printing position adjustment performed in the printing mode using only the small nozzles is the state shown in FIG. 18, the printhead having the arrangement of this embodiment cannot drive the two, large and small nozzle groups in the same main scan direction printing position by using these printing position adjusting values. That is, when the large nozzles are in the state shown in FIG. 4, these large nozzles are driven in the even-numbered main scan direction printing positions, so the small nozzles cannot be driven in these even-numbered main scan printing positions any longer. In this embodiment, therefore, to give priority to staggering the discharge timings, the small nozzles are driven in an odd-numbered main scan printing position as shown in FIG. 25, and dots are printed as shown in FIG. 23. (Although the timing of the small dots is staggered in this example, the driving timing of the large nozzles may also be staggered).

FIG. 25 shows the state in which the driving timing of the small nozzles is delayed by 1 from the state shown in FIG. 18 (the printhead is scanning to the right as indicated by the arrows). Referring to FIG. 25, the state of the printhead shown in FIG. 18 is also indicated by the dotted lines. FIG. 23 is a view showing the printed dots (401L and 402L) formed in the target pixel 400 when the large nozzles are driven at the driving timing shown in FIG. 4, together with the printed dots (251S and 252S) formed in the target pixel 400 when the small nozzles are driven at the driving timing shown in FIG. 25.

Also, if dots printed by ink discharged from the large nozzles are formed as shown in FIG. 4 and dots printed by ink discharged from the small nozzles are formed as shown in FIG. 19, the large and small nozzles cannot be driven during the same main scan, so it is necessary to change the printing position set values by staggering the driving timing of the large or small nozzles. In this embodiment, the driving timing of a nozzle row is staggered in order to minimize the number of dots to be printed at the staggered driving timing. That is, in this case, only the driving timing of the small nozzles of the nozzle row 1001 is staggered by 1 as shown in FIG. 20.

Figure 20:
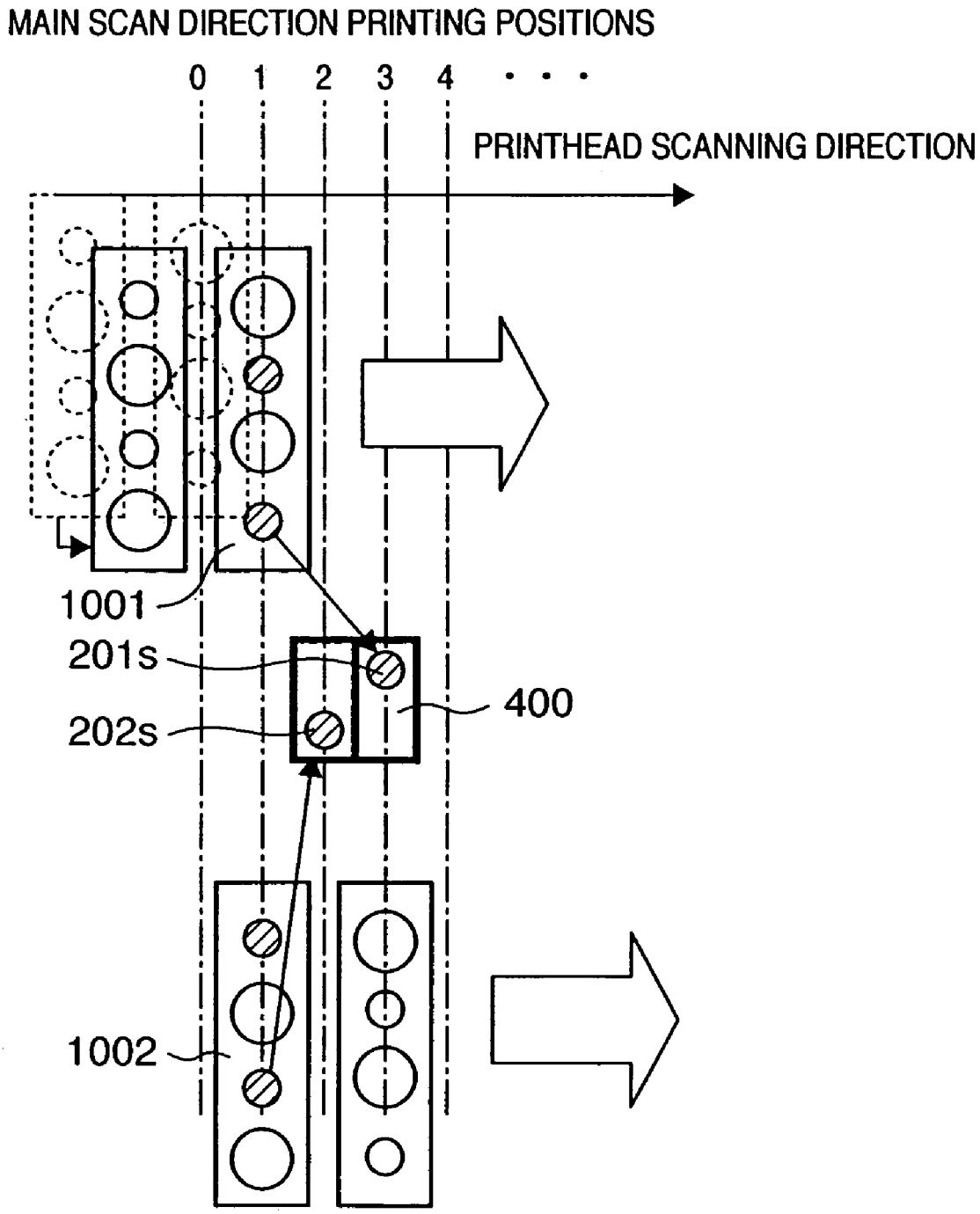
FIG. 20 is a schematic view for explaining the printing positions of printed dots when only the driving timing of small nozzles of one nozzle row is staggered by 1 in the first embodiment.

FIG. 20 shows the state in which the driving position of the small nozzles of the even-numbered nozzle row 1001 is shifted by 1 in the main scan direction (+) from the state shown in FIG. 19. In FIG. 20, the driving timing of the small nozzles of the even-numbered nozzle row shown in FIG. 19 is also indicated by the dotted lines. By thus staggering the driving timing of the small nozzles of one nozzle row, the small nozzles of the even- and odd-numbered nozzle rows 1001 and 1002 can be driven in an odd-numbered main scan direction printing position. Consequently, the large and small nozzles can be driven during the same main scan without overlapping the main scan direction printing positions of the large nozzles as shown in FIG. 4.

Figure 24:
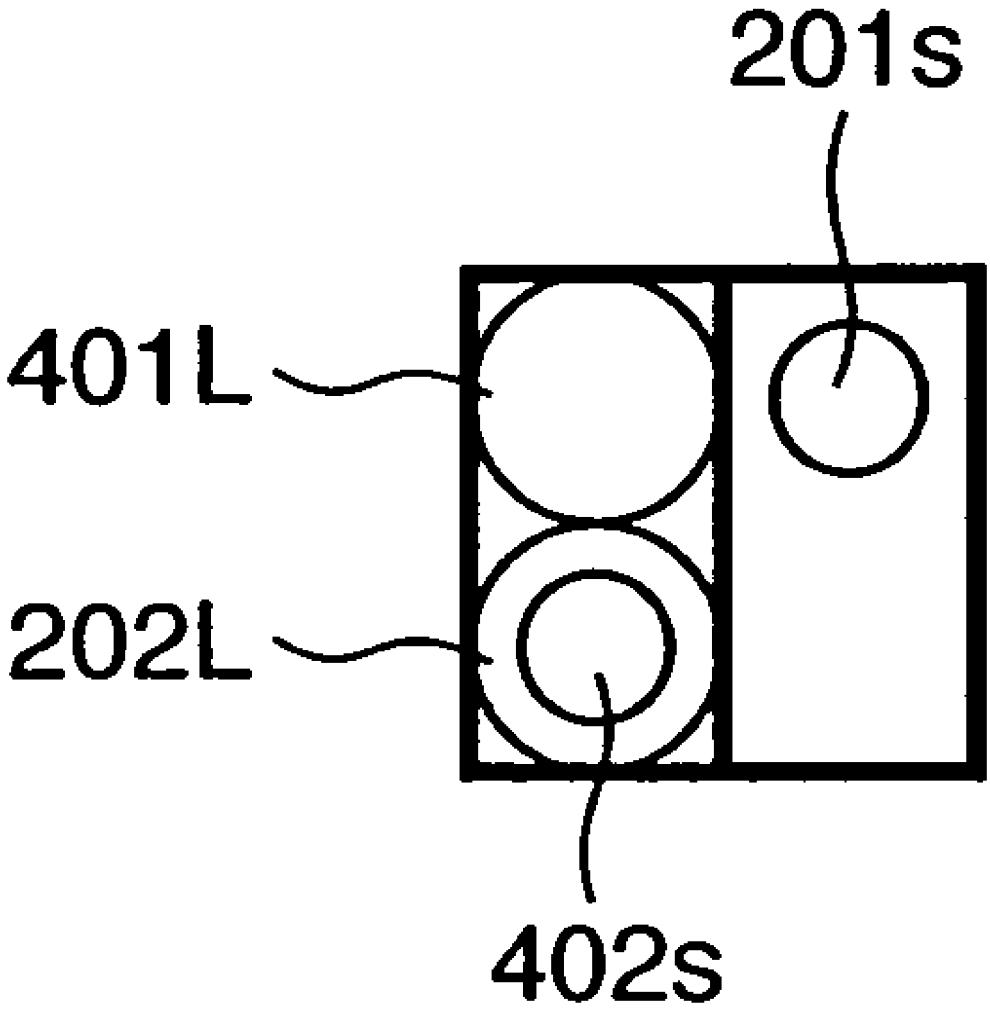
FIG. 24 is a schematic view for explaining the printing positions of printed dots according to the first embodiment.

The resulting printing positions of dots are as shown in FIG. 24. FIG. 24 is a view showing printed dots (401L and 402L) formed in the target pixel 400 when the large nozzles are driven at the driving timing shown in FIG. 4, and printed dots (201S and 202S) formed in the target pixel 400 when the small nozzles are driven at the driving timing shown in FIG. 20. In this embodiment as described above, the set values adjusted by the printing position adjustment are reflected on printing as much as possible, and the number of dots to be printed at the staggered timing is minimized.

When the large and small nozzles are driven at the same driving timing, the driving timing is changed as follows. That is, after a set value of the printing position adjustment of the large nozzles (row) and a set value of the printing position adjustment of the small nozzles (row) are determined, the driving timing is changed by the MPU 32 of the printing apparatus in accordance with a predetermined rule by referring to these two set values. For example, the driving timing is changed by looking up a table on the basis of the set values of the large and small nozzles. A nozzle row whose driving timing is to be changed can be either the even- or odd-numbered nozzle row 1001 or 1002. However, this driving timing change is always performed such that dots are printed within 600 dpi as the size of a target pixel (in this embodiment, such that the main scan direction printing position is shifted backward).

Figure 37:
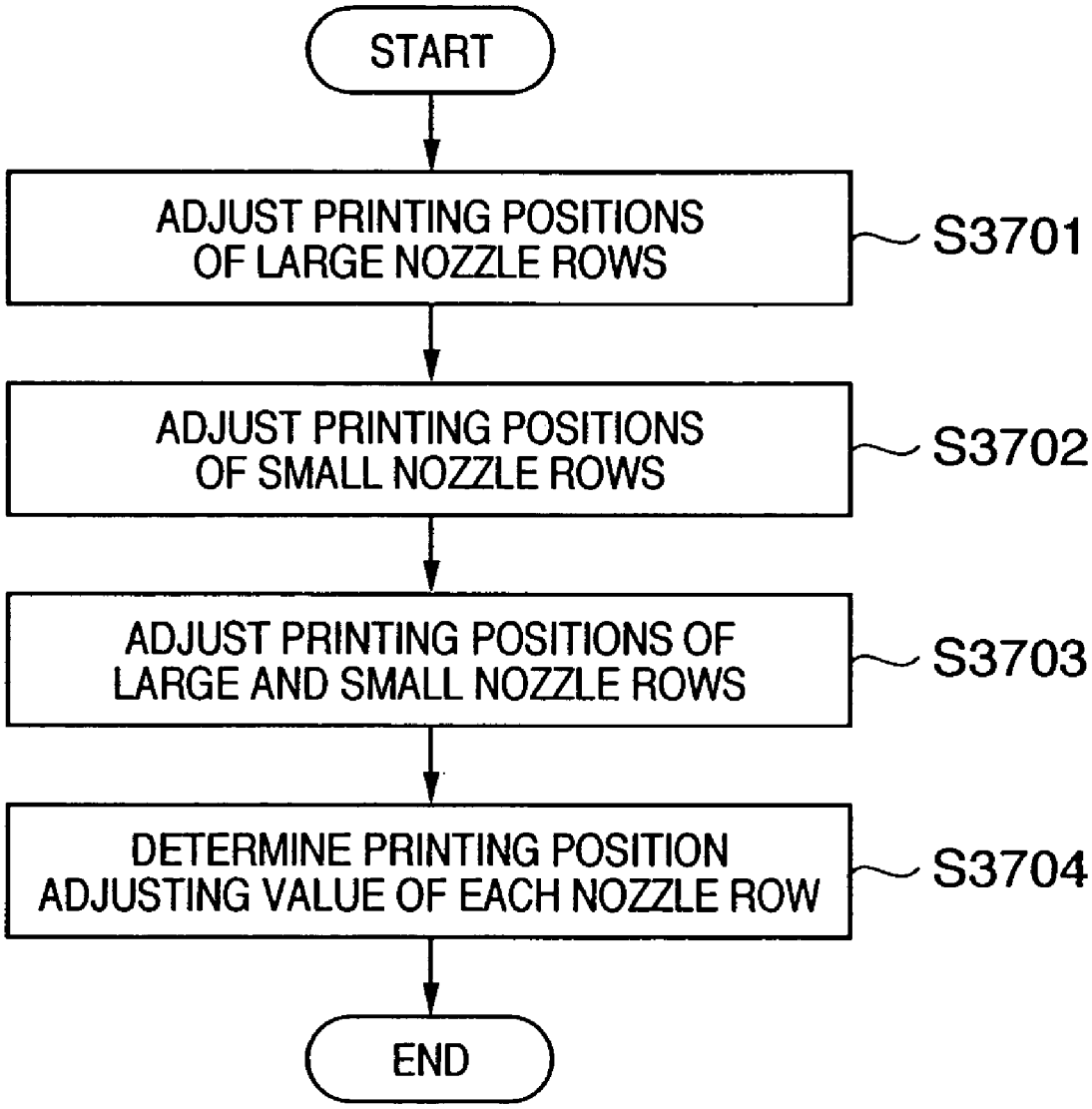
FIG. 37 is a flowchart for printing position adjusting value setting.

FIG. 37 shows the flow of printing position adjusting value setting.

First, in step S3701, the relative positional relationship (large nozzle row printing position relationship) between the printing positions of even- and odd-numbered nozzle rows of large nozzle rows is checked. In step S3702, the relative positional relationship (small nozzle row printing position relationship) between the printing positions of even- and odd-numbered nozzle rows of small nozzle rows is checked. In step S3703, the printing position relationship between the even-numbered large and small nozzle rows is checked. On the basis of these positional relationships, printing position adjusting values of the large even-numbered nozzle row, large odd-numbered nozzle row, small even-numbered nozzle row, and small odd-numbered nozzle row are determined.

Figure 38:
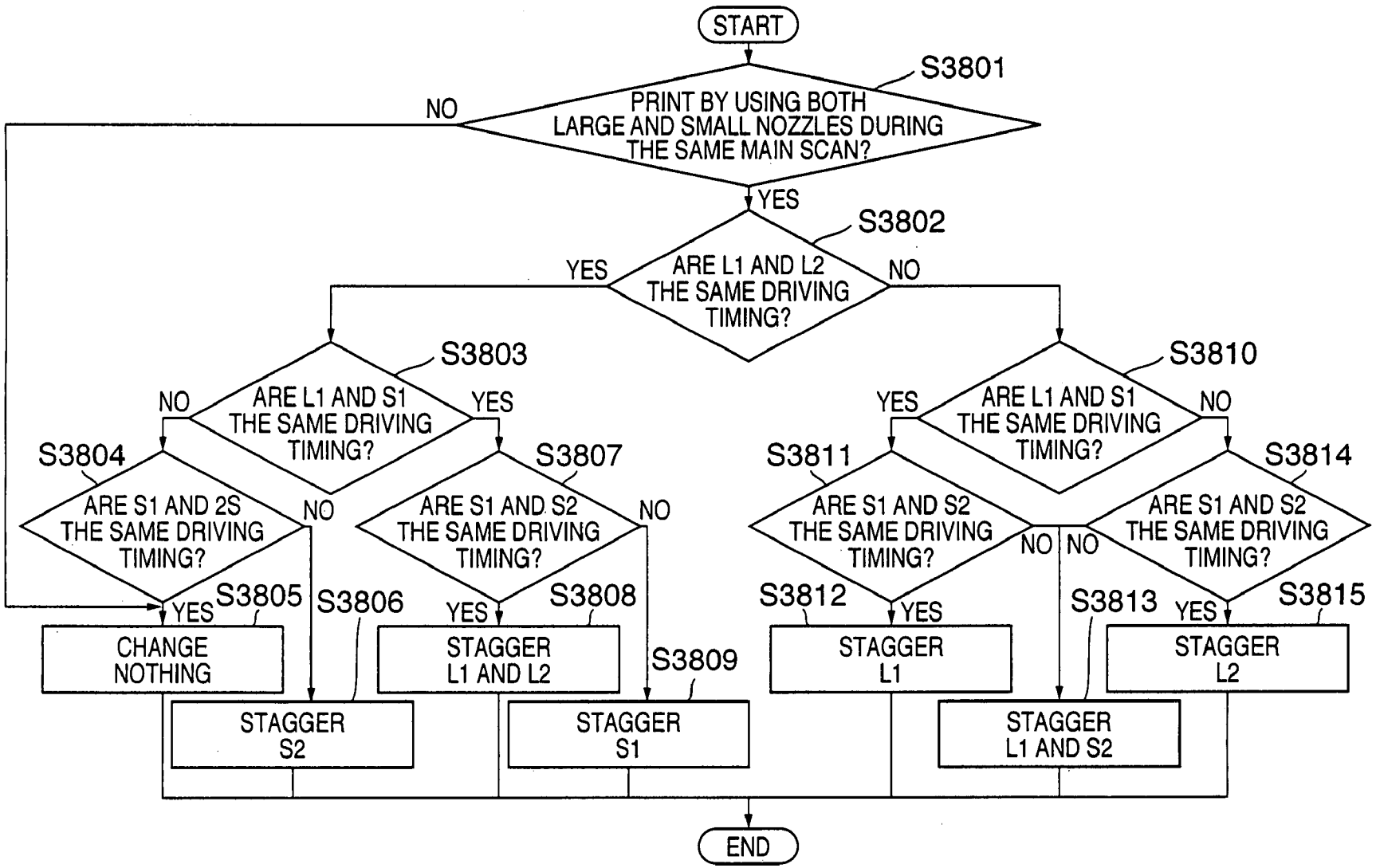
FIG. 38 is a flowchart used when the printing position adjusting values explained with reference to FIG. 37 are used in actual printing.

FIG. 38 shows an example of a flow used when the printing position adjusting values explained with reference to FIG. 37 are used in actual printing. For the sake of descriptive simplicity, in this flow shown in FIG. 38, the printing position adjusting value of the large even-numbered nozzle row is indicated by L1, the printing position adjusting value of the large odd-numbered nozzle row is indicated by L2, the printing position adjusting value of the small even-numbered nozzle row is indicated by S1, and the printing position adjusting value of the small odd-numbered nozzle row is indicated by S2.

In step S3801, whether the printing mode to be printed by using both the large and small nozzles during the same main scan is determined. If the large and small nozzles are not used together in the same main scan, this means that printing can be performed by directly using the printing position adjusting values calculated in FIG. 37. Therefore, the flow advances to step S3805 to print by directly using these printing position adjusting values.

If the large and small nozzles are used together in the same main scan, the flow advances to step S3802 to determine whether L1 and L2 are the same driving timing if driving is performed using the position adjusting values obtained in FIG. 37. The "same driving timing" herein mentioned indicates whether printing positions in the main scan direction in which driving is performed are equally even numbers or odd numbers in FIG. 4 or 17. That is, when L1 and L2 are the same driving timing, both L1 and L2 are even numbers or odd numbers.

If in step S3802 both L1 and L2 are found to be even numbers, the flow advances to step S3803 to determine whether L1 and S1 are the same driving timing. If L1 and S1 are the same driving timing, the flow advances to step S3807; if not, the step advances to step S3804. In both steps S3804 and S3807, whether S1 and S2 are the same timing is determined. If YES in step S3804, this means that L1 and L2 are the same timing, S1 and S2 are the same timing, and L1 and S1 are not the same timing, so it is determined that printing can be performed by directly using the printing position adjusting values obtained beforehand. If in step S3804 S1 and S2 are not the same timing, S2 is staggered. If in step S3807 S1 and S2 are the same timing, L1 and L2 are staggered. If in step S3807 S1 and S2 are not the same timing, S1 is staggered.

If it is determined in step S3802 that L1 and L2 are not the same timing, the flow advances to step S3810 to determine whether L1 and S1 are the same timing. If YES in step S3810, the flow advances to step S3811. If NO in step S3810, the flow advances to step S3814. In both steps S3811 and 3814, whether S1 and S2 are the same timing is determined. If YES in step S3811, L1 is staggered. If NO in step S3811 or S3814, L1 and S2 are staggered. If YES in step S3814, L2 is staggered.

In this embodiment, printing position adjustment performed in forward printing in which scan is performed from the left to the right is explained. However, even in printing position adjustment performed in backward printing in which scan is performed from the right to the left, it is of course possible to change printing positions by alternately driving the large and small nozzles on the basis of the same concept. Even in this case, changes are made such that dots are always printed in a 600-dpi target pixel in the same manner as above.

As described above, in the arrangement in which the large and small nozzles are alternately driven, it is possible, by changing the driving timings as needed, to obviate the need to perform any special printing position adjustment for alternate driving of the large and small nozzles, and to decrease the difference from an optimum printing position to 1,200 dpi which is a minimum value. In addition, since set values are so determined as to fall within the range of 600 dpi as the size of a pixel, deterioration of the quality of printed images can be prevented.

SECOND EMBODIMENT

The second embodiment of the present invention will be described below. The second embodiment also relates to printing position adjustment in an inkjet printing apparatu-similar to that of the first embodiment. In the following description, an explanation of the same portions as in the first embodiment will be omitted, and only the characteristic features of this embodiment will be explained.

In the first embodiment, printing position adjustment performed for two nozzle rows during scan (one scan) in one direction is described. In this embodiment, printing position adjustment performed when two-way printing is performed will be explained. As in the first embodiment, assume that the size of a target pixel is 600 dpi, and driving timings can be set at a pitch of 1,200 dpi.

That is, the second embodiment is characterized in that when printing is performed by scanning a printhead forward and backward, set values of the forward and backward relative printing positions of the same nozzle row are determined in a second printing mode on the basis of the setting of relative printing positions determined from patterns for adjusting the forward and backward relative printing positions of the same nozzle row in a first printing mode.

Figure 36:
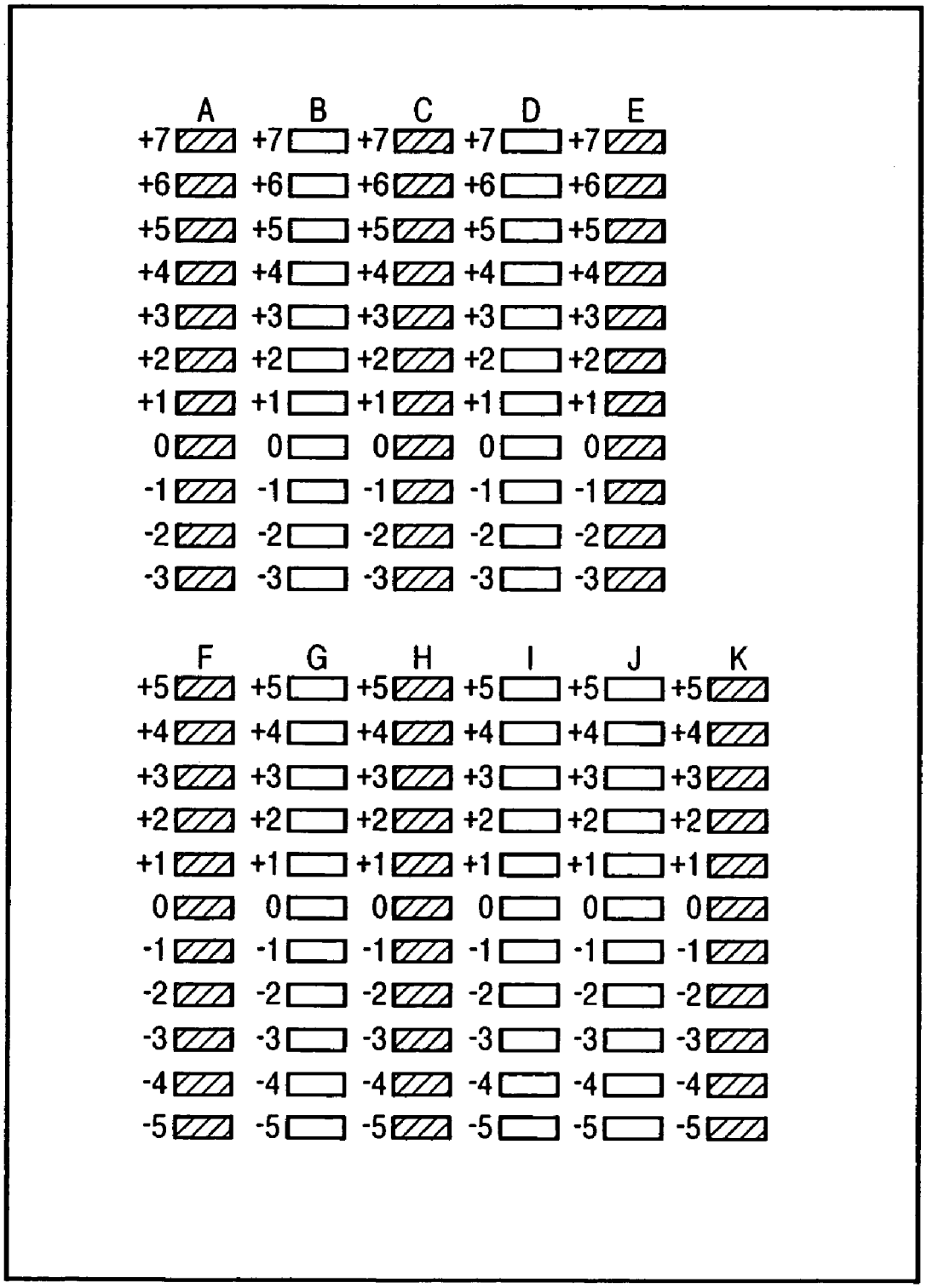
FIG. 36 is a view showing examples of patterns for performing printing position adjustment between a plurality of nozzle rows in the second embodiment.

FIG. 36 shows examples of test patterns used in this embodiment to perform the printing position adjustment. Combinations of nozzle rows and nozzle groups to be adjusted by these patterns are as follows.

A: Black even-numbered row large nozzles/odd-numbered row large nozzles

B: Cyan even-numbered row large nozzles/odd-numbered row large nozzles

C: Magenta even-numbered row large nozzles/odd-numbered row large nozzles

D: Cyan even-numbered row small nozzles/odd-numbered row small nozzles

E: Magenta even-numbered row small nozzles/odd-numbered row small nozzles

F: Black large nozzle two way

G: Color large nozzle two way

H: Black nozzle row/color nozzle row

I: Color small nozzle two way

J: Cyan large nozzles/small nozzles

K: Magenta large nozzles/small nozzles

Details of the patterns A to K shown in FIG. 36 are the same as explained above with reference to FIGS. 8, 9, and 12 to 15. That is, on the basis of one of two nozzle rows as objects of the printing position adjustment (without changing the driving timing of this nozzle row), printing is performed by changing the driving timing of the other nozzle row by 1,200 dpi at one time. In this manner, the relative printing positions of the two nozzle rows as objects of the printing position adjustment can be made different from each other. The printing position adjustment is performed by selecting the smoothest one of a plurality of types of printed patterns. This is also the same as explained above with reference to the patterns shown in FIG. 8.

In the printing position adjustment during two-way printing, unlike in the printing position adjustment during one-way (one-scan) printing as in the first embodiment, even when printing is to be performed by alternately driving large and small nozzles, the printing position adjustment can be performed at a pitch of 1,200 dpi for one nozzle row, as a reference, of the small nozzles of different rows or the large nozzles of different rows.

When printing is to be performed by using the large and small nozzles as described above, only the small nozzles are used for highlighted portions having low densities, thereby reducing the graininess. If the area factor (the ratio of a printing area in a predetermined region on a printing medium: the area factor is proportional to the density in a dot area modulation method) is increased to a certain degree by small printed dots (to be also referred to as small dots hereinafter) formed by the small nozzles, the use of printed dots (to be also referred to as large dots hereinafter) formed by the large nozzles is started.

Accordingly, in a highlighted portion in which small dots are mainly used, the area factor is low, so differences between printing positions are conspicuous and perceived as graininess. In contrast, in an area in which large dots are used, the area factor rises to a certain degree, so differences between printing positions are less conspicuous than the graininess resulting from the printing position differences produced by the small dots. In the printing position adjustment performed in two-way printing according to this embodiment, therefore, to avoid staggering of the driving timings of the small nozzles as much as possible, the driving timings of the large nozzles are primarily staggered on the basis of the small nozzles.

The foregoing will be explained below with reference to FIGS. 26 to 29. In FIGS. 26 to 29, reference numeral 1001 denotes a basic nozzle row of each of a large nozzle group and small nozzle group.

Figure 26:
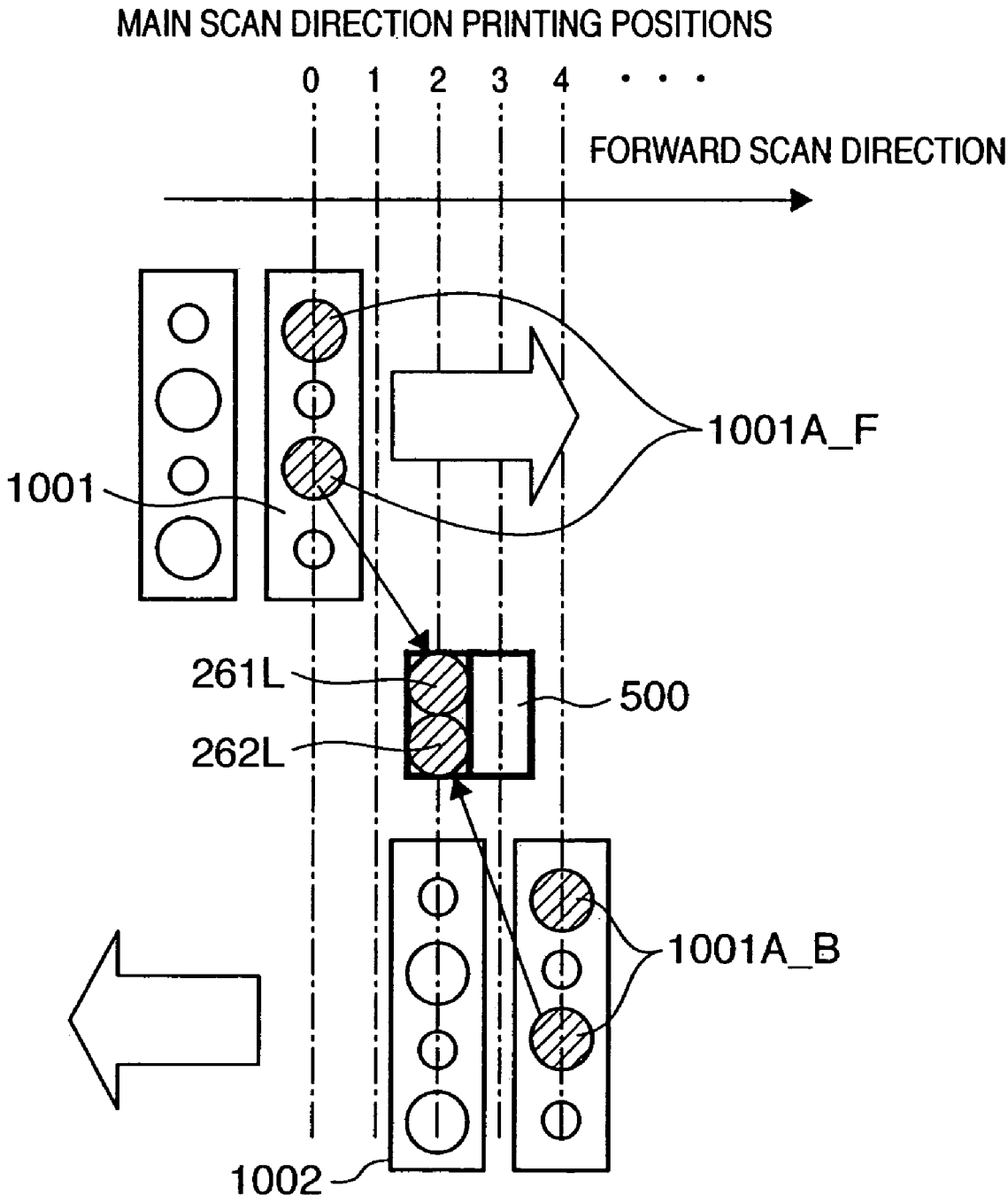
FIG. 26 is a view for explaining the relationships between the driving timings of large nozzles and the positions of printed dots according to the second embodiment.
Figure 27:
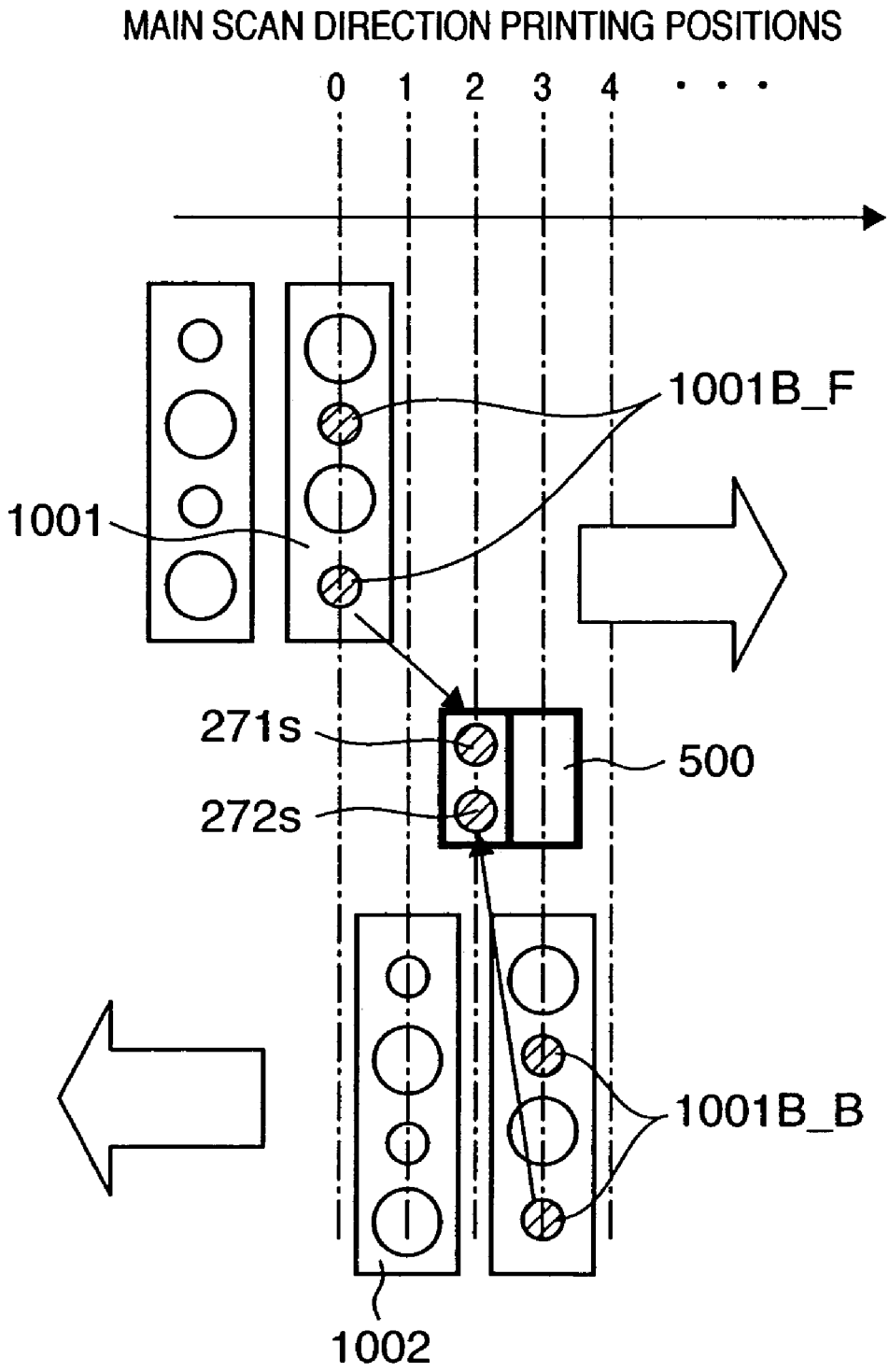
FIG. 27 is a view for explaining the relationships between the driving timings of small nozzles and the positions of printed dots according to the second embodiment.

In alternate driving using large nozzles and small nozzles whose driving timings must be staggered during the same main scan, the state in which dots a formed by using only the large nozzles is shown in FIG. 26, and the state in which dots are formed by using only the small nozzles is shown in FIG. 27.

Figure 28:
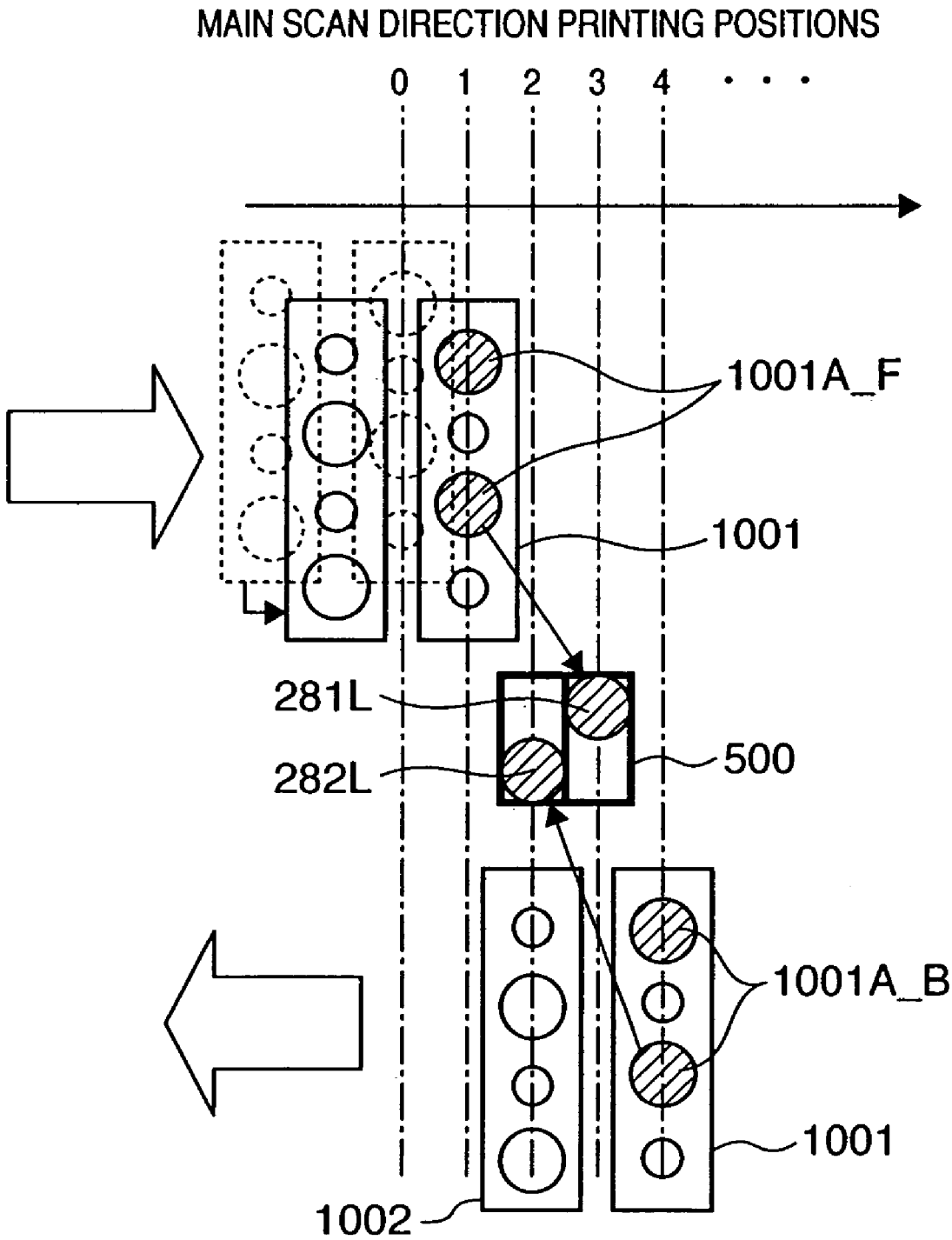
FIG. 28 is a view showing the positions of printed dots when the driving timing of the large nozzles in one way is staggered from that in the other way in the second embodiment.

Referring to FIGS. 26, 27, and 28, the abscissa indicates main scan direction printing positions, and the pitch of these positions is 1,200 dpi, as in the first embodiment described above. Also, each of FIGS. 26, 27, and 28 shows a printhead printing on one target pixel 500, as in FIG. 4 and the like explained in the first embodiment. Furthermore, as in FIG. 4 and the like, nozzles being driven are hatched, dots printed on the target pixel are indicated by hatched circles having the same size as the nozzles, and the scan directions of the printhead are indicated by the arrows.

FIG. 26 shows the state in which while the printhead scans in the main scan direction from the left to the right (forward scan) above the target pixel 500, a dot 261L is printed on the target pixel 500 by driving large nozzles 1001A_F of an even-numbered nozzle row in main scan direction printing position 0. FIG. 26 also shows the state in which while the printhead scans in the main scan direction from the right to the left (backward scan) below the target pixel 500, a dot 262L is printed on the target pixel 500 by driving large nozzles 1001A_B of the even-numbered nozzle row in main scan direction printing position 4.

FIG. 27 shows the state in which while the printhead scans in the main scan direction from the left to the right (forward scan) above the target pixel 500, a dot 271S is printed on the target pixel 500 by driving small nozzles 1001B_F of the even-numbered nozzle row in main scan direction printing position 0. FIG. 27 also shows the state in which while the printhead scans in the main scan direction from the right to the left (backward scan) below the target pixel 500, a dot 272S is printed on the target pixel 500 by driving small nozzles 1001B_B of the even-numbered nozzle row in main scan direction printing position 3.

When the relationships between the printing timings and printed dot positions are as shown in FIGS. 26 and 27, in order to print by driving the large and small nozzles by sequentially switching these nozzles during the same main scan, the large and small nozzles of the even-numbered row must be driven in the same main scan direction printing position 0 during the forward scan. Hence, this driving cannot be executed by the printhead of this embodiment.

In this embodiment, therefore, staggering the driving timing of the small nozzles on the basis of the small nozzles is avoided as much as possible, and the driving timing of the large nozzles is mainly staggered. That is, the driving timing of the large nozzles shown in FIG. 26 is changed to the driving timing as shown in FIG. 28.

FIG. 28 is a view showing the state in which the driving timing of the large nozzles of the even-numbered nozzle row 1001 is changed from main scan direction printing position 0 to main scan direction printing position 1 in the forward scan of target pixel printing. In FIG. 28, the position of the printhead during the forward scan shown in FIG. 26 is also indicated by the dotted lines. Since the driving timing is changed, a printed dot 281L is shifted by 1,200 dpi to the right in the main scan direction from the printed dot 261L shown in FIG. 26.

Figure 29:
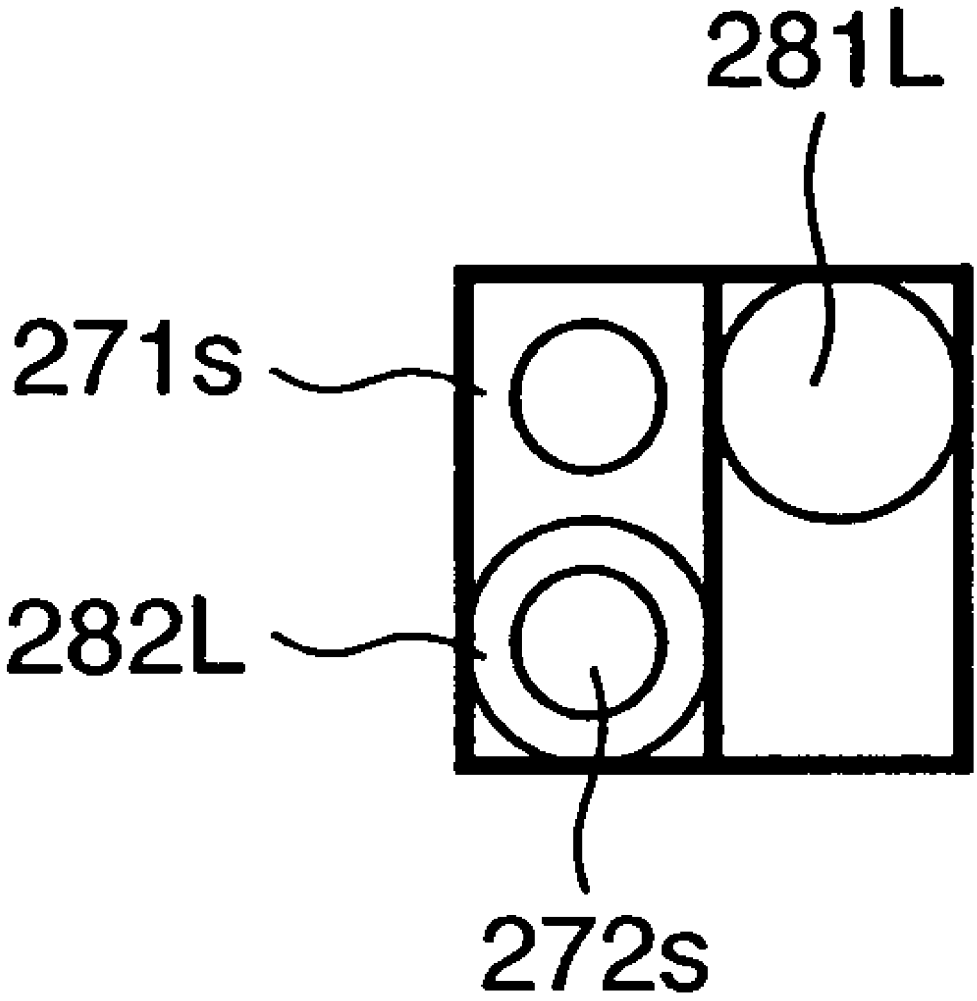
FIG. 29 is a schematic view for explaining the printing positions of printed dots in a target pixel shown in FIG. 28.

FIG. 29 shows the state of dots printed on the target pixel alone when the large and small nozzles are driven as shown in FIGS. 27 and 28. That is, FIG. 29 shows the dot 281L printed by forward scan using the large nozzles of the even-numbered nozzle row, a dot 282L printed by backward scan using the large nozzles of the even-numbered nozzle row, the dot 271S printed by forward scan using the small nozzles of the even-numbered nozzle row, and the dot 272S printed by backward scan using the small nozzles of the even-numbered nozzle row.

Figure 30B:
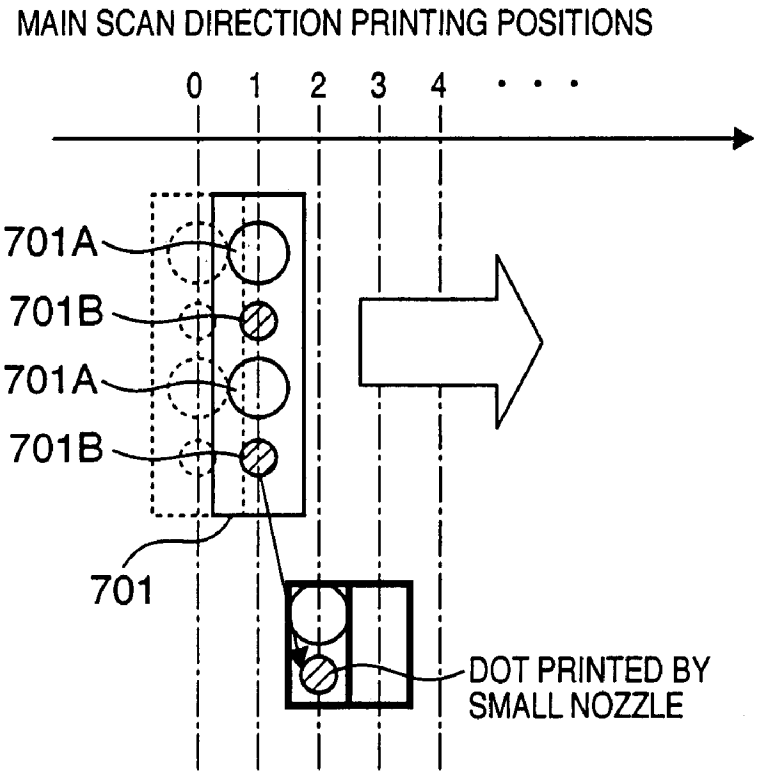
FIGS. 30A and 30B are views for explaining the discharge operation of a printhead including both large and small nozzles and the positions of printed dots.
Figure 30A:
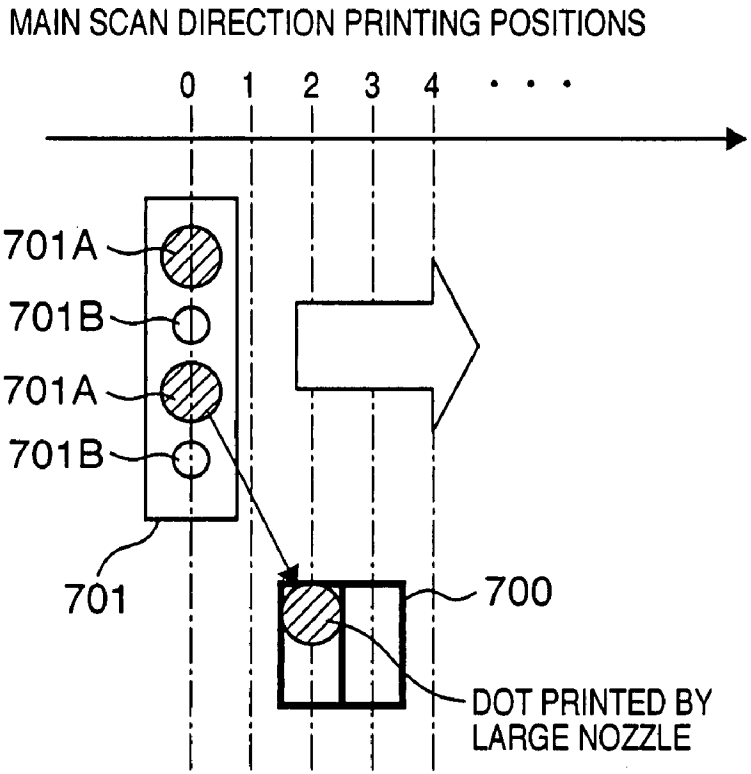

In the above description, the adjustment of printing positions in two-way printing using the large and small nozzles of the even-numbered nozzle row is explained. However, as explained earlier with reference to FIGS. 30A and 30B, the printhead used in this embodiment also prints patterns for adjusting the printing positions of even- and odd-numbered nozzle rows, and is subjected to printing position adjustment using these patterns. Therefore, if the relationships between dots printed on a target pixel and the driving timings when the small nozzles of even- and odd-numbered nozzle rows are used in forward scan are as shown in FIG. 19, the driving timing of the small nozzles of the odd-numbered nozzle row must be changed from 1 to 2 (not shown).

As described above, the driving timing of the small nozzles must be changed as needed. Normally, on the basis of the small nozzles of the even-numbered nozzle row, the set value of printing position adjustment is always reflected on two-way printing position adjustment of the small nozzles of the even-numbered nozzle row. In this manner, two-way printing can be performed while printing positions match best.

In the above example, the large nozzles are driven such that the main scan direction printing positions are odd numbers during forward scan and are even numbers during backward scan. That is, during the same main scan, the large or small nozzles can be driven only at even- or odd-numbered timings. However, the driving timings need not be even- or odd-numbered timings during different scan operations, i.e., during forward scan and backward scan. Accordingly, two-way printing position adjustment of the large or small nozzles can be performed at a pitch of 1,200 dpi.

As described above, when printing is to be performed by alternately driving the large and small nozzles, the driving timing of the large nozzles is mainly staggered without staggering the driving timing of the small nozzles (without changing the set value of printing position adjustment). This obviates the need to perform any special printing position adjustment for the alternate driving using the large and small nozzles, and makes it possible to minimize the difference from an optimum printing position. In addition, deterioration of the quality of printed images can be prevented.

Furthermore, printing position adjustment for the two nozzle rows when the large and small nozzles are to be alternately driven can be so set as to fall within the range of 600 dpi as the size of a pixel. This also prevents deterioration of the quality of printed images.

MODIFICATIONS

In each of the above embodiments, the printhead in which the large and small nozzles are alternately arranged in the same nozzle row is explained. However, the present invention is also applicable to printheads having other arrangements. For example, the present invention can be applied to a printhead in which large and small nozzles are arranged in different rows and these large and small nozzle rows cannot be driven at the same time during the same printing scan. The same effect as above can also be obtained by this printhead.

Figure 31:
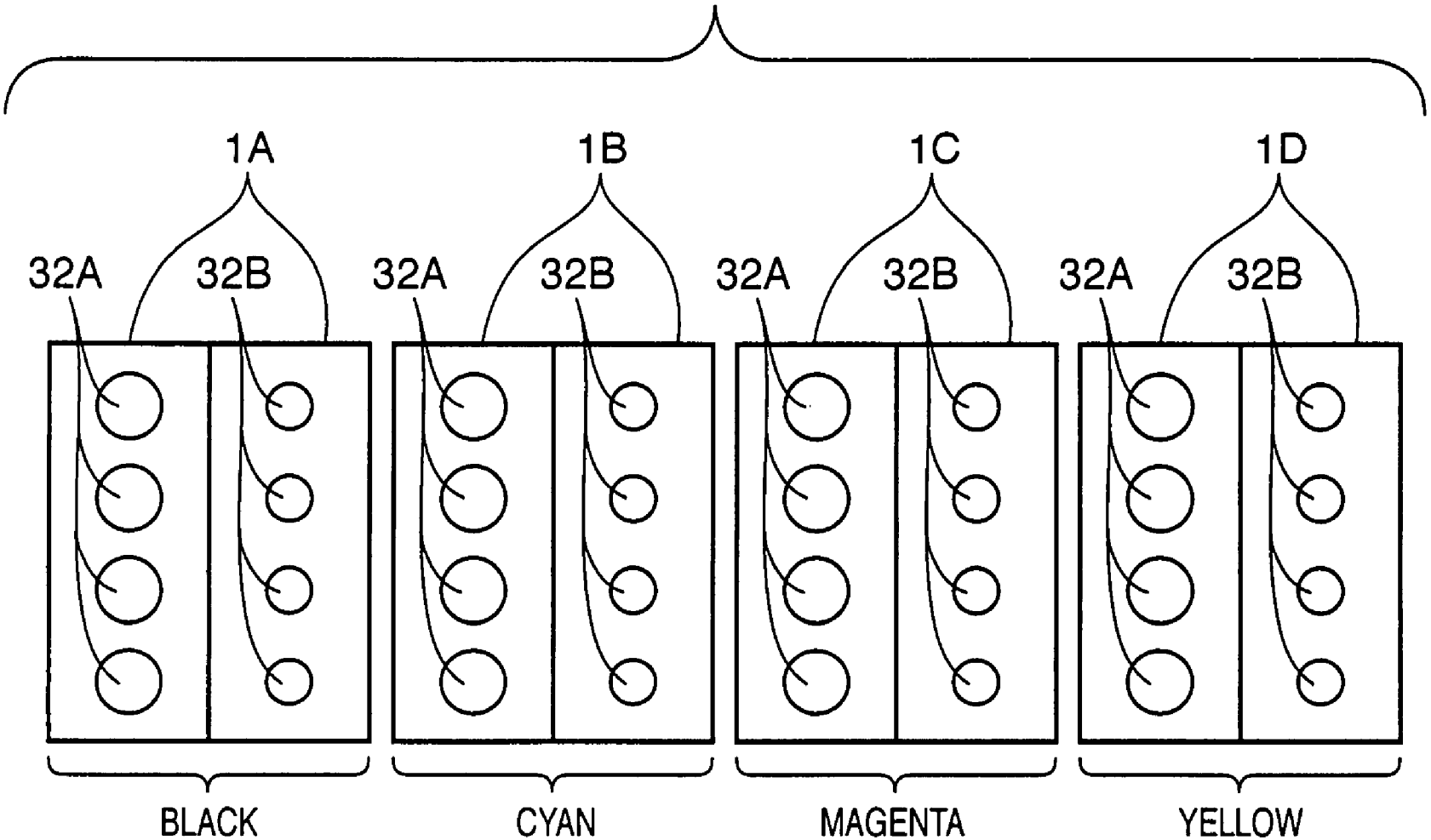
FIG. 31 is a view showing the arrangement of a printhead in which large and small nozzles form different nozzle rows.

An outline of the operation in this case will be explained below. FIG. 31 shows an example of a printhead in which large and small nozzles are formed as different nozzle rows.

This printhead shown in FIG. 31 uses ink liquids of four colors, i.e., black, cyan, magenta, and yellow, and has a large nozzle row 32A and small nozzle row 32B for each of these ink liquids. The printhead can be used by driving these large and small nozzle rows by sequentially switching them during the same main scan.

The printhead shown in FIG. 31 requires no printing position adjustment between even- and odd-numbered nozzle rows as described in the first embodiment. Therefore, only printing position adjustment in two-way printing is the problem.

Even when the printhead as shown in FIG. 31 is used, the same effect as in the second embodiment can be obtained by the same processing as in the second embodiment. This will be briefly explained below with reference to FIGS. 32 to 35 by taking nozzle rows of black ink as an example.

Figure 32:
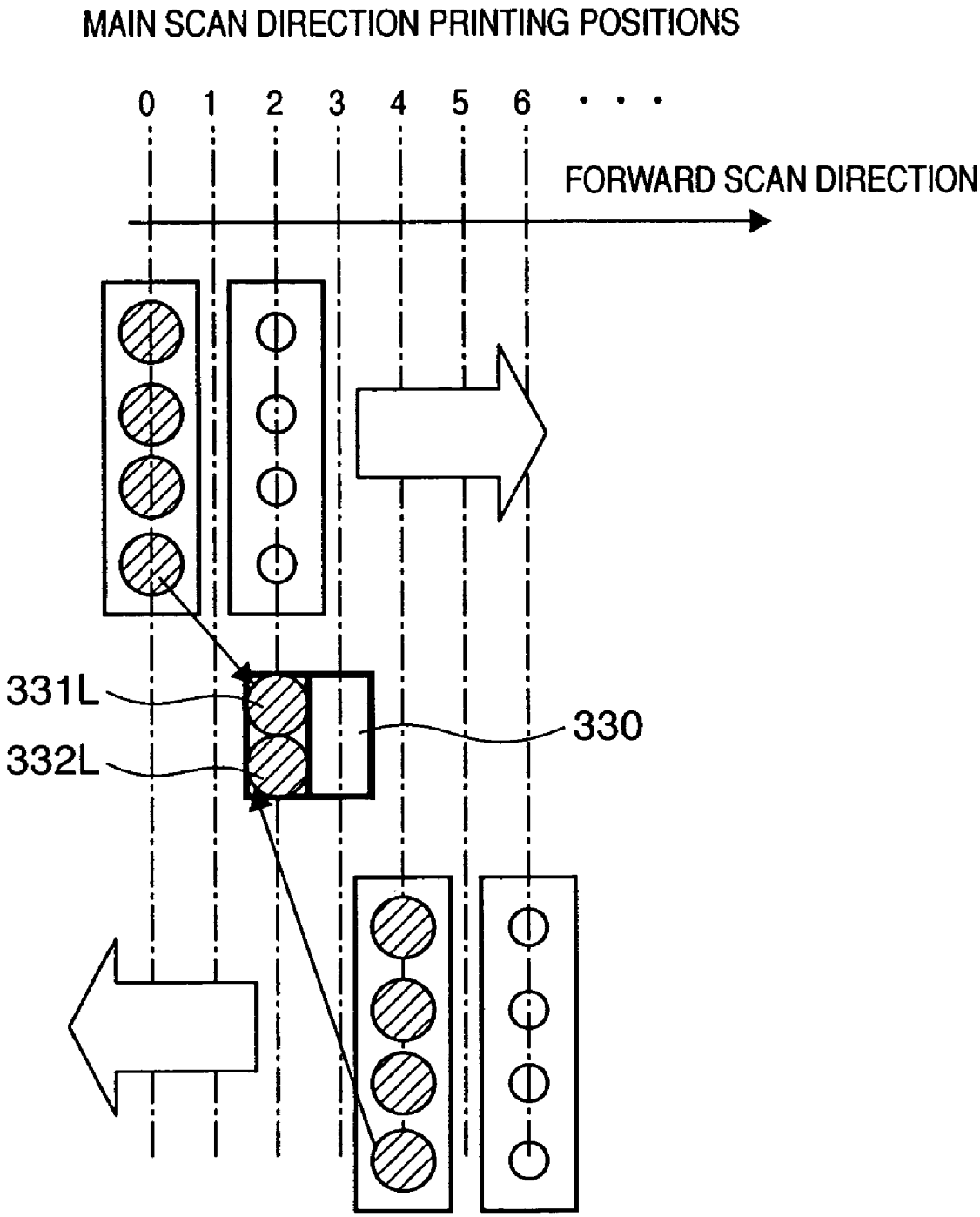
FIG. 32 is a view for explaining the relationships between the driving timings of large nozzles and the positions of printed dots according to a modification of the second embodiment.
Figure 33:
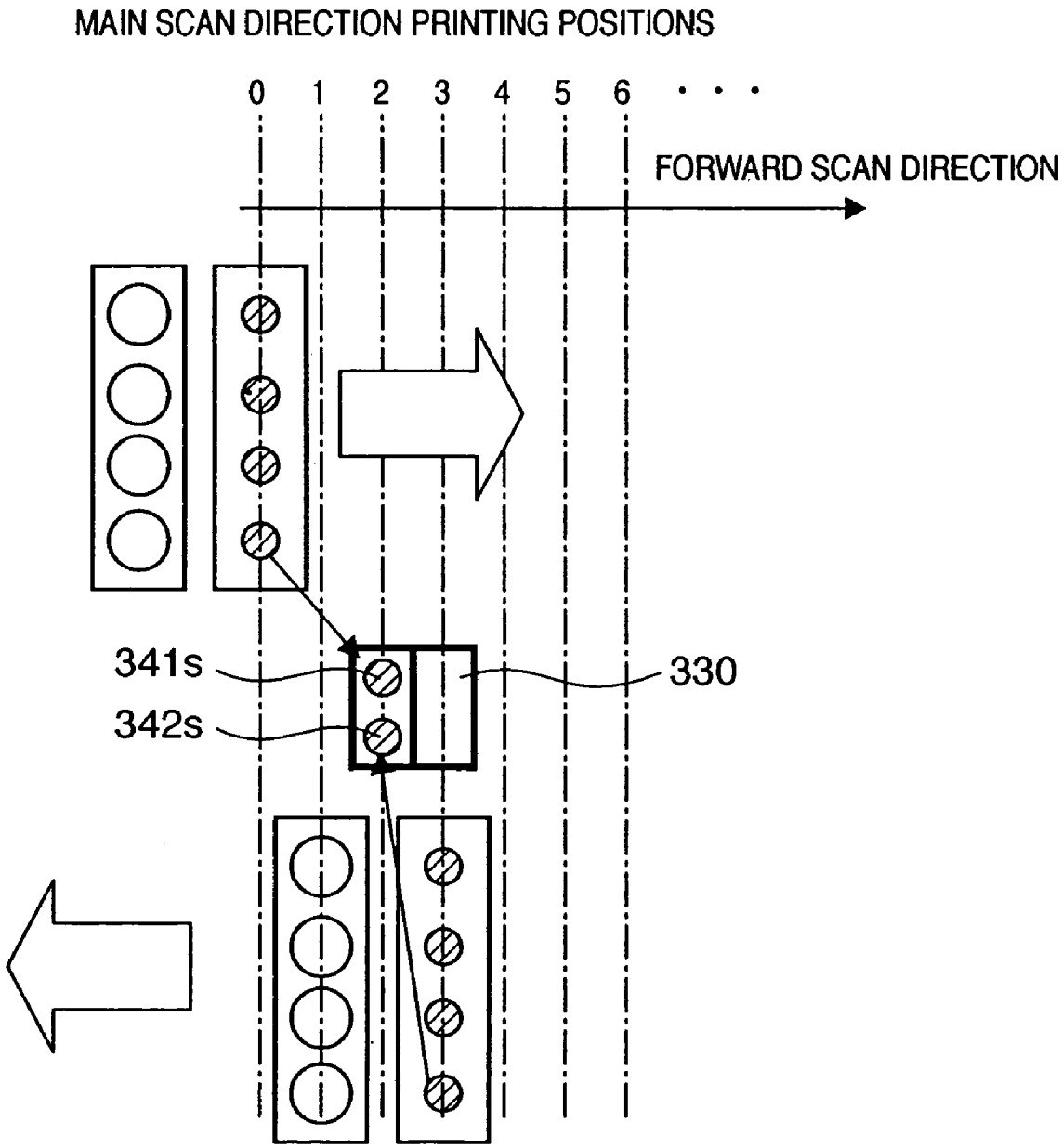
FIG. 33 is a view for explaining the relationships between the driving timings of small nozzles and the positions of printed dots according to the modification of the second embodiment.
Figure 34:
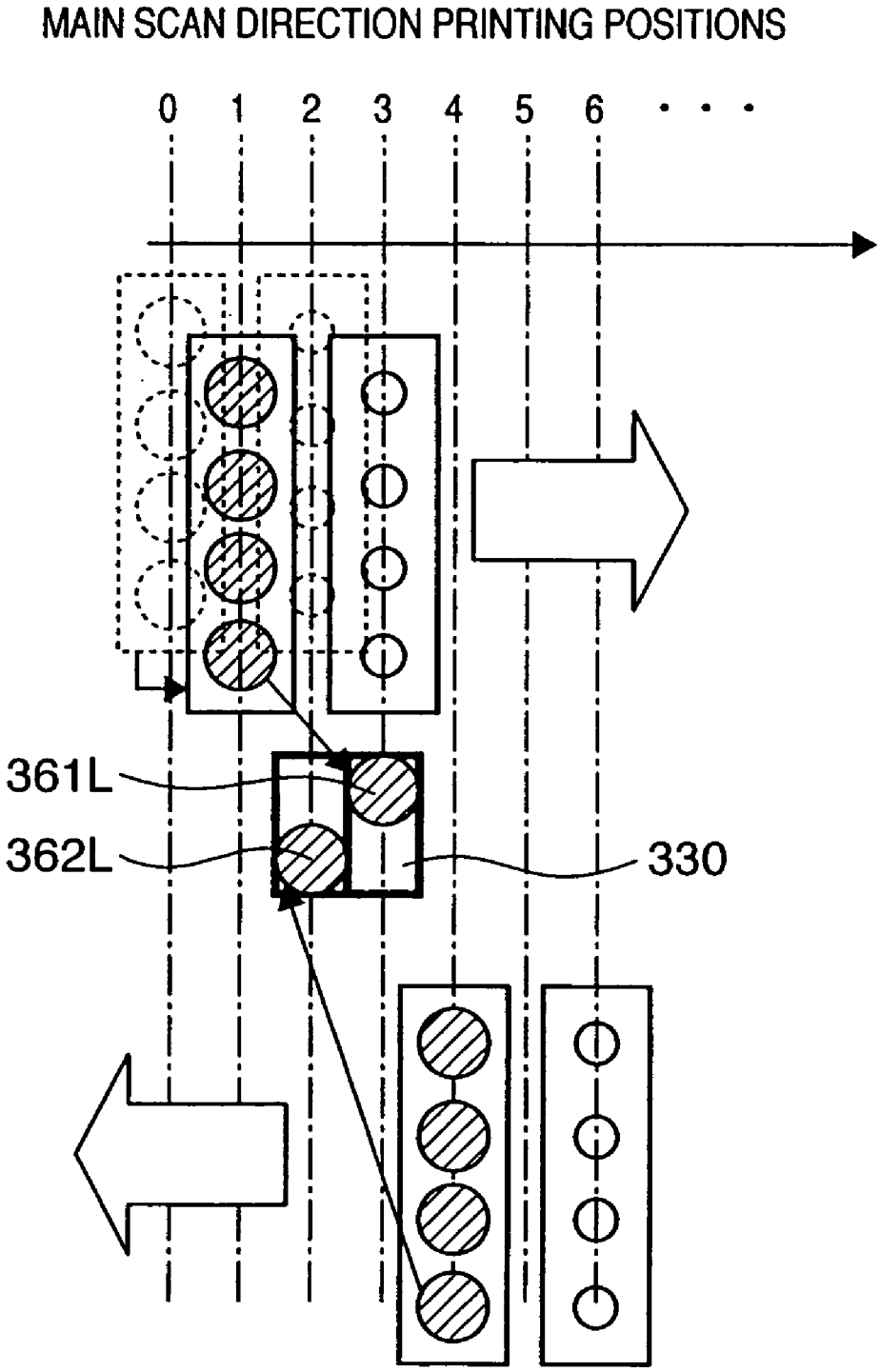
FIG. 34 is a view for explaining the relationships between the driving timings of the large nozzles and the positions of printed dots when these driving timings are staggered in the modification of the second embodiment.

FIGS. 32 to 34 illustrate the same relationships between the driving timings and printed dots as shown in FIGS. 26 to 28 except that the printhead is changed. That is, FIG. 32 shows the relationships between the driving timings and printed dots when two-way printing is performed using only the large nozzle row. FIG. 33 shows the relationships between the driving timings and printed dots when two-way printing is performed using only the small nozzle row.

Figure 35:
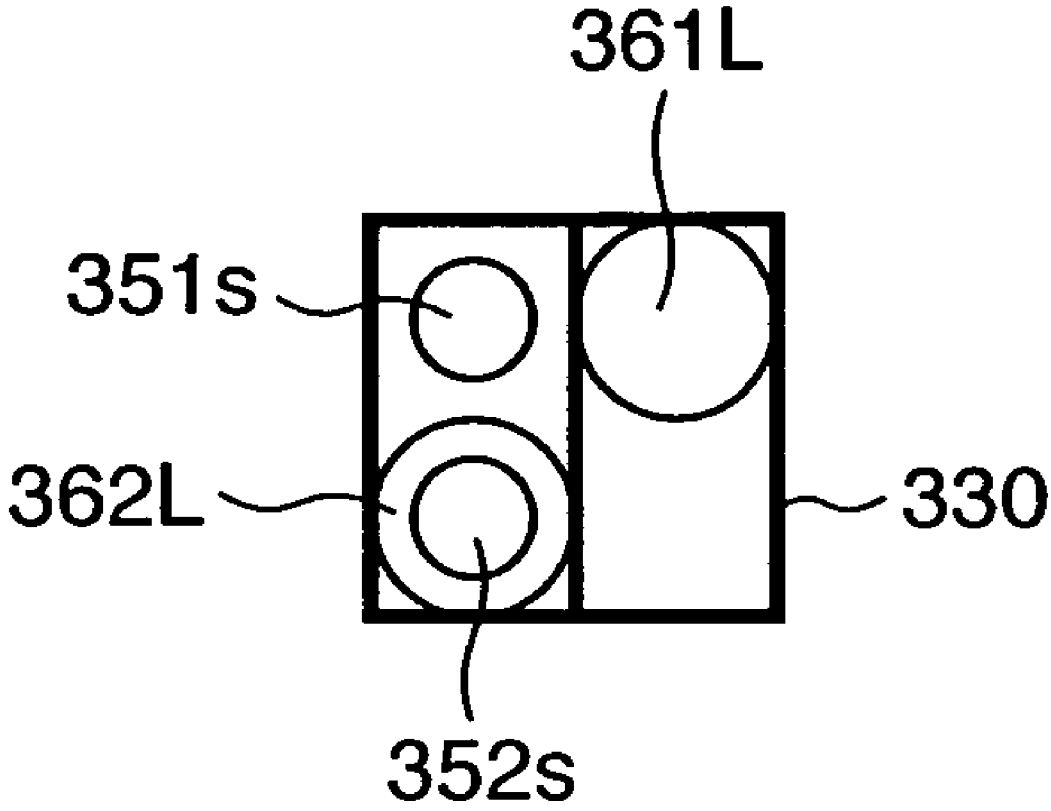
FIG. 35 is a schematic view for explaining the printing positions of printed dots in the second embodiment.

In these cases, as in the cases shown in FIGS. 26 and 27, the printhead so designed as to print by driving the large and small nozzle rows by sequentially switching them during the same main scan cannot print meeting the states shown in FIGS. 32 and 33 at the same time during forward scan. Therefore, as shown in FIG. 34, the printing position of the large nozzle row in the forward scan is shifted by 1 in the main scan direction. This makes sequential switching printing in the same main scan possible. FIG. 35 shows the state of the printed dots in a target pixel 330.

As described above, the same effect as in the second embodiment can be obtained by the same processing as in the second embodiment without using the printhead having the arrangement as described in the second embodiment.

Also, in each of the above embodiments, printing position adjustment between two types of nozzles, i.e., large and small nozzles for forming printed dots having different sizes is explained. However, the present invention is also applicable to printing position adjustment between printheads using ink liquids different in density. Even in this case, the same effect as above can be obtained by performing the same processing as above by replacing small nozzles with nozzles for discharging thin ink, and large nozzles with nozzles for discharging thick ink.

Furthermore, even when printing ink liquids such as cyan, magenta, and yellow are used, ink which is conspicuous if printed in an incorrect position is desirably used as a reference. More specifically, it is desirable to set ink to be used as a reference in accordance with an image to be printed. For example, for an image such as a human face, magenta which is mainly used to form the skin color is set as a reference. For an image including the sky, cyan which is mainly used to form the color of the sky is set as a reference. This further improves the image quality.

OTHER EMBODIMENTS

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, besides a device provided as an integral part of, or separate from, an image output terminal of an information processor such as a computer, a printing apparatus according to the present invention may take on the form of a copier combined with a reader or the like, or a facsimile machine having a transceiver function.

The present invention can be applied to a system comprising a plurality of devices (e.g., host computer, interface, reader, printer) or to an apparatus comprising a single device (e.g., copying machine, facsimile machine).

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus for printing by scanning an inkjet printhead for discharging ink and a printing medium relative to each other, wherein said printhead comprises a first nozzle group used to print a dot having a first density, and a second nozzle group used to print a dot having a second density, and also has a plurality of nozzle groups, and the inkjet printing apparatus has a first printing mode in which only one of said first and second nozzle groups is used during one printing scan, and a second printing mode in which said first and second nozzle groups are driven at different timings during one printing scan, and wherein the inkjet printing apparatus comprises printing position setting means for determining set values of relative printing positions of said plurality of nozzle rows in the second printing mode, on the basis of set values of relative printing positions specified from a pattern for adjusting relative printing positions of said plurality of nozzle rows in the first printing mode.

2. The printing apparatus according to claim 1, wherein a resolution of relative printing position adjustment in the first printing mode is an integral multiple of a resolution of relative printing position adjustment in the second printing mode.

3. The printing apparatus according to claim 1, wherein if a set value of a relative printing position of one of said two nozzle groups must be changed, a set value of a nozzle group to be used to print a dot having a low density is not changed.

4. The printing apparatus according to claim 1, further comprising two-way printing position setting means for, when printing is to be performed by scanning said printhead forward and backward, determining set values of relative printing positions in forward and backward scans of the same nozzle row in the second printing mode, on the basis of set values of relative printing positions determined from a pattern for adjusting relative printing positions in forward and backward scans of the same nozzle row in the first printing mode.

5. The printing apparatus according to claim 1, wherein said first and second nozzle groups are different in size of a dot as a unit of printing.

6. The printing apparatus according to claim 1, wherein said first and second nozzle groups are different in density of ink to be used.

7. The printing apparatus according to claim 1, wherein said first and second nozzle groups are different in color of ink to be used.

8. The printing apparatus according to claim 1, wherein said printhead comprises a first nozzle row including said first nozzle group, and a second nozzle row including said second nozzle group.

9. The printing apparatus according to claim 1, wherein said printhead comprises a plurality of nozzle rows in each of which nozzles of said first nozzle group and nozzles of said second nozzle group are alternately arranged.

10. The printing apparatus according to claim 1, wherein the set value in the first printing mode is input by a user by referring to the pattern.

11. The printing apparatus according to claim 1, further comprising reading means for reading the pattern, and set value selecting means for selecting the set value in the first printing mode.

12. A printing position setting method of an inkjet printing apparatus which prints by scanning an inkjet printhead for discharging ink and a printing medium relative to each other, the printhead comprising a first nozzle group used to print a dot having a first density, and a second nozzle group used to print a dot having a second density, and also having a plurality of nozzle groups, and which has a first printing mode in which only one of the first and second nozzle groups is used during one printing scan, and a second printing mode in which the first and second nozzle groups are driven at different timings during one printing scan, comprising:

a pattern printing step of printing a pattern for adjusting relative printing positions of the plurality of nozzle rows when printing is to be performed in the first printing mode;

a specification step of specifying set values of the relative printing positions in the first printing mode from the pattern; and a determination step of determining, on the basis of the specified set values, set values of relative printing positions of the plurality of nozzle rows in the second printing mode.

13. A computer program for allowing a computer to implement a printing position setting method of an inkjet printing apparatus which prints by scanning an inkjet printhead for discharging ink and a printing medium relative to each other, said printhead comprising a first nozzle group used to print a dot having a first density, and a second nozzle group used to print a dot having a second density, and also having a plurality of nozzle groups, and which has a first printing mode in which only one of said first and second nozzle groups is used during one printing scan, and a second printing mode in which said first and second nozzle groups are driven at different timings during one printing scan, comprising program codes corresponding to:

a pattern printing step of printing a pattern for adjusting relative printing positions of said plurality of nozzle rows when printing is to be performed in the first printing mode;

a specification step of specifying set values of the relative printing positions in the first printing mode from the pattern; and a determination step of determining, on the basis of the specified set values, set values of relative printing positions of said plurality of nozzle rows in the second printing mode.

14. A storage medium storing a computer program for allowing a computer to implement a printing position setting method of an inkjet printing apparatus which prints by scanning an inkjet printhead for discharging ink and a printing medium relative to each other, said printhead comprising a first nozzle group used to print a dot having a first density, and a second nozzle group used to print a dot having a second density, and also having a plurality of nozzle groups, and which has a first printing mode in which only one of said first and second nozzle groups is used during one printing scan, and a second printing mode in which said first and second nozzle groups are driven at different timings during one printing scan, storing program codes corresponding to:

a pattern printing step of printing a pattern for adjusting relative printing positions of said plurality of nozzle rows when printing is to be performed in the first printing mode;

a specification step of specifying set values of the relative printing positions in the first printing mode from the pattern; and a determination step of determining, on the basis of the specified set values, set values of relative printing positions of said plurality of nozzle rows in the second printing mode.

* * * * *

UNITED STATES PATENT AND TRADEMARK OFFICE

CERTIFICATE OF CORRECTION

PATENT NO. : 7,252,364 B2
APPLICATION NO. : 10/788137
DATED : August 7, 2007
INVENTOR(S) : Chikuma et al.

It is certified that error appears in the above-identified patent and that said Letters Patent is hereby corrected as shown below:

On the Title Page of the above-identified US Patent, Item (56) References Cited", Subsection, "FOREIGN PATENT DOCUMENTS", Changes "JP 8-181379 7/1996" to --JP 8-183179 7/1996--.

Signed and Sealed this

Twenty-fifth Day of December, 2007

JON W. DUDAS
*Director of the United States Patent and Trademark Office*